US011134804B2

(12) United States Patent
Mackenzie

(10) Patent No.: US 11,134,804 B2
(45) Date of Patent: Oct. 5, 2021

(54) RELATING TO CLOTHES HANGERS

(71) Applicant: Norman Fraser Mackenzie, London (GB)

(72) Inventor: Norman Fraser Mackenzie, London (GB)

( * ) Notice: Subject to any disclaimer, the term of this patent is extended or adjusted under 35 U.S.C. 154(b) by 665 days.

(21) Appl. No.: 14/907,277

(22) PCT Filed: Jul. 29, 2014

(86) PCT No.: PCT/GB2014/000296

§ 371 (c)(1),
(2) Date: Nov. 13, 2018

(87) PCT Pub. No.: WO2015/015139

PCT Pub. Date: Feb. 5, 2015

(65) Prior Publication Data

US 2019/0246825 A1 Aug. 15, 2019

(30) Foreign Application Priority Data

| | | |
|---|---|---|
| Jul. 29, 2013 | (GB) | 1313486 |
| Oct. 4, 2013 | (GB) | 1317592 |
| Mar. 18, 2014 | (GB) | 1404814 |
| May 6, 2014 | (GB) | 1407942 |
| Jun. 25, 2014 | (GB) | 1411262 |
| Jun. 25, 2014 | (GB) | 1411263 |
| Jun. 25, 2014 | (GB) | 1411265 |
| Jun. 25, 2014 | (GB) | 1411266 |

(51) Int. Cl.
*A47G 25/48* (2006.01)
*A47G 25/20* (2006.01)
(Continued)

(52) U.S. Cl.
CPC ..... *A47G 25/488* (2013.01); *A47G 25/20* (2013.01); *A47G 25/36* (2013.01); *A47G 25/38* (2013.01);
(Continued)

(58) Field of Classification Search
CPC ..... A47G 25/488; A47G 25/20; A47G 25/36; A47G 25/38; A47G 25/06; A47G 25/0607;
(Continued)

(56) References Cited

U.S. PATENT DOCUMENTS 1,268,416 A * 6/1918 Wordingham ..... A47G 25/36 223/87
1,768,005 A * 6/1930 Schwartzman ..... A47G 25/486 24/560
(Continued)

*Primary Examiner* — Ismael Izaguirre
(74) *Attorney, Agent, or Firm* — Rumit Ranjit Kanakia

(57) ABSTRACT

Constituent elements of a clothes hanger comprising one or more planar segments (1, 3) that can be assembled to form a clothes hanger for suspending a garment, the assembly typically involving folding the one or more planar segments and fixing them together, the fixing means (1A, 1B; 2A, 2B; 3A, 3B; 4A, 4B; 5A, 5B, 6A, 6B; 7A, 7B; 8A, 8B) including glue or tabs, wings etc. The clothes hanger may employ planar or tubular grippers hanger tubes for forming or bulking out arms of the hanger, etc. Manufacturing methods are also provided for manufacturing a clothes hanger.

17 Claims, 58 Drawing Sheets

(51) Int. Cl.
*A47G 25/36* (2006.01)
*A47G 25/38* (2006.01)
*A47G 25/50* (2006.01)
*A47G 25/44* (2006.01)
*A47G 25/14* (2006.01)

(52) U.S. Cl.
CPC ..... *A47G 25/445* (2013.01); *A47G 25/482* (2013.01); *A47G 25/485* (2013.01); *A47G 25/50* (2013.01); *A47G 2025/1492* (2013.01)

(58) Field of Classification Search
CPC .... A47G 25/0678; A47G 25/14; A47G 25/24; A47G 25/26; A47G 25/28; A47G 25/30; A47G 25/32; A47G 25/40; A47G 25/48; A47G 25/481; A47G 25/482; A47G 25/445; A47G 25/485; A47G 25/50; A47G 2025/1492; A47G 2025/483; A47G 2025/484
See application file for complete search history.

(56) References Cited

U.S. PATENT DOCUMENTS 1,886,126 A * 11/1932 Sessions ..... A47G 25/30 223/88
1,987,174 A * 1/1935 Zetlin ..... A47G 25/26 223/98
2,034,859 A * 3/1936 Cahn ..... A47G 25/38 223/87
2,099,308 A * 11/1937 Mcallister ..... A47G 25/30 223/98
2,307,256 A * 1/1943 Burwell ..... D06F 59/02 223/69
2,383,819 A * 8/1945 Ronning ..... A47G 25/38 223/87
2,424,048 A * 7/1947 Pankowski ..... A47G 25/20 223/91
2,448,673 A * 9/1948 Kohl ..... A47G 25/30 223/87
2,473,408 A * 6/1949 Alkin ..... A47G 25/485 223/96
2,622,742 A * 12/1952 Oldham ..... A47G 25/16 211/113
2,835,422 A * 5/1958 Stuard ..... A47G 25/30 223/92
2,888,725 A * 6/1959 Cudd ..... A47G 25/485 24/531
3,456,262 A * 7/1969 Coon ..... A47G 25/485 24/501
3,512,228 A * 5/1970 Carvell ..... A47G 25/28 206/409
4,300,688 A * 11/1981 London ..... A47G 25/36 206/285
4,454,969 A * 6/1984 Huth ..... A47G 25/487 223/96
5,005,742 A * 4/1991 Smith ..... A47G 25/48 223/85
D334,480 S * 4/1993 Dongas ..... A47G 25/38 D6/318
5,277,345 A * 1/1994 Ozaki ..... A47G 25/485 223/98
5,546,641 A * 8/1996 Radvin ..... A41F 19/005 24/557
5,967,388 A * 10/1999 Kolton ..... A47G 25/16 223/95
2004/0031825 A1 * 2/2004 Roberts ..... A47G 25/36 223/85

* cited by examiner

Fig.1
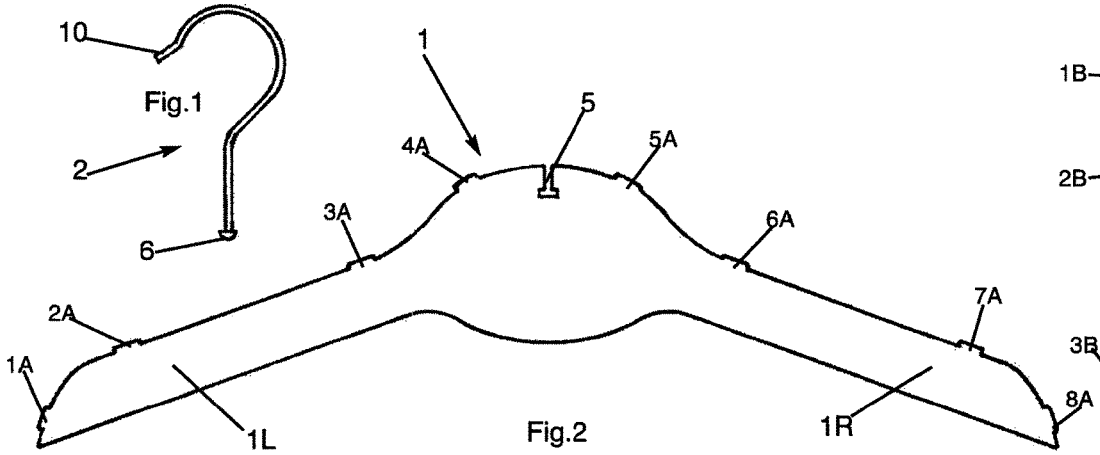
Fig.2
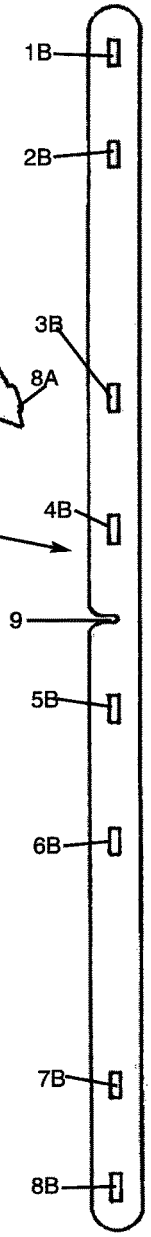
Fig.7
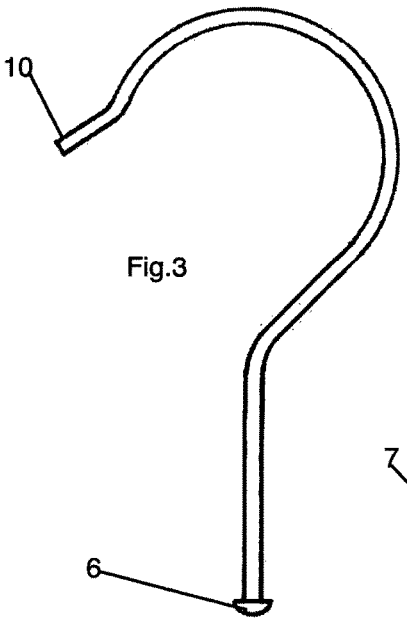
Fig.3
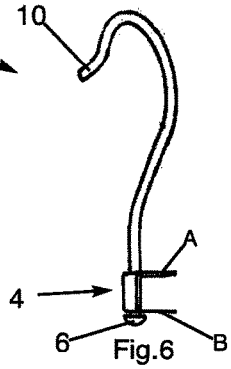
Fig.6
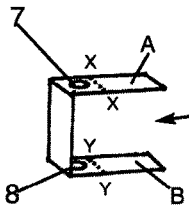
Fig.4
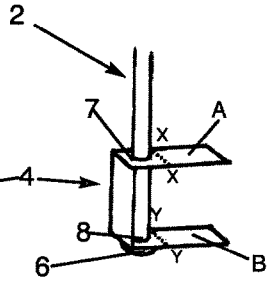
Fig.5

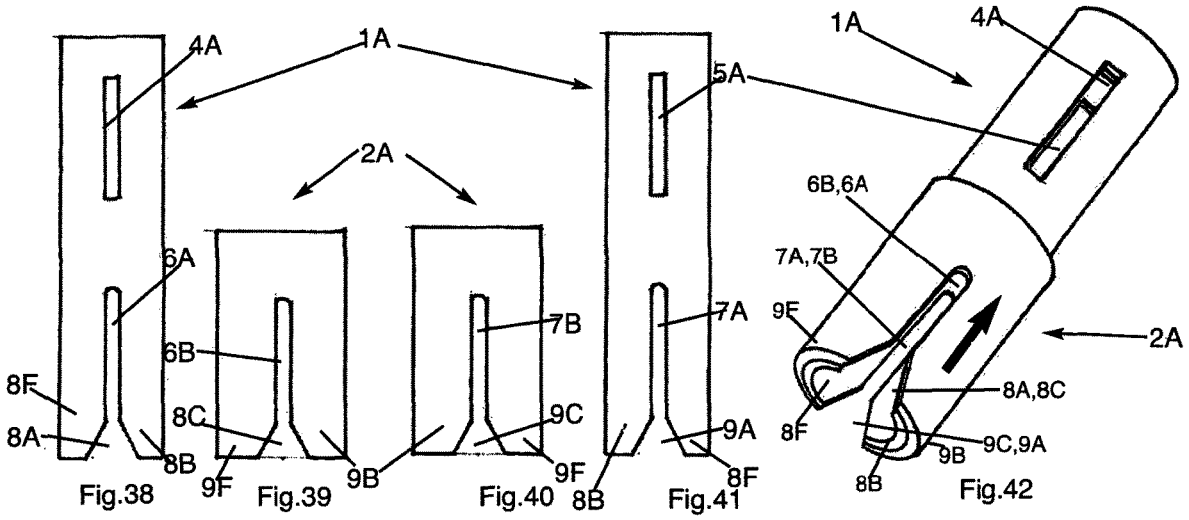
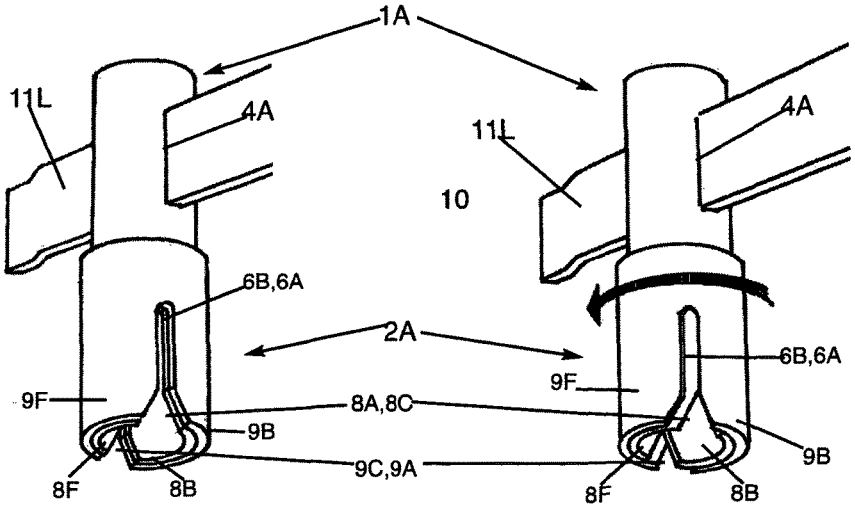
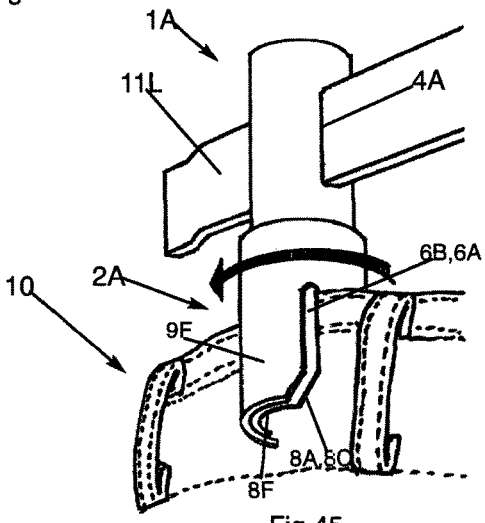
Fig.45

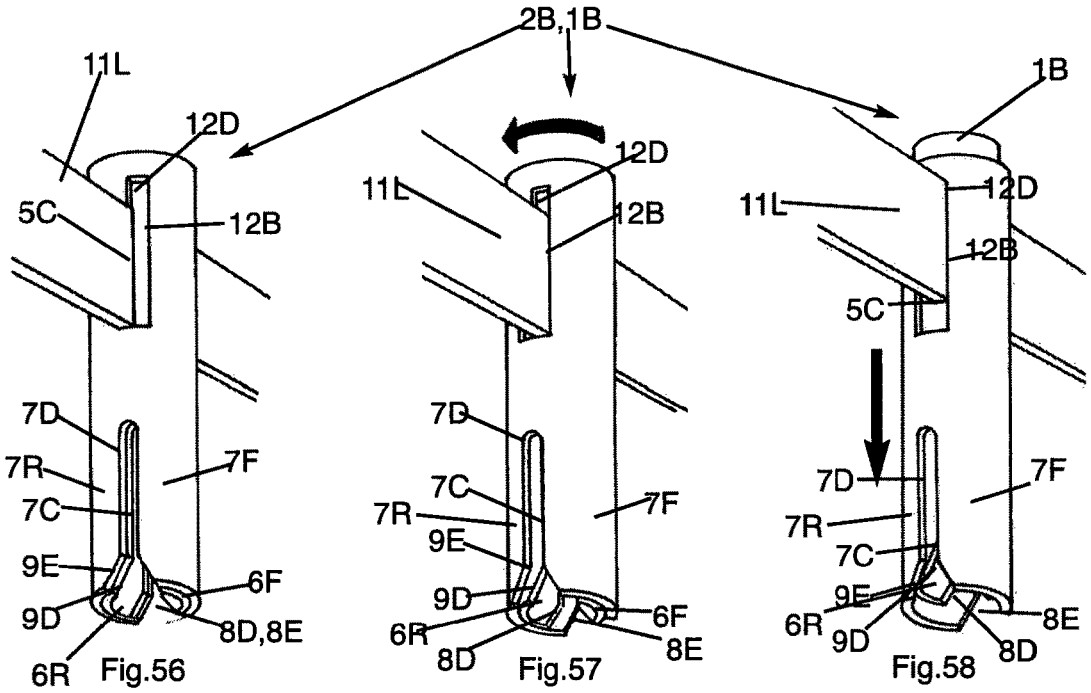
2B,1B
11L
12D
5C
12B
7D
7R
7C
9E
9D
6R
7F
6F
8D,8E
Fig.56
12D
11L
12B
7D
7C
7R
9E
9D
6R
8D
6F
8E
Fig.57
1B
11L
12D
12B
5C
7D
7R
7C
9E
6R
9D
7F
8E
8D
Fig.58
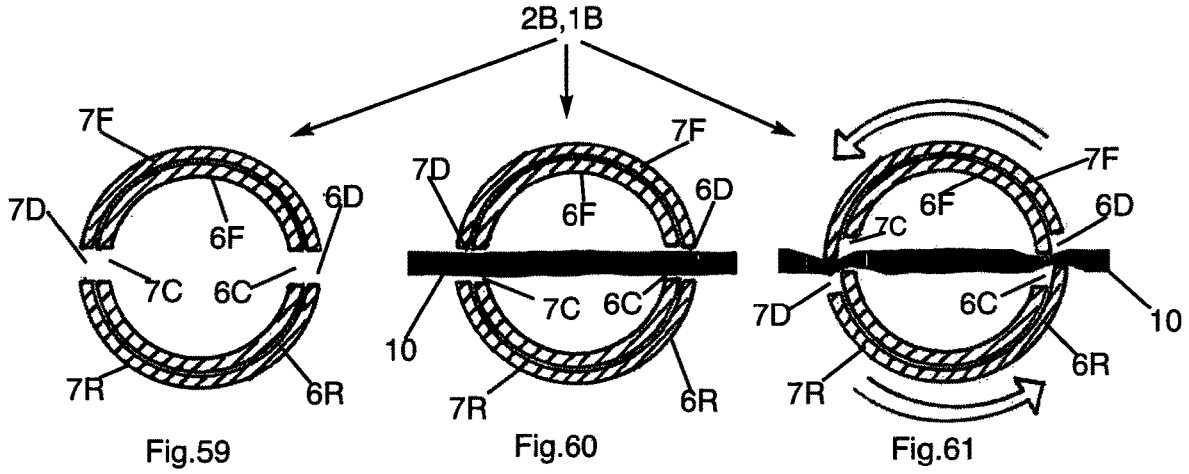
2B,1B
7F
7D
6D
6F
7C
6C
7R
6R
Fig.59
7F
7D
6D
6F
7C
6C
10
7R
6R
Fig.60
7F
6F
6D
7C
7D
6C
10
6R
7R
Fig.61

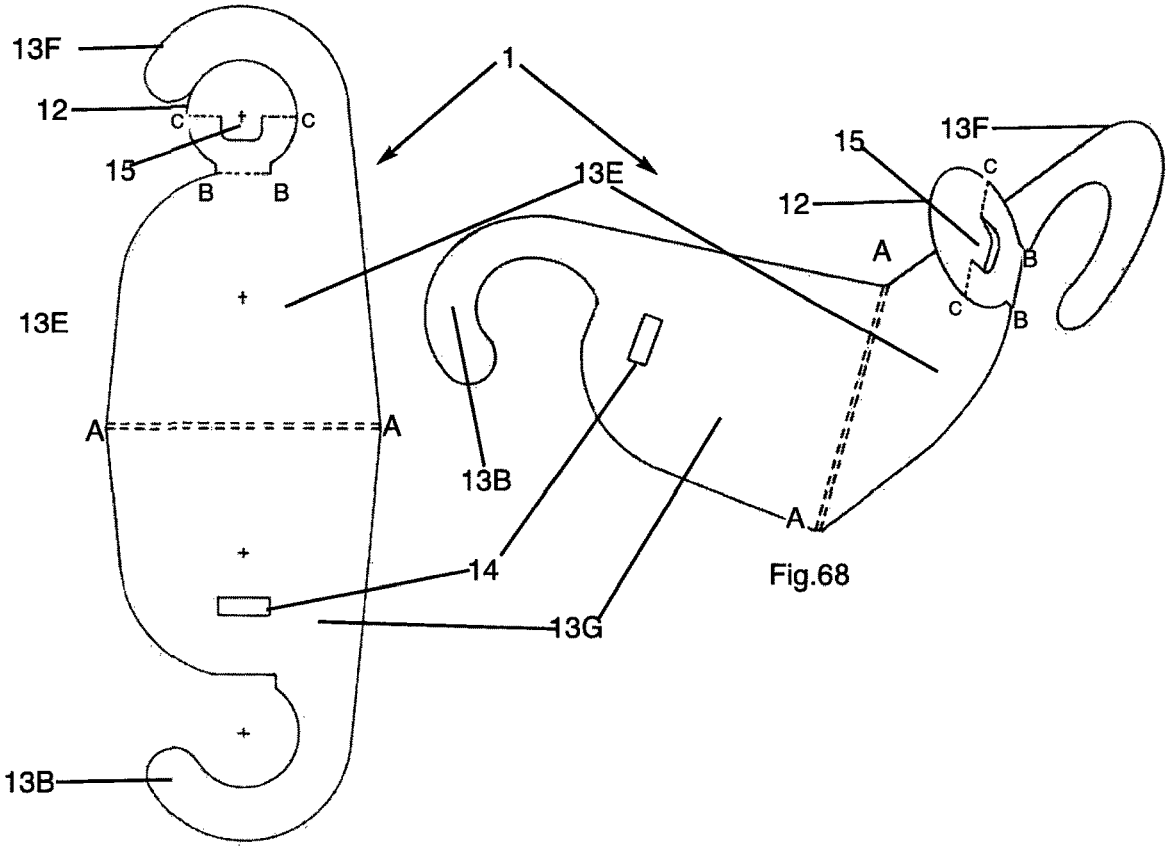
Fig.68
Fig.67
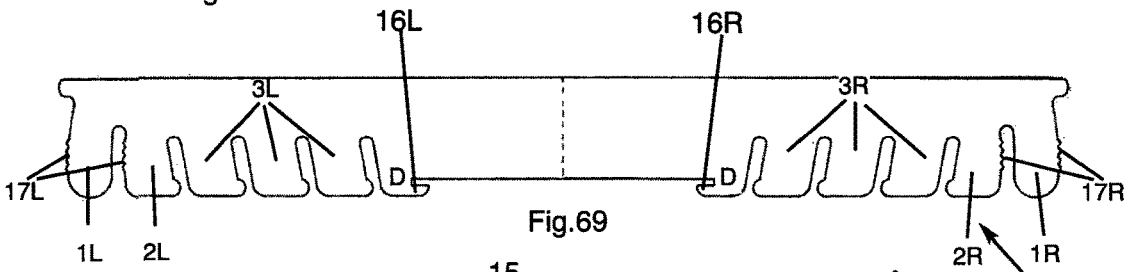
Fig.69
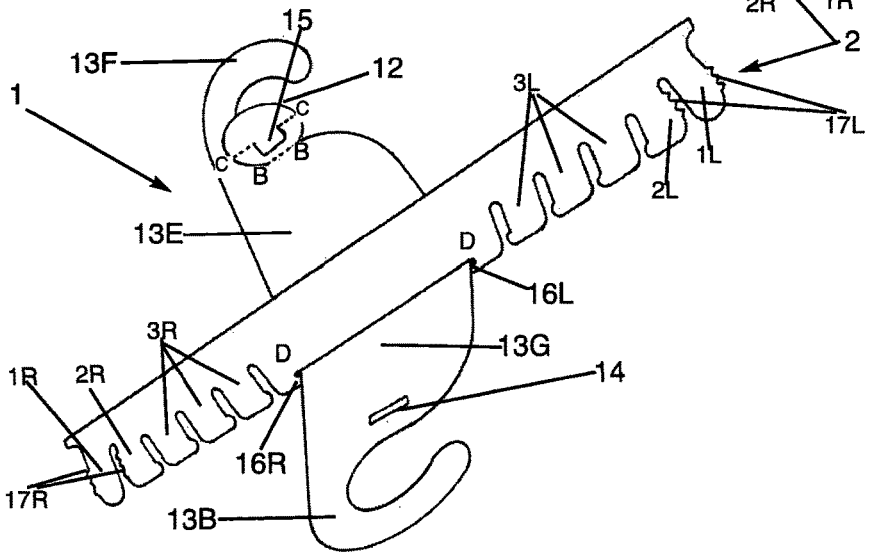
Fig.70

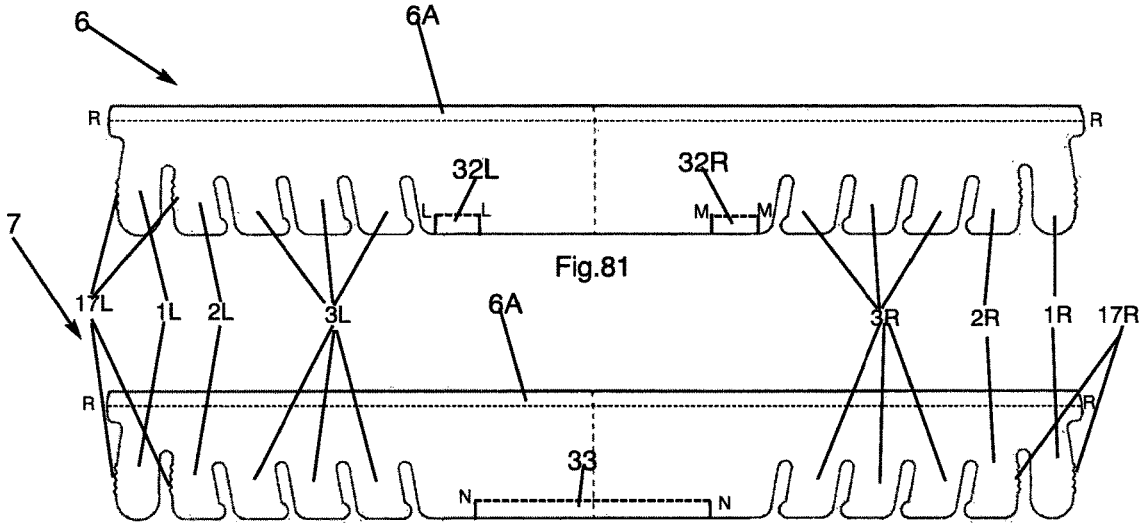
Fig.81
Fig.82
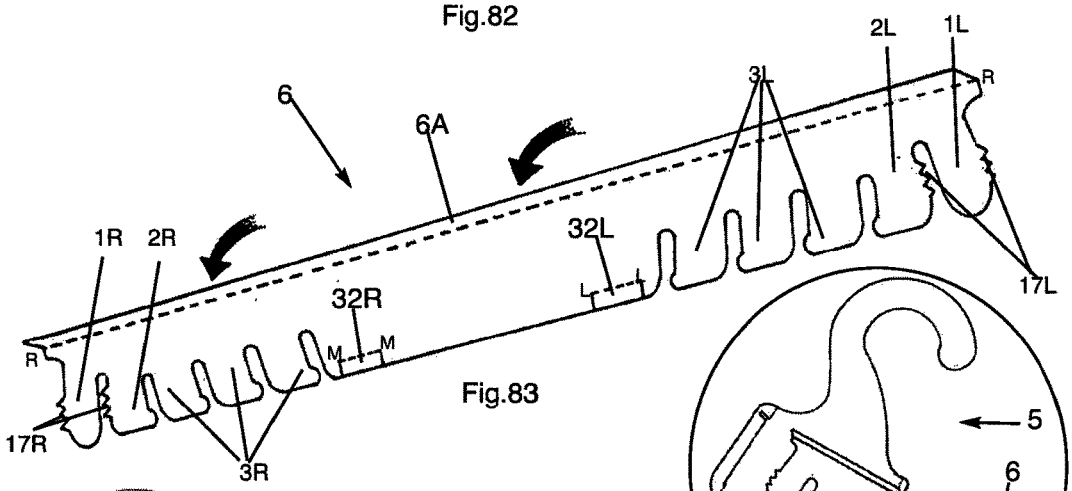
Fig.83
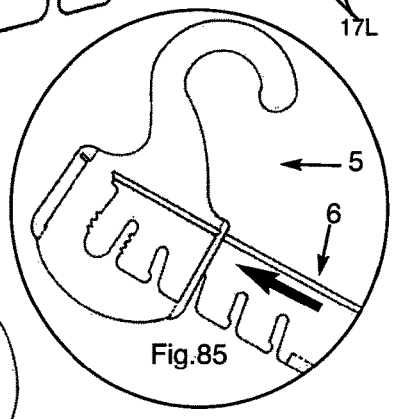
Fig.85
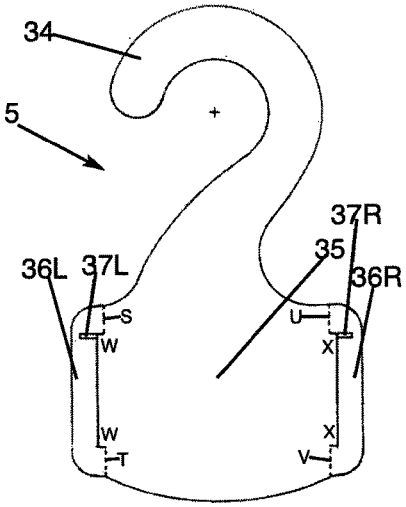
Fig.84
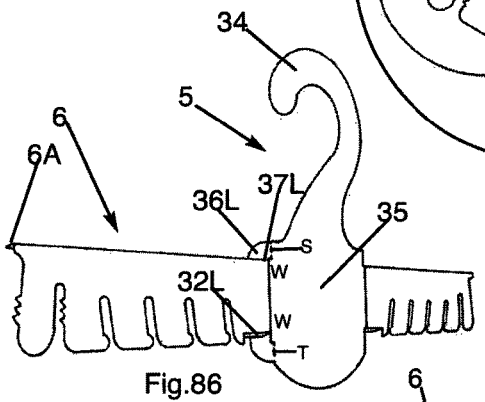
Fig.86
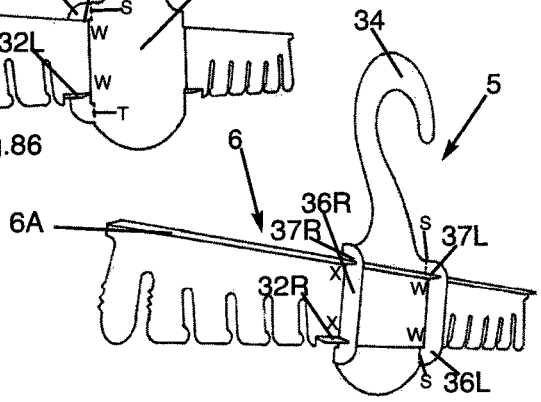
Fig.87

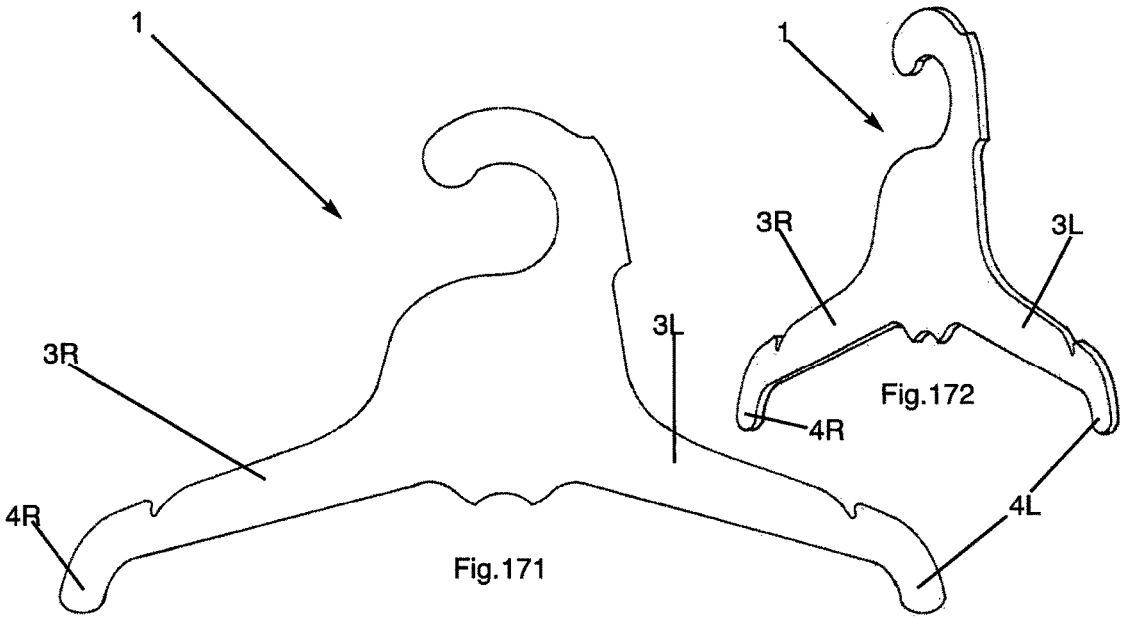
Fig.171
Fig.172
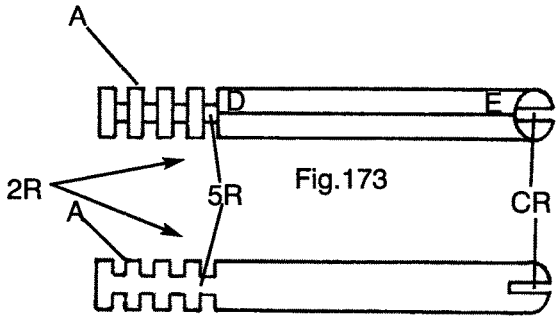
Fig.173
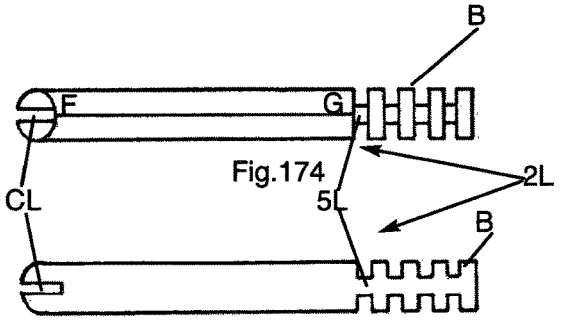
Fig.174
Fig.175
Fig.176
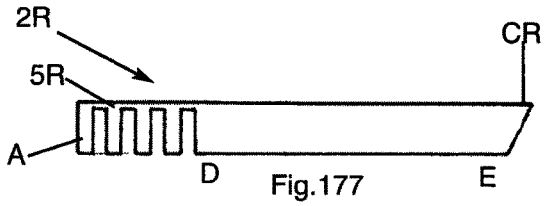
Fig.177
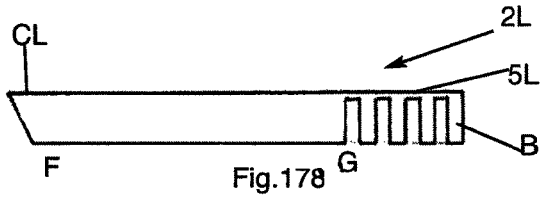
Fig.178
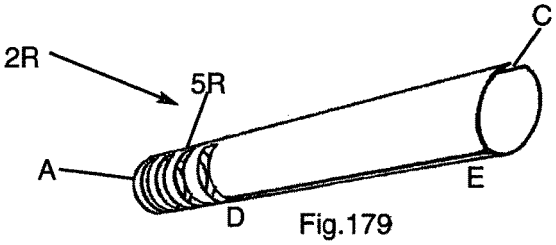
Fig.179

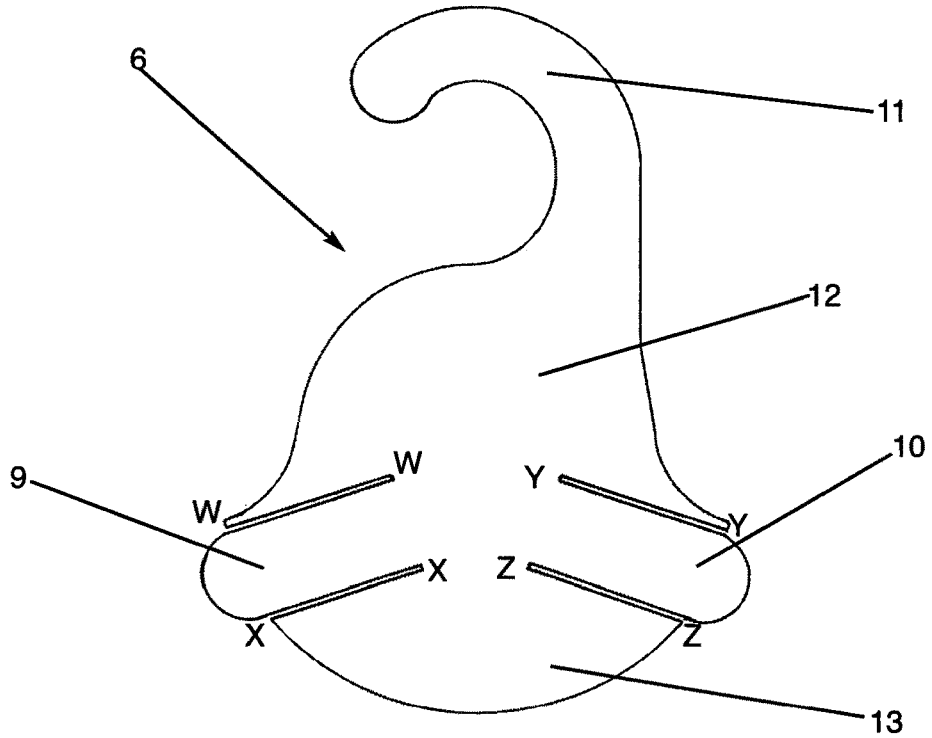
Fig.187
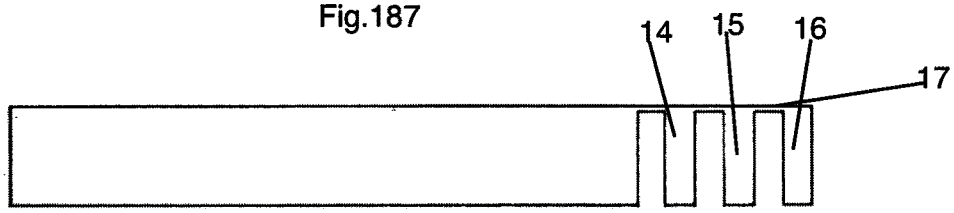
Fig.188
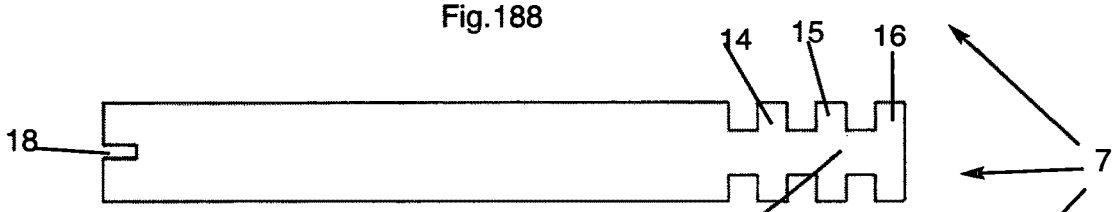
Fig.189
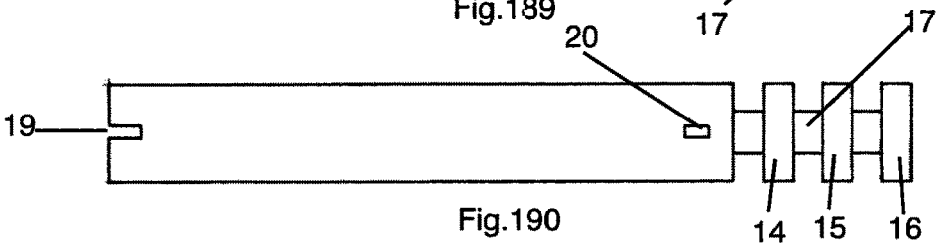
Fig.190
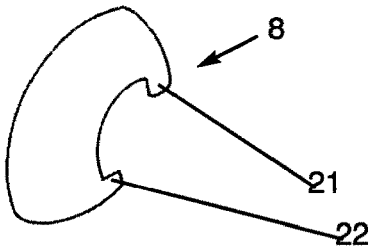
Fig.191
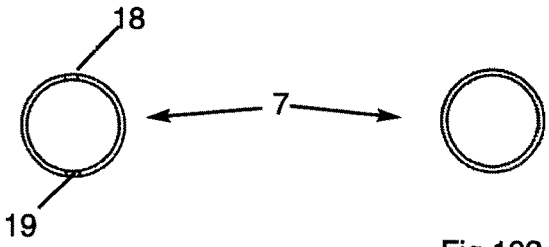
Fig.192
Fig.193

RELATING TO CLOTHES HANGERS

BACKGROUND

The present invention relates to clothes hangers, clothes grippers and related accessories, and particularly in the case where one or more planar segments are exploited.

Companies are constantly seeking to encourage people to purchase their goods, and to encourage existing customers to purchase more. They are also constantly looking for interesting ways of presenting their products. Furthermore, companies are constantly looking for new ways to deal with issues raised by concerns such as the welfare of the environment, and therefore there is a constant demand for the kind of display apparatus which will not only provide the best way of showing garments, but which will address those issues which are of increasing concern to the public without neglecting to enhance and promote the products by providing an impression of quality and value.

With clothing, for example, which is being offered for sale in a modern retail environment, a hanger is an important 'point-of-sale' ('POS') tool, which may be provided with features which can show a garment in its best possible aspect, so it needs to be both attractive and functional. The combination of quality and attractiveness with low-cost is almost always part of the requirement of any POS artefact, and the increasingly important necessity to comply with, and be seen to comply with environmental concerns, means that many clothing retailers are seeking to use new, recyclable, and environmentally friendly materials, which means that designs which work with plastic and metal will not be suitable for materials such as paper, wood or fiber-boards of various types, or any material which comes mainly is sheet form.

SUMMARY

The invention is defined by the independent claims below. Dependent claims are directed to optional features and preferred embodiments.

In any of the claimed aspects mentioned below, any one of the constituent elements, particularly those relating to the hanger frame, top strip, bar, hook (when not wire-based), planar grippers, etc., or other planar element, may be formed from sheet-based material, preferably paper-based sheet-based material. They may be die-cut.

Top Strip

This aspect of the invention is primarily defined in claims 1 to 17.

Currently most clothes-hanging apparatus is made from moulded plastic, and requires industrial processes, which are far from eco-friendly. With regard to a hanger which may be made from a variety of materials, for example, cut out from sheets of material, e.g., paper, board of various types, metal, or any inexpensive material which comes in sheet form, one disadvantage has been that a substantially planar hanger does not provide an upper surface on the arms, of sufficient width to show the garment to its best advantage, therefore, a number of possibilities exist for the development of the hanger by either changing the type of construction or by the addition of extensions and attachments, which may strengthen the apparatus, while using less material, thereby reducing costs.

In the present development, a substantially planar hanger has been developed in different formats, to form a lighter, stronger hanger using less material, by the addition of a strip, or strips of material along the top of the arms, which may be held by means of a number of tabs projecting from the top surface of the arms, engaging with a series of slots cut along the length of the said strip or strips, which may also be glued or pinned to the arms, to form an upper surface of sufficient width to present a fuller appearance or 'body' to the garment hung thereon.

Additionally, the hanger may be provided with an incorporated hook as part of the hanger, or have a hook made from either the same material as the hanger, or of metal or plastic, or some other material, attached separately. In the present embodiment both an incorporated hook, and a range of different hooks have been described, with a metal hook, rotatable or fixed, being featured.

Planar Grippers

This aspect of the invention is primarily defined in claims 18 to 47.

With regard to cost, a hanger which can offer a simpler mechanism for gripping a garment such as pants or skirts, made from a recyclable material, such as paper, for example, than the current sprung grippers made from metal or plastic, would be a welcome addition to those seeking to use more environmentally friendly materials. Furthermore, since the raw material in this case, comes in sheet form, the design and construction of such a hanger would require to be adapted so that the maximum number of units could be made from a sheet, in order to reduce both waste and cost.

There are therefore two developments; the first, relating to ways of gripping garments for display or storage, which metal and plastic spring-clips currently do, by utilizing a different way of holding and retaining a garment with a design made by a simple die-cut from material which comes in sheet form. The second relates to the construction of the hanger, also from sheet material, whereby the hanger is created in two parts which allows more units to be cut from a sheet, thereby diminishing waste, and reducing unit-costs. Cost savings would also result from a two-piece artifact, as only one element may be printed with branding, and any information a specific customer required, while the other may be bulk produced, unprinted, across and applicable to, a range of clients and brands.

According to the first development, therefore a hanger is provided with a substantially planar gripper, consisting of one or more vertical channels, open at the lower end, pointing downwards, with one or more 'teeth' projecting from either side of the channel, and so that a tooth on one side faces the space above or below the tooth on the opposite side, and not set opposite each other. The teeth project inwards and upwards from the channel wall, with the lower surface of each tooth at an upward angle, to meet the top surface of the said tooth, which projects outwards from the channel wall horizontally, or near horizontally, at a sharp point. This design forms a 'zig-zag' channel between the teeth, allowing the garment a smooth ingress, but a more restricted egress because the weight of the garment tends to pull it downwards, thereby engaging the material with the upward-pointing teeth which act as 'barbs' retaining the garment in the gripper. Release is effected by pulling down sharply on the garment. If the gripper is made from paper or board, the teeth are able to 'flex' slightly and are more 'forgiving' than such a gripper made from plastic or metal would be, limiting any damage which may occur to a normal piece of material. A version where the teeth oppose each other directly across the channel, may be effective for thinner material, but inserting a garment therein, would be more difficult, as would extracting it.

According to the second development, a substantially planar hanger is created in two or more parts, each of which said parts may be made from the same material. In this embodiment the bar has been created separately from the hook, allowing many more units to be created from a sheet, and brought together to form a single hanger. In order to form a series of hangers in this way, a method of registration has been designed so that the two parts come together in exactly the same way, and in the same position each time. A bar section has been created and may have a small projecting base set centrally on the underside, between the two arms of the hanger bar, into which one or more, (in this case two), small indents have been cut, a short distance apart. The hook section, which may be contoured at its base to same shape as the previously described underside of the hanger bar, also has cut into the base, exactly the same configuration of indents. The bar is placed on a platform, which may be flat, or part of a carousel or drum in the case of mass-production, into which have been set two pins, pointing outwards from the surface of the platform, and corresponding exactly in size and position to the indents on the hanger bar and hook sections. The bar is placed on the pins so that the pins occupy the indents on the base of the hanger bar. When the hook section is placed on top so that the indents on its base are set upon the pins in the same way, with an adhesive between the two parts, an accurate registration of the two parts forms a complete hanger. The join may also be effected by methods other than adhesives, such as staples, pins, clips or such like.

Tubular Grippers

This aspect of the invention is primarily defined in claims 48 to 68.

With regard to cost, a hanger which can offer a wider spectrum of applications in one unit would be a useful way to bring down costs, or a hanger which could be adapted to perform more functions by having extensions which may be attached and removed easily by shop-staff, would reduce the need for the retailer to have to purchase large numbers of hangers which each had a different and unalterable function.

The present disclosures relate to ways of gripping garments for display in the way that metal and plastic spring-clips currently do, and all four embodiments in this series utilise a cylindrical or tube structure, and although these may be made from plastic or metal, the designs are particularly suitable for the commonly available paper or cardboard tube, which is often made from recycled paper and may be recycled again and again.

According to the present development therefore, there is provided apparatus in four embodiments made in a substantially cylindrical form, from tubing configured by a series of slits, cuts, or apertures to grip a range of garments, and be suspended from a hanger, hook, bar, pin, cordor other, singly or in multiples, taking advantage of the inherent rigidity and limited flexibility of a manufactured tube or tubes. In the first embodiment, a short length of tube has been cutwith two parallel slits or apertures, open at one end and running about halfway along the length of the tube, opposite one another across the diameter of the cylinder to form 'jaws' above and below the slits, which may be configured with indents or teeth on one or both edges of each slit. The open end of these apertures are made wider at the lower open end by being cut in a 'V' shape to form a 'mouth' so that a garment may be forced in and held between the two jaws of the tube, which may have further apertures cut into the opposite or top end allowing it to be suspended from a hanger, hook, bar, pin or other. This embodiment may also be used after the fashion of a clothes-peg, to attach clothing or textile to a rope, cord or beam of any description.

The second embodiment involves two tubes cut in a similar configuration to the first, made to fit tightly one inside the other such that the slits which form the jaws line up and allow a garment to be inserted into the open end. In this case, the grip is enhanced by turning the outer tube around the inner tube, causing the edges of the slits of the outer tube to converge on the edges of the slits on the inner tube, narrowing the aperture and gripping the garment within the slits.

The third embodiment is similar, except that the outer tube requires that the inner tube be held stationery in relation to the outer tube, by means of being attached to a hanger where the bar passes through both tubes. The aperture through which the bar passes, therefore, in the outer tube is cut wider to accommodate the rotation, and also has an additional locking slot cut, which may be either above or below the larger aperture in the outer tube, whereby pulling downwards, (or pushing upwards, if the locking slot is below) on the outer tube when the apparatus is in the closed position, causes the bar to enter the slot, thereby locking the outer tube in situ when the garment is in place, providing an even stronger grip. The fourth embodiment utilises a different aspect of the tube by cutting a slit along the length of a short section of tube, with 'V' sections cut out from either end to form a 'mouth' where a garment may be forced into either end of the slit to be gripped by the jaws formed on either side of the slit. This gripper may be attached in two's to a hanger through horizontal slits allowing for horizontal movement, or singly, attached to an 'S' hook, pin, cord etc.

Developments in Garment Display

This aspect of the invention is primarily defined in claims 69 to 87.

With regard to the environment, an industry where the vast majority of hangers are made from plastic has seen an increasing demand for more environmentally friendly materials, and an end to polluting industrial processes. Also, with regard to cost, the present designs have created the hangers from more than one part whereby more units may be created from less material. Such a design may utilise less expensive materials by skilful deployment of stronger material to the place where it is necessary, thereby allowing those parts of the hanger which do not require strength to be made from less, or weaker and therefore less expensive material, driving down unit costs. Also, in the case of a printed hanger, printing a one piece hanger can be extremely costly, and therefore a two-piece hanger would be very much less expensive as one part, for example, the crossbar, which may be made in bulk and in a range of sizes, could be left blank, while the hook/sleeve could be printed with a range of different graphics on a single sheet. This would dramatically increase the number of units cut from one sheet while at the same time reduce the number of sheets to be printed. This is to say that a hanger created from more than one piece could have the advantage of standardising one part and manufacturing that part in bulk. Size differentials could be set by the size of the crossbar, allowing different sizes of hanger to be made at less cost.

In some embodiments, features such as folds of one kind and another have been incorporated into the design in order to create rigidity in an otherwise flimsy piece of material in order to render it capable of bearing tension or weight without giving way. Furthermore, if the hanger, either in its entirety, or if the load-bearing parts were constructed from layers of material, and the grain in each of those layers were set in different directions, the strength would be significantly increased, and allow the reduction in the amount or weight of the material used.

In the present embodiments therefore, a series of hangers have been developed to be made from inexpensive sheet material, e.g., plastic, paper etc. Although the present embodiments are designed for smaller garments, it will be appreciated that the mechanisms and constructions will be applicable to hangers of all kinds, for example a heavy garment hanger may be made with the same design, i.e., a stronger one-piece bar and a hook designed in a similar way as the examples shown here. The present designs fall into two categories: one for garments which have a horizontal tension, e.g., pants, and garments which hang, e.g., ladies bras.

According to the present development therefore, two basic types of garment hanger have been developed: one designed to hold and display a garment using its own horizontal tension such as pants, the other to hold a garment which hangs, such as a ladies bra. Although the method of attaching the garments has become fairly standard, the present embodiments have developed a number of construction methods allowing the hangers to be created from materials, e.g., paper or card, which may incorporate a surface or panel of various sizes, and be printed to carry information/graphics, and designed in such a way as to create maximum strength from a minimum of material. The hangers discussed here are in two parts, a hook made from one piece of material, either folded to form a sleeve, or as a single piece designed to engage with features on the crossbars, which are of two basic types, configured to engage with a range of hook/sleeve attachments. The hook/sleeve assembly may attach to the crossbars by being folded around the centre and secured by glue, rivet, staple, clasp, pin, a tab or tabs, or have small 'wings' through which the crossbar may slide into position, or be suspended by a tab which may hook through the hook/sleeve assembly, and through an aperture in the crossbar like a 'pin', and be supported on the opposite side of the sleeve. Alternatively, the hook and bar may be made of one piece each, unfolded and simply glued, stapled, pinned or conjoined in some way, surface-to-surface, as a way of reducing the amount of material used, by making each part smaller, and thus enabling more units to be cut from a sheet.

Sliding Clamp

This aspect of the invention is primarily defined in claims 88 to 106.

Currently most clothes-hanging apparatus is made from moulded plastic, and requires industrial processes, which are far from eco-friendly. With regard to a hanger which may be made from a variety of materials, for example, in layers cut out from sheets of material, e.g., paper, or any material which comes in sheet form, a number of possibilities exist for the development of not only the hanger but the additions and extensions, which until now have mostly had to utilize metal and plastic, in the form of spring-clips etc., to which most users would prefer to find an alternative.

In the present series of embodiments a number of extensions which may be created from more sustainable materials have been developed which mainly work in pairs, and which may form part of each arm of the hanger, or attach to the hanger by various means for the purpose of holding a garment which cannot be draped over the hanger. In the first series of extensions, when a garment is deployed on the extensions, the outward movement of the extension retains the garment using the garment's own tension, causing it to lock against the arm of the hanger, displaying the garment flat so that it's profile may be displayed to greatest effect. In the second and third series, a clamping mechanism has been developed, one, integrated into the hanger itself, the other a separate apparatus which attaches to the hanger arm, both functioning to grip the clothing along an edge, by the formation of 'jaws' forced together by clamping them at the outer edges by means of a piece of material having an aperture cut into its centre, which, when slid over the jaws, will encounter an increasing width as it moves, upwards in one case and downwards in the other, causing the jaws to come together, providing a grip on whatever material is placed between them.

In the first embodiment, the extensions may be of sheet construction, one embodiment having a single projecting leg, another having two, which may be attached around each arm of the hanger, either by wrapping around or sliding onto each arm of the hanger by means of a loop or box formed at one end of the extension, between the surfaces. The extensions may function in pairs, and be made from layers of material such that when the pre-cut form is folded and bonded, the loop or box, open at both ends has projecting downwards below it, one or more rigid members or legs. The box may either slide onto, or be wrapped around each of the hanger-arms, and is made to a size where the fitting affords horizontal movement along the arms of the hanger when pushed or pulled along the length of the arm by applying pressure to one side of the box part or the other.

When pressure, however is applied to the projecting leg below the box, the extension will not move, as pressure applied at that point causes the box to tilt slightly, effectively anchoring the extension against the hanger arm. In this way when a garment is located on the extensions, and the extensions are moved outwards along the length of the arms of the hanger, the tension generated by the garment anchors the extensions in situ, keeping the garment flat and facing outward. The extensions may be kept from coming off the hanger by the creation of a slightly wider end-piece or pommel at the outer end of each hanger arm. In the case of an extension with more than one leg, or having a divided leg, any garment which is too wide for the hanger, may have some of the extra material taken up by first hooking the outer edges of the garment around the legs on the inner sides of the extensions before setting it in situ to display the frontal view.

Additionally, extensions of this type, which rely on the garments providing the tension for, may have a number of different formats, e.g., different angles of projection, and a range of contours on those edges which come in contact with the garment, plus surfaces or edges which may be 'toothed' or serrated in some way to improve grip. The number and size of extension may also vary with the range of garments displayed upon the hanger. Other formats might be the addition to the hanger of one or more fixed legs, i.e., made as part of the hanger and combined with one or more movable legs. For example, the fixed leg, or legs may be created at the outside end of the hanger arms, with the movable leg or legs set near the centre, or the fixed leg or legs may be set in the centre, with the movable leg or legs being positioned along the arms of the hanger. A variety of formats may be created where garments of most sizes may be securely fixed to one more of the fixed legs, and be tensioned into a display position by moving the movable legs inwards or outwards depending on which format was used.

In the second embodiment, the hanger arm itself has been divided into two at the outer ends, by means of a slit extending from the centre of each arm and widening towards the tip to form upper and lower 'jaws' at the outer ends of the arms. The upper jaw increases in width as it extends inwards towards the centre of the hanger, so that when a clamping device, a piece of material having an aperture cut slightly smaller than the width of the distance between the outer edges of the jaws is slid onto the outer ends of the hanger arm, the jaws are forced together, trapping any material such as a garment between them. In this embodiment, the lower jaw has cut into its lower outer edge, a small indent into which the lower end of the aperture on the clamping piece fits, forming the centre of a radius around which the clamping piece pivots, the lower end remaining stationery, held in the indent, while the upper end rotates upwards along the outer edge of the upper jaw which increases in width along its length towards the centre of the hanger, causing the upper and lower jaws to be drawn together, gripping any material between them.

In the third variant, a separate gripper is formed along the same principle as the previous example. A piece of material has been created to form, roughly, the shape of an inverted 'U' to form two 'jaws' which are as in the previous example, brought together by a clamping piece formed with an aperture cut slightly smaller than the outer width of the jaws, although In this variant, unlike the previous, the clamping piece slides on from behind the jaws whose outer edges are graduated to create a width which increases towards the outer tips of the jaws. The apparatus slides onto the hanger arm through another single vertical aperture cut into the material above and between the jaws, after the clamping piece has been slid onto the apparatus from the top end, to sit above the jaws and below the aperture, allowing the apparatus to be attached to the arm of the hanger. The clamping piece is prevented from coming off the end of the jaws by two small projections extending the width of the outer edges of the jaws, just before the tips. In this embodiment, the central vertical aperture which allows the jaws to be slid onto the hanger arm, is closed at its lower end, although another variant may be considered, without the aperture being closed at that position, to allow the apparatus to be 'dropped' onto the crossbar of a 'closed loop' hanger, with the clamping piece being slid onto the jaws from the open end of the jaws, the width graduation being made to increase as the clamping piece slides upwards to bring the jaws together, in a similar manner to the previous example.

Clips

This aspect of the invention is primarily defined in claims 107 to 121.

With regard to cost, a hanger which can offer a wider spectrum of applications in one unit would be a useful way to bring down costs, or a hanger which could be adapted to perform more functions by having extensions which may be attached and removed easily by shop-staff, would reduce the need for the retailer to have to purchase large numbers of hangers which each had a different and unalterable function. Similarly, the provision of a hook created from the hanger itself, would dispense with the need to permanently attach a separate hook. For example, a shirt requires to be draped over the shoulders of a hanger; while a skirt of a pair of trousers requires to held at the waist, normally by a clips or hooks. Currently these are mainly provided in the form of two different hanger-types, and therefore the provision of, for example, a separate clip-section which could be attached to, or removed from a hanger which was shaped to carry a shirt, would extend the use of that hanger without having to use a totally different hanger.

According to the present invention therefore, there are provided two types of additions or extensions designed to attach to a hanger, the first of which is applied to a dedicated gripper hanger which has adapted the gripper by cutting out from its surface, or by adding an extension, such as a clip of some kind, to allow the gripper to attach directly onto part of the hanger, which may also be adapted by the addition of slits or apertures cut into its surface allowing the grippers horizontal movement along the width of the hanger. In the second, a standard hanger designed to hold a garment such as a shirt, jacket, coat, dress etc., by supporting the shoulders from inside in the traditional manner, has the grippers attached to a rail slung under such a hanger to support a different kind of garment from below, such as trousers, skirts etc.

Hanger Tubes

This aspect of the invention is primarily defined in claims 122 to 144.

Currently most clothes-hanging apparatus is made from moulded plastic, and requires industrial processes, which are far from eco-friendly. With regard to a hanger which may be made from a variety of materials, for example, in layers cut out from sheets of material, e.g., paper, metal, or any inexpensive material which comes in sheet form, a number of possibilities exist for the development of the hanger by the addition of extensions and attachments.

In the present development, a hanger attachment has been developed in two different formats, to form a basic, fixed or detachable contoured shoulder piece, which may be applied to a substantially planar hanger to provide the hanger with a smooth, contoured upper-edge. The attachments consist of tubes, which like the hanger may be made from a variety of materials, e.g., paper, metal or any inexpensive and readily available material. In the first embodiment the tube is cut partway along the length of the tube to allow it to drop over the entire length of the arms of the hanger, and at the outer ends, configured by a series of excavations or cuts into the underside of the tube to form a series of downward-pointing 'loops' supported by a central spine, allowing it to bend around to form a smooth downward pointing contour at the outer end of the shoulder, and held in position by the downward pointing tips of the hanger-arm. In the second embodiment, there is provided a substantially planar hook and centre section, but without the 'arms' of a hanger, incorporating two outward pointing members, contained within, but each separated from the centre section by two parallel cuts, set on either side of the centre section, said outwardly pointing members providing support for the tubes which slide onto the members along the cuts provided, and kept in place by being gripped top and bottom within the cuts. At the inner ends of the tubes, two small indents running parallel to the length, and cut into the upper and lower edges of the tube-ends, adjacent to one another across the circumference also keep the tubes in position. The rounded contour at the outer, sectioned ends of the tubes is achieved in the same way as described in the first embodiment, but as there are no 'arms' the outer ends are held in the downward-pointing position by the insertion of small formers or stays, which have a tab at one end which locks into an aperture cut into the bottom of the circumference of the tube, just before the loop-section begins, and a retaining tab at the other which hooks onto the outer edge of the last loop, pulling the loops downward and allowing the spine at the top to bend into a smooth downward-pointing contour. Such extensions may also be fixed to the hanger by being glued or pinned or locked onto the hanger for additional security and durability.

Quick Fix Hook

This aspect of the invention is primarily defined in claims 145 to 155.

Another consideration emerging in the modern business sector, is a growing requirement to provide products which are environmentally friendly, and sustainable, in their manufacture, recycling or disposal. Currently most clothes-hanging apparatus is made from moulded plastic, metal or wood and requires industrial processes which are far from eco-friendly, so a hanger which can fulfil that requirement, and yet be robust enough to withstand the harsh punishment it receives when being propelled at speed, in large numbers along clothing rail channels at the factory or warehouse prior to being loaded onto vehicles, would be a welcome addition to a company's equipment resource.

With regard to a hanger which may be made from a variety of materials, for example, in layers cut out from sheets of material, e.g., paper, or any inexpensive material which comes in sheet form, a number of possibilities exist for the development of not only the hanger but the additions and extensions which most users would find useful and beneficial in both the retail environment, and in the transporting of clothes. As a purely paper or board hanger would be unlikely to be able to withstand the robust movements of a high-speed clothing rail, a board hanger has been equipped with a metal hook, which is the point at which the hanger is most subject to stress, and a hook which has the added benefit of being able to be attached and detached in a simple movement, and yet be strong and tightly attached, to allow the paper part to be recycled at the end of its life without having to use complex industrial process to separate the two elements.

In the present embodiment, a paper or board hanger has been configured with two apertures, one above the other located in the centre or heart of the hanger, whereby a hook made from metal wire consisting at the top, of the standard hook which attaches the hanger to a clothing rail, a loop created in the centre of the stem immediately below the hook, and a spur created from the wire as it descends below the loop and up again to turn at right angles to meet the section descending below the loop. At the base of the apparatus, the 'U'-bend itself is bent outwards from the stem-side of the loop to form a spur which also points upwards at a slight angle. The loop enables the apparatus to be attached to the hanger very firmly, when the apparatus is inserted through the top aperture by inserting the spur into the aperture, so that the spur faces inwards towards the surface of the hanger. Pulling the hook upwards allows the 'jaws' formed by the stem and the loop to grip the section of the hanger above the top aperture, and further pulling in an upward direction brings the spur at the base of at the apparatus into the lower aperture, locking and stabilising the hook in situ in the hanger itself. The apparatus is removed from the hanger by simply pressing the spur back through the lower aperture from the other side of the hanger and pushing down on the hook to release its grip.

BRIEF DESCRIPTION OF THE DRAWINGS

Embodiments of the present invention will now be described by way of example with reference to the accompanying drawings, in which:

Top Strip

FIG. 1 shows a standard metal or wire hook with a small 'pommel' at the base.

FIG. 2 shows the main section of the hanger in elevation, with the projecting tabs on the upper surface.

FIG. 3 shows an enlarged view of the hook shown in FIG. 1.

FIG. 4 shows a perspective view of the bracket which holds the hook in situ, and allows it to rotate 360 degrees within the slot in the hanger.

FIG. 5 shows the bracket as located on the end of the shaft of the hanger, just above the pommel.

FIG. 6 shows a full view of the hook with the bracket attached.

FIG. 7 shows a plan view of the top-strip with the slots running along the centre of the length of the strip.

Planar Grippers

Figure 18:
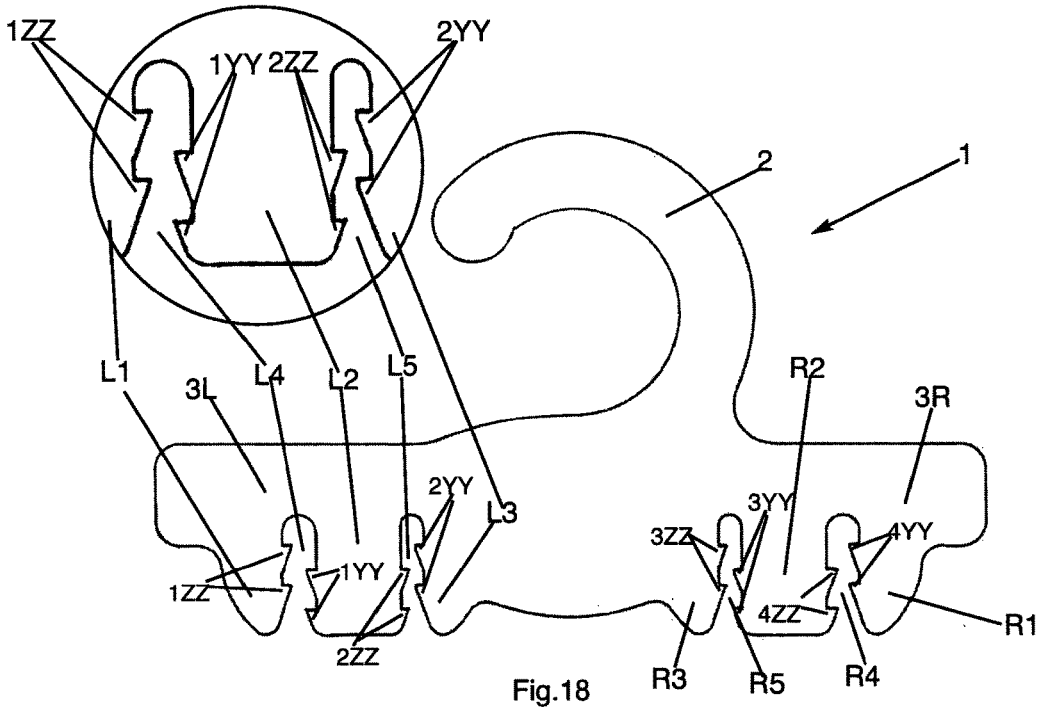

FIG. 18 shows a hanger with two sets of grippers plus an enlargement of the gripper.

Figure 19:
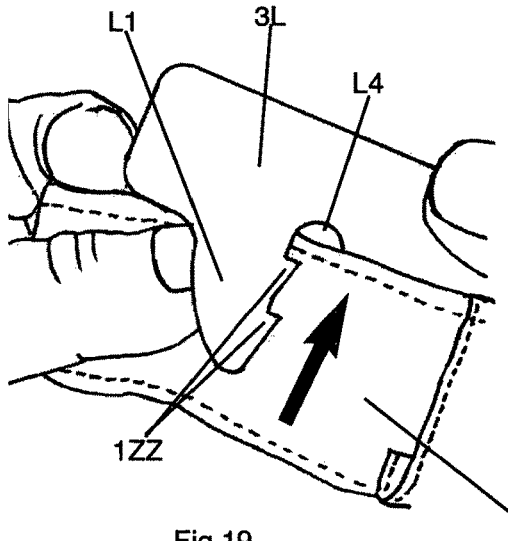

FIG. 19 shows a garment seam being pushed into the gripper.

Figure 20:
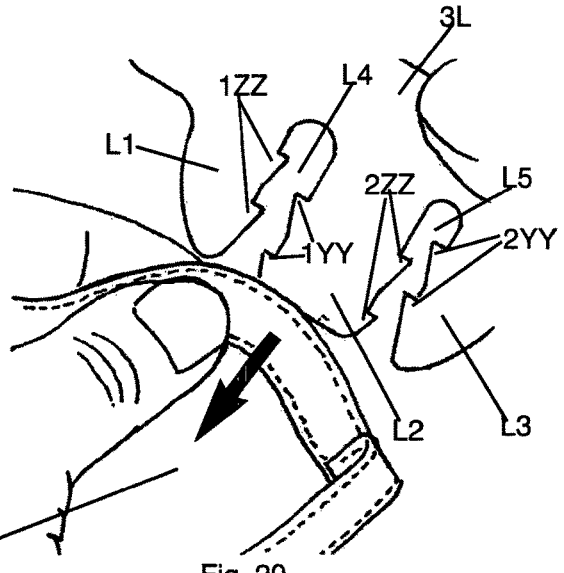

FIG. 20 shows how the garment is extracted from the gripper.

Figures 21, 22, 23:
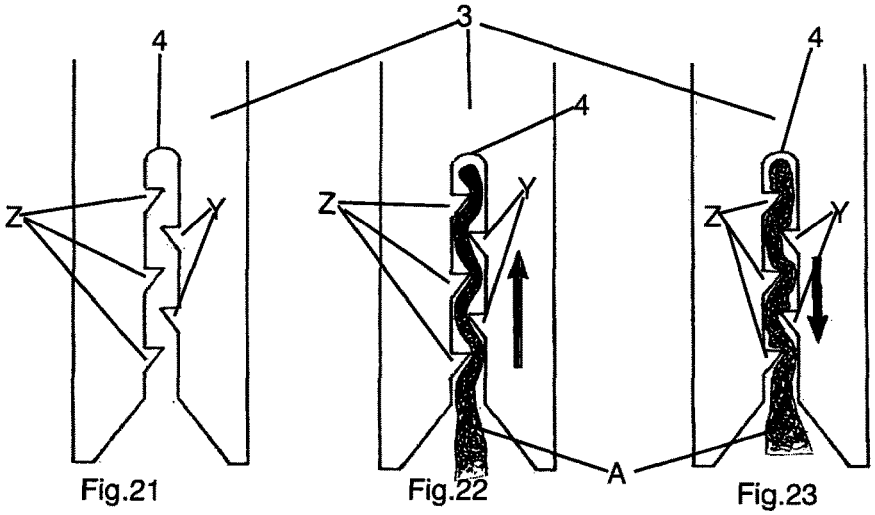

FIGS. 21-23 are generic drawings showing how the gripper works.

Figure 24:
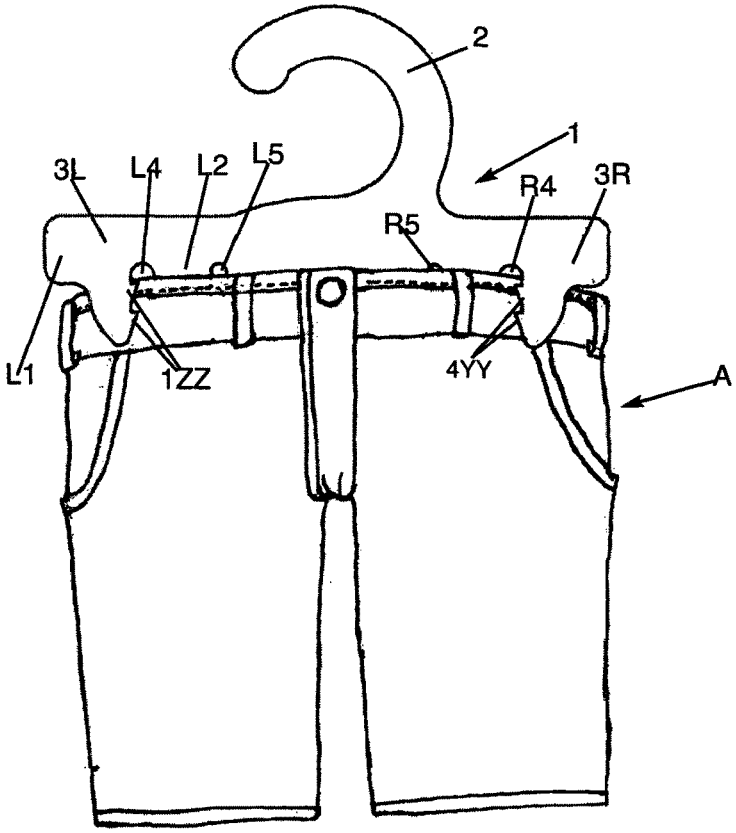

FIG. 24 shows a pair of pants held by the hanger.

Figure 25:
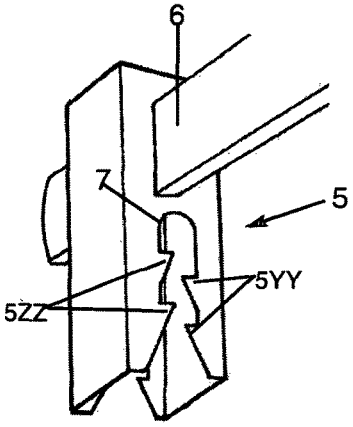
Figure 26:
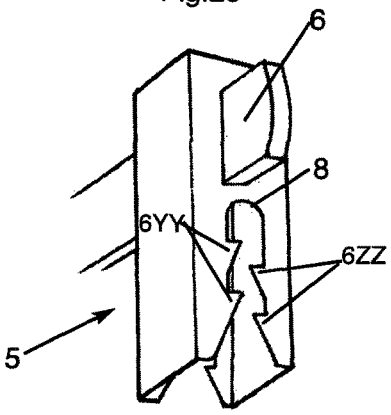

FIGS. 25 & 26 show different sides of a box-format gripper, set on a hanger-bar with channels set on either side of the box.

Figure 26B:
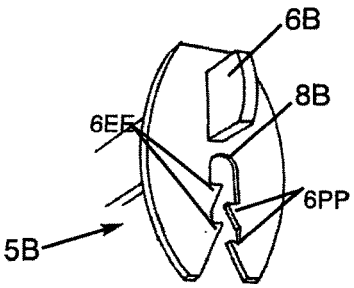

FIG. 26B shows a simple flat single gripper deployed on a hanger-bar.

Figure 27:
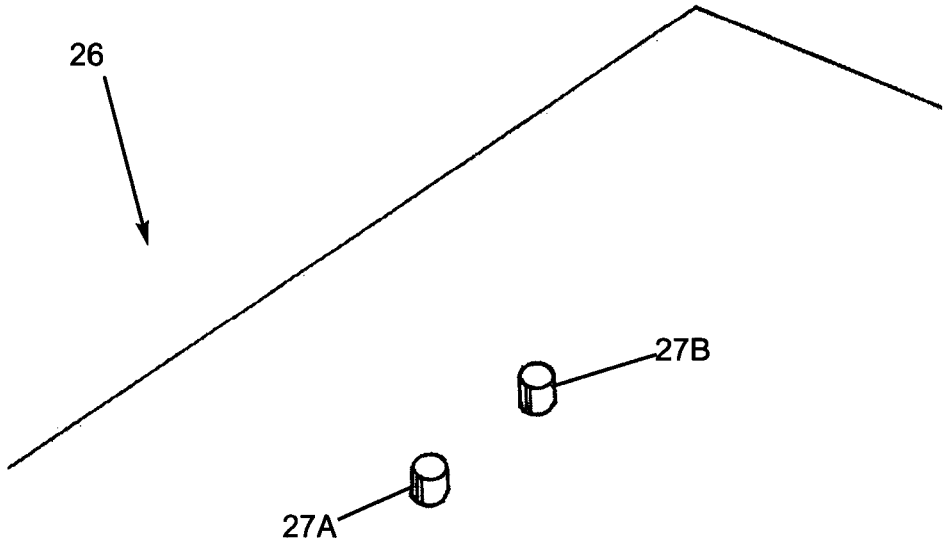

FIG. 27 shows a platform with two location pins set in position.

Figure 28:
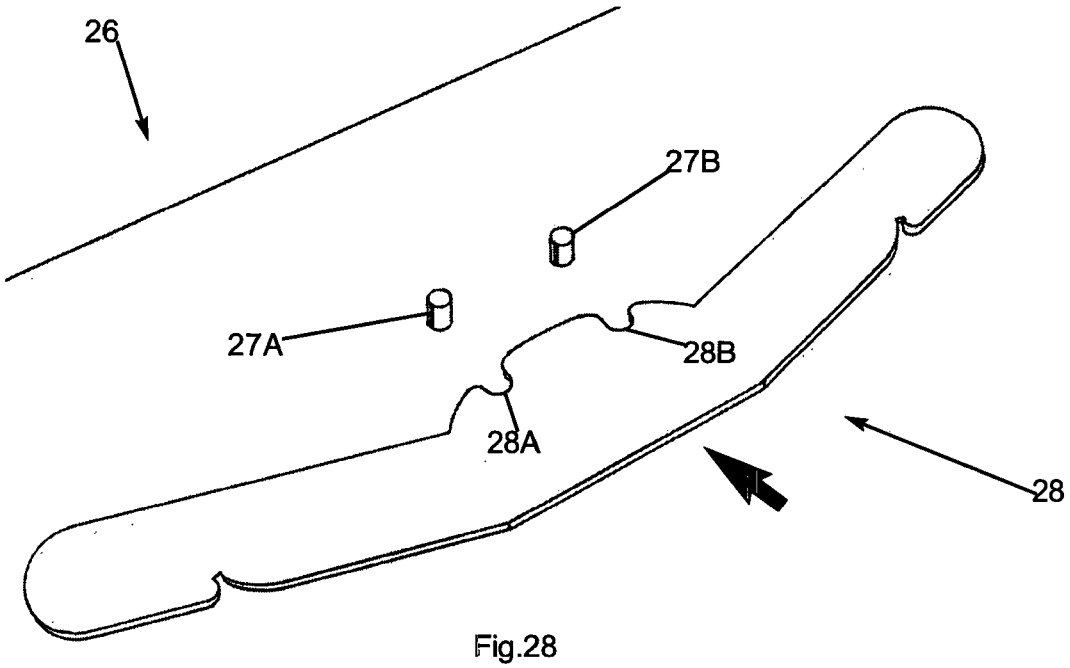

FIG. 28 shows the hanger bar being moved towards the pins.

Figure 29:
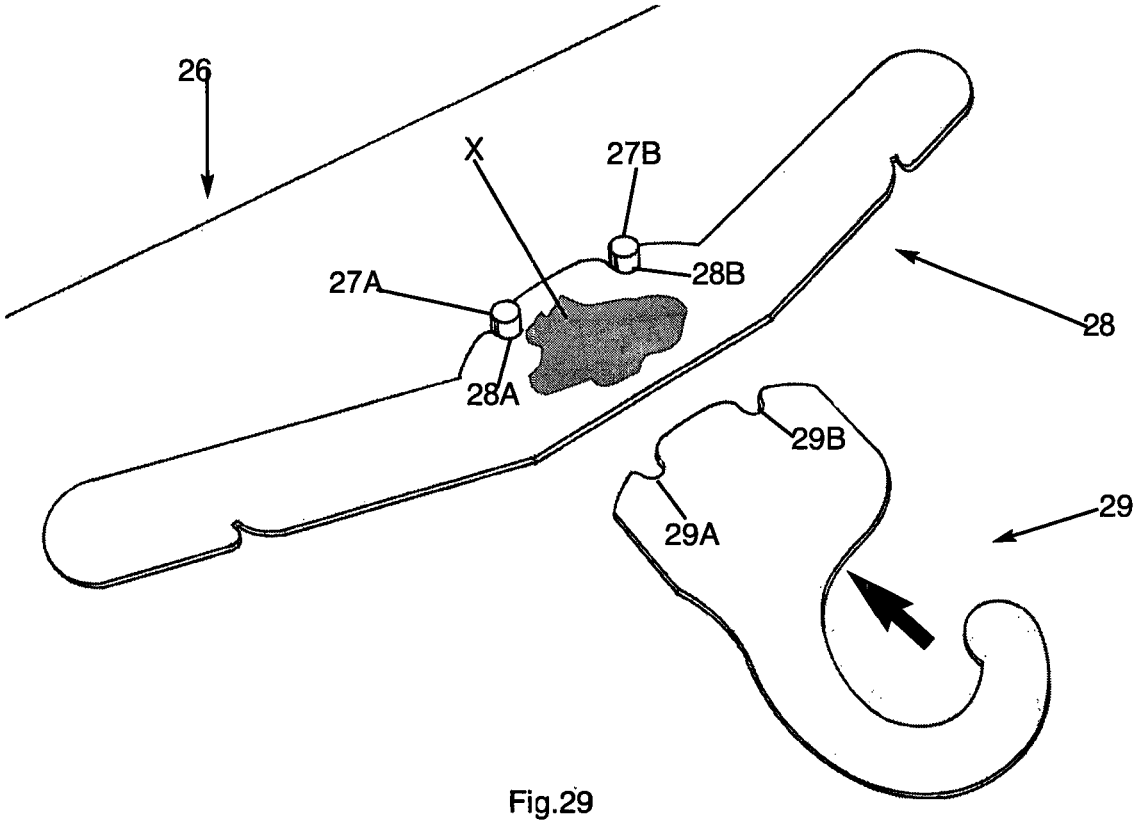

FIG. 29 shows the hanger bar set upon the pins with glue indicated on its upper surface, and the hook section prior to being set on the pins and hanger bar.

Figure 30:
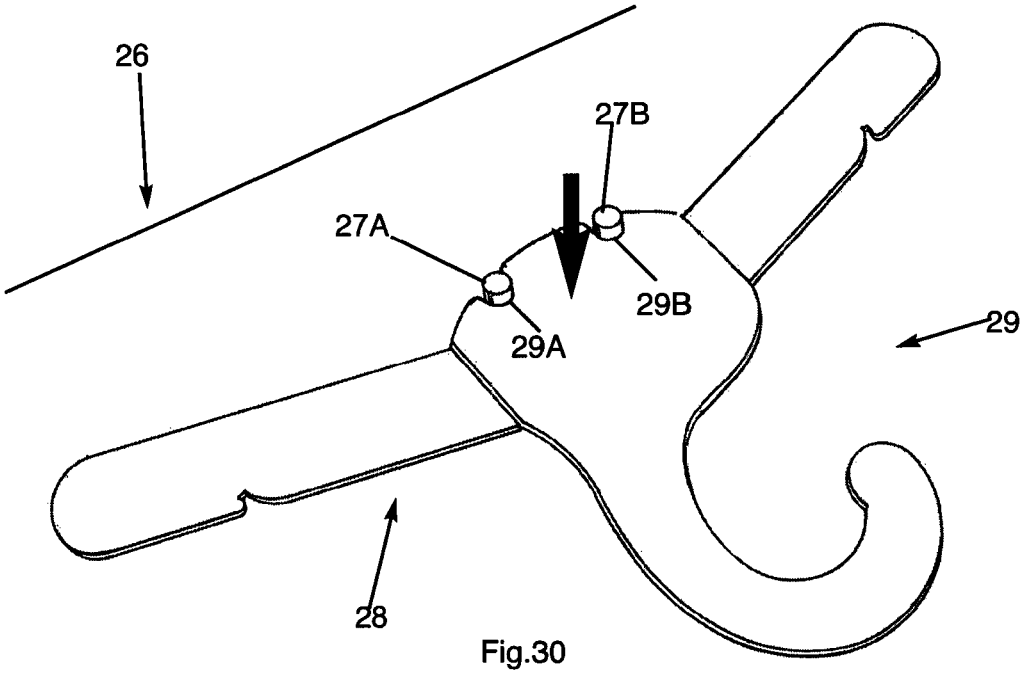

FIG. 30 shows the hook section in situ on top of the hanger bar.

Figure 31:
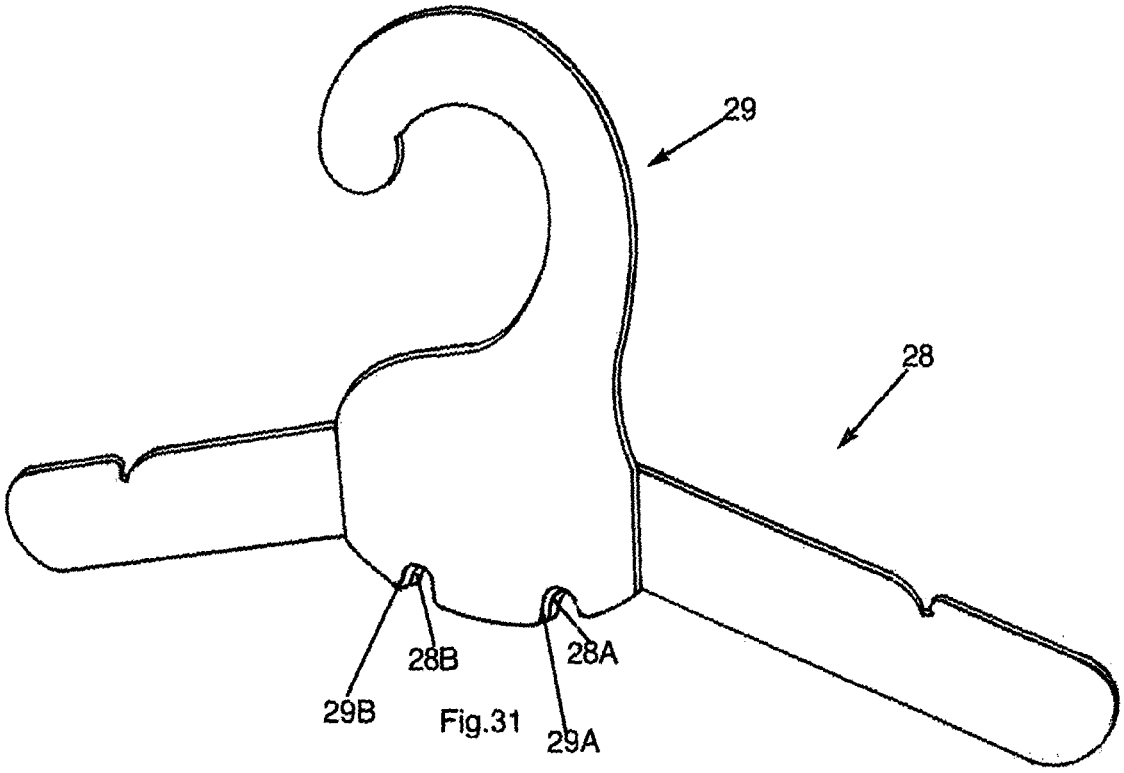

FIG. 31 shows the completed hanger.

Tubular Grippers

Figure 32:
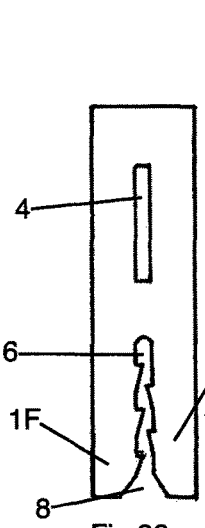
Figure 33:
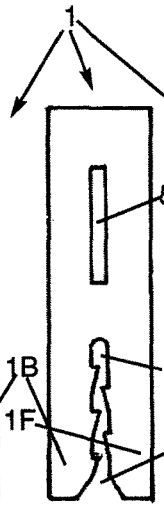

FIGS. 32 & 33 show side elevations from both sides of the tube gripper.

Figure 33A:
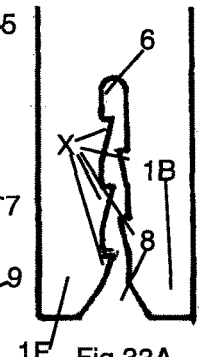

FIG. 33A is a close-up showing how teeth may be configured within the jaws.

Figure 34:
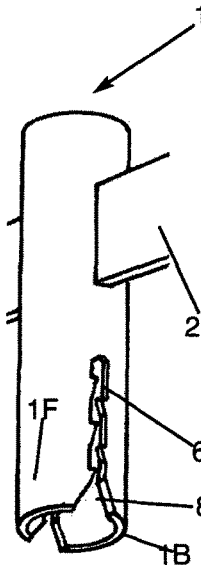

FIG. 34 shows how the gripper may be mounted on the arm of a hanger.

Figure 35:
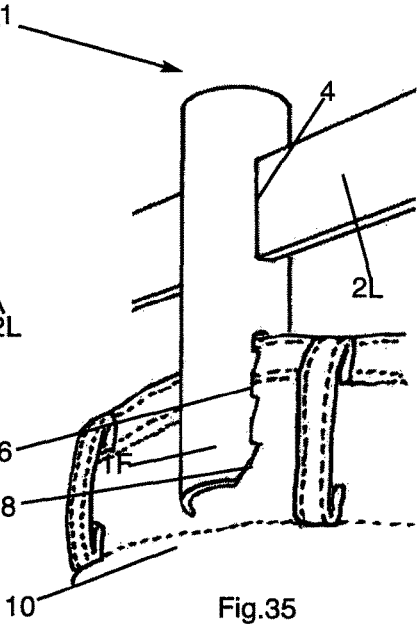

FIG. 35 shows a garment (pants) set within the jaws.

Figure 36:
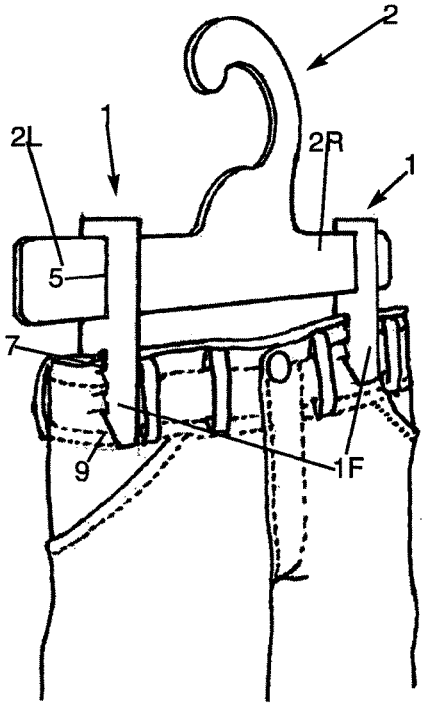

FIG. 36 shows how two of the elements may be utilized on a dedicated hanger.

Figure 37:
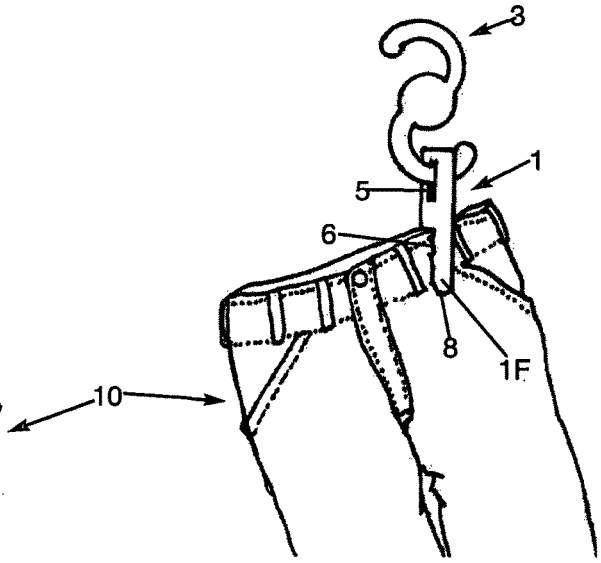

FIG. 37 shows an alternative use of a single gripper using an 'S' hook.

Figure 37A:
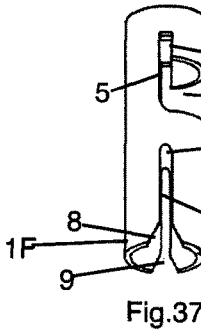

FIG. 37A shows how a gripper may be configured with an open 'hook'.

Figure 37B:
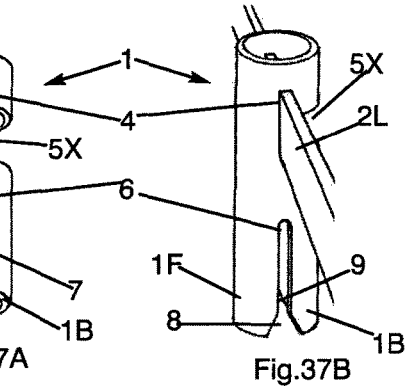

FIG. 37B shows how such a configuration may be used on a closed cross-bar hanger.

FIG. 38 shows the side elevation of the inner tube from the non-locking turn-gripper.

FIG. 39 shows the side elevation of the outer tube.

FIG. 40 shows the other side.

FIG. 41 shows the other side of the inner tube.

FIG. 42 shows a perspective view of how the inner and outer tubes are configured prior to being attached to the hanger.

FIGS. 43 & 44 show the rotational movement which closes the jaws.

FIG. 45 shows a garment in situ with the gripper in the closed position.

Figures 46, 47, 48, 49:
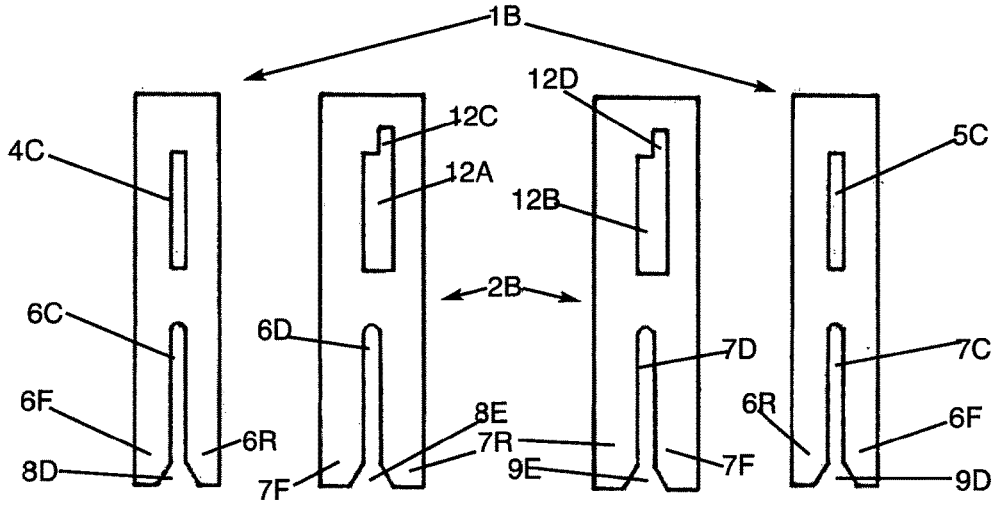

FIGS. 46 & 47 show side elevations of the inner and outer tubes respectively of the locking gripper.

FIGS. 48 & 49 show the other sides.

Figures 50, 51, 52:
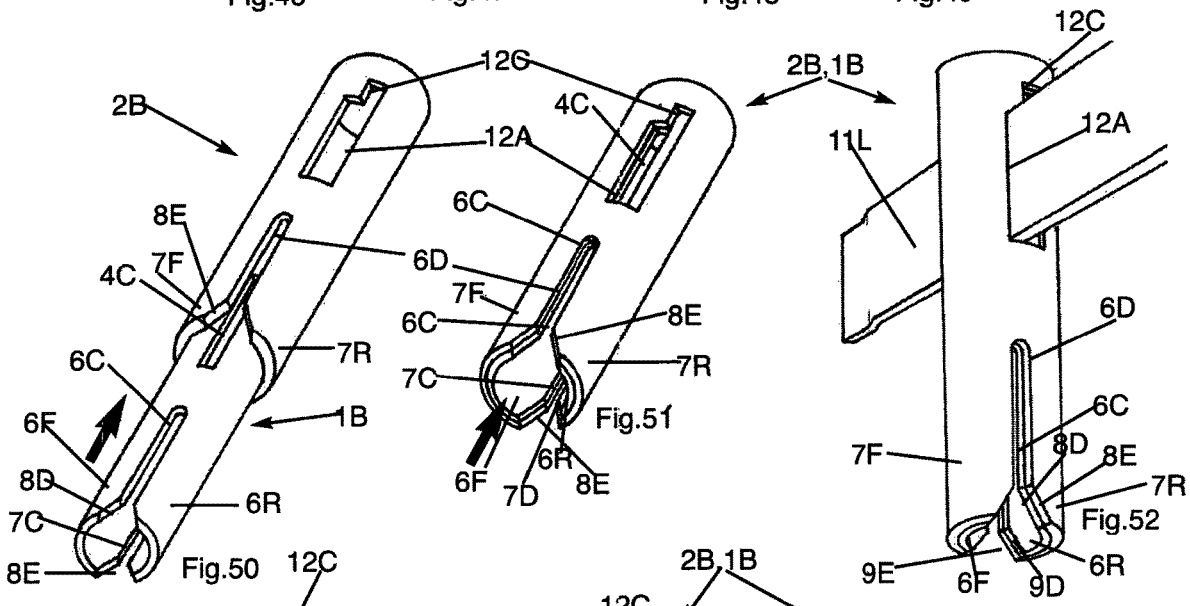

FIGS. 50 & 51 show in perspective how the tubes are pushed together so that the apertures line up.

Figures 53, 54, 55:
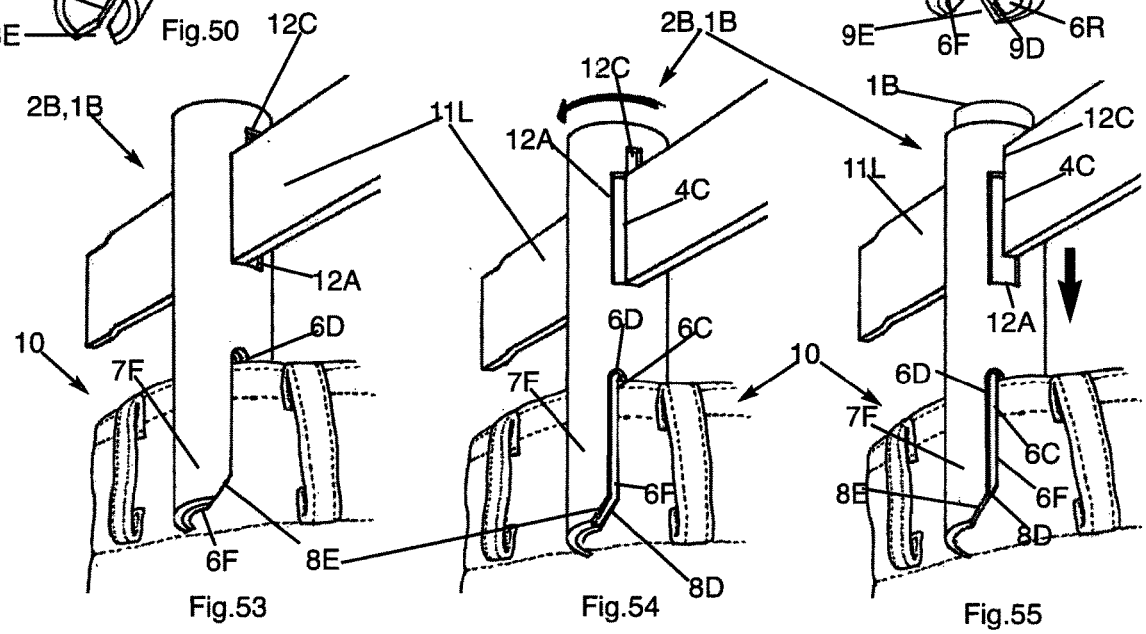

FIG. 52 shows the apparatus mounted on a hanger arm, prior to garment insertion FIG. 53 shows a garment in-situ, prior to closing the gripper.

FIG. 54 shows the outer tube turned to the 'closed' position, trapping the garment.

FIG. 55 shows how the outer tube is pulled downwards so that the bar moves into the upper locking slot, locking the gripper in-situ.

FIGS. 56-58 show all the previous movements of the apparatus from the other side.

FIGS. 59-61 show, in cross-section, how the cylinders rotate to trap the garment.

Figure 62:
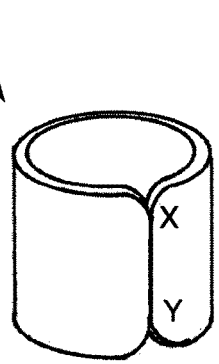

FIG. 62 shows an alternative type of tube-gripper configured with a slit, parallel to the length of the tube, and configured with a wider or 'mouth' opening at either end.

Figure 63:
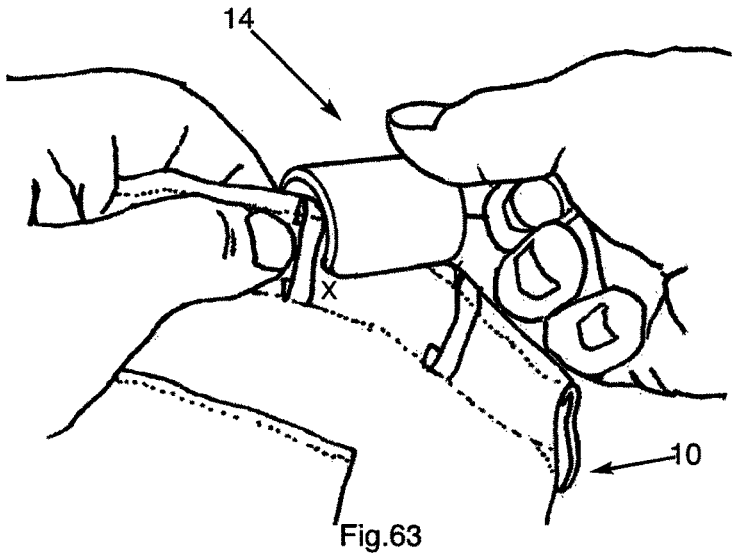

FIG. 63 shows how a garment may be forced into the slit.

Figure 64:
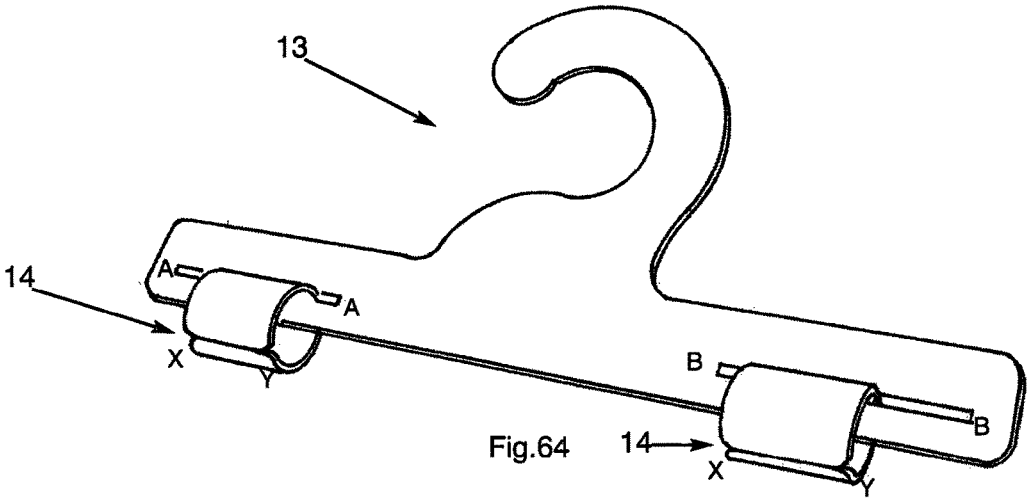

FIG. 64 shows how this type of gripper may be set up on a hanger.

Figure 65:
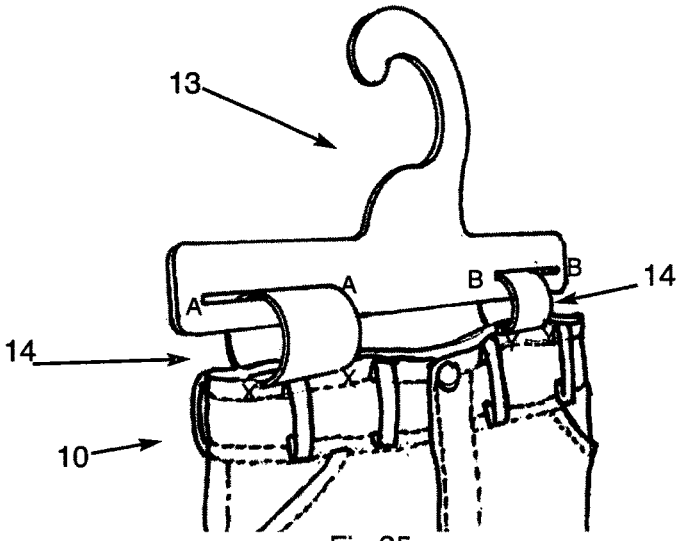

FIG. 65 shows this type of configuration may be used to hold a garment.

Figure 66:
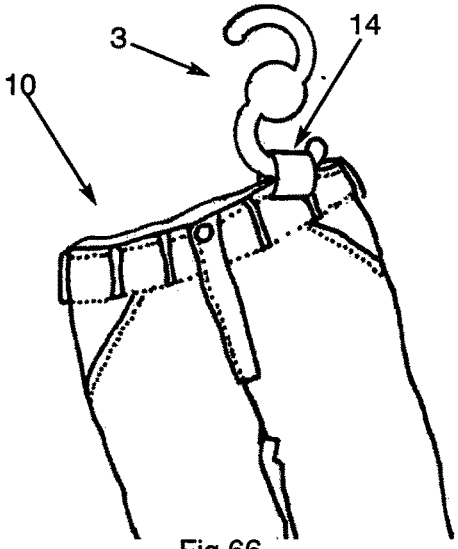

FIG. 66 shows how a gripper of this type may be used singly with an 'S' hook.

Developments in Garment Display

FIG. 67 is a profile of the hook/support section of a pants hanger.

FIG. 68 is 3-dimensional drawing showing how the hook/support section folds along the central horizontal fold.

FIG. 69 is the cross-bar with legs and retaining slot cut from the underside.

FIG. 70 is a 3-dimensional drawing showing how the bar is inserted between the two parts of the hook/support section, and engaged with the positional slot below.

Figure 71:
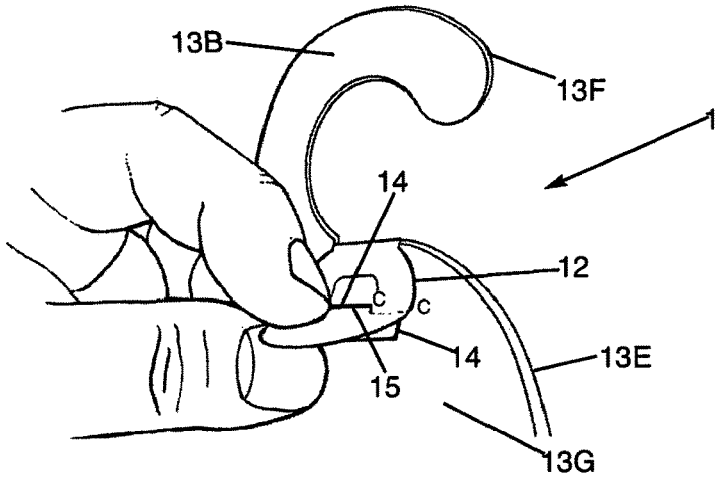

FIG. 71 shows how the retaining latch is folded over and engaged.

Figure 72:
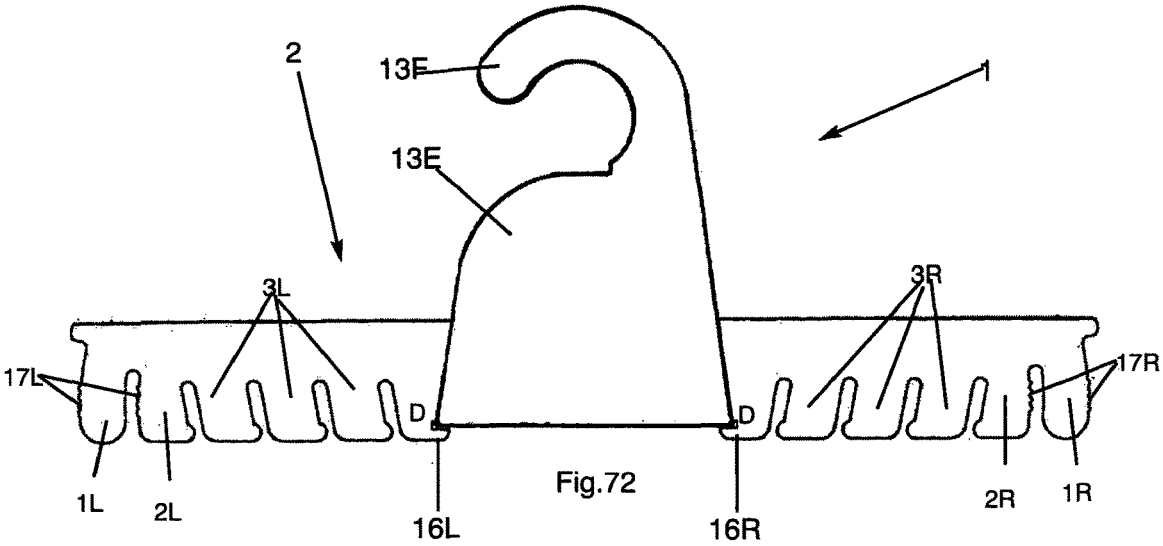
Figure 73:
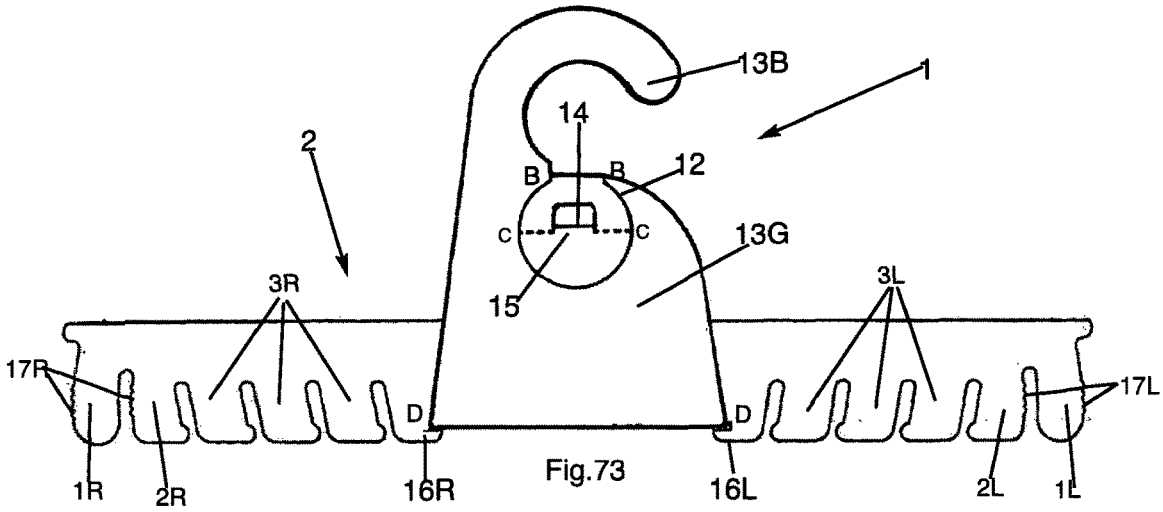

FIGS. 72 & 73 show the front and back of the fully assembled hanger.

Figure 74:
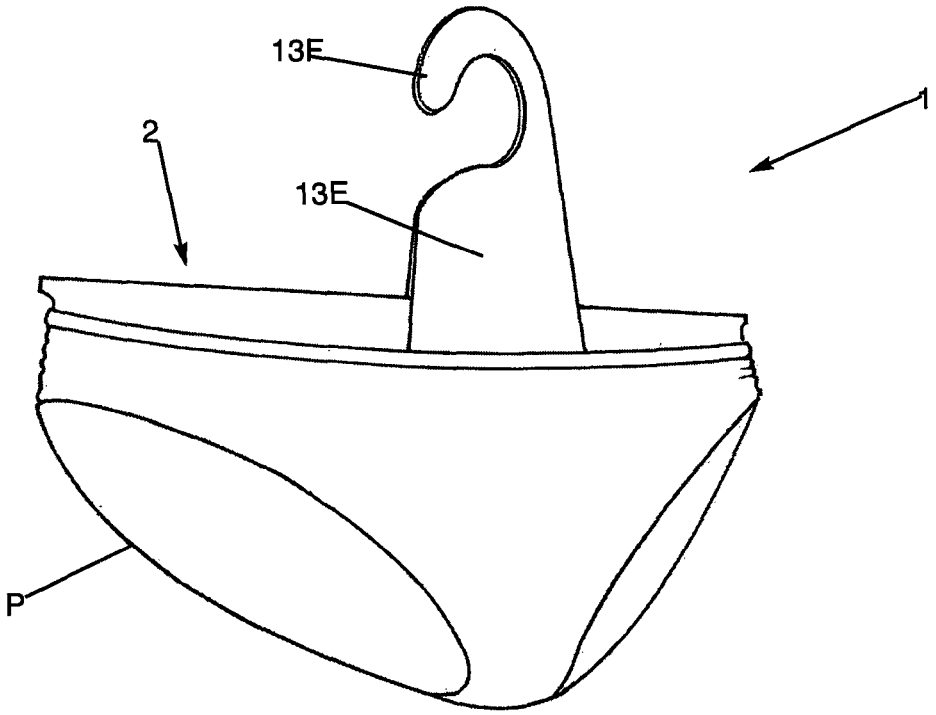
Figure 75:
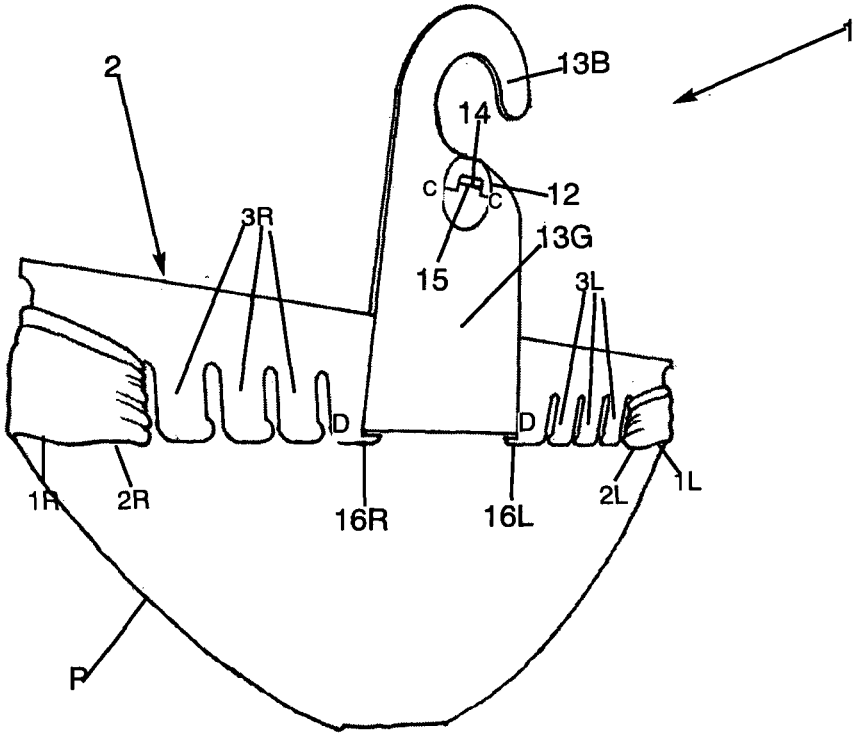

FIGS. 74 & 75 show how a garment may be deployed on the bar. (Common to all embodiments.)

Figure 76:
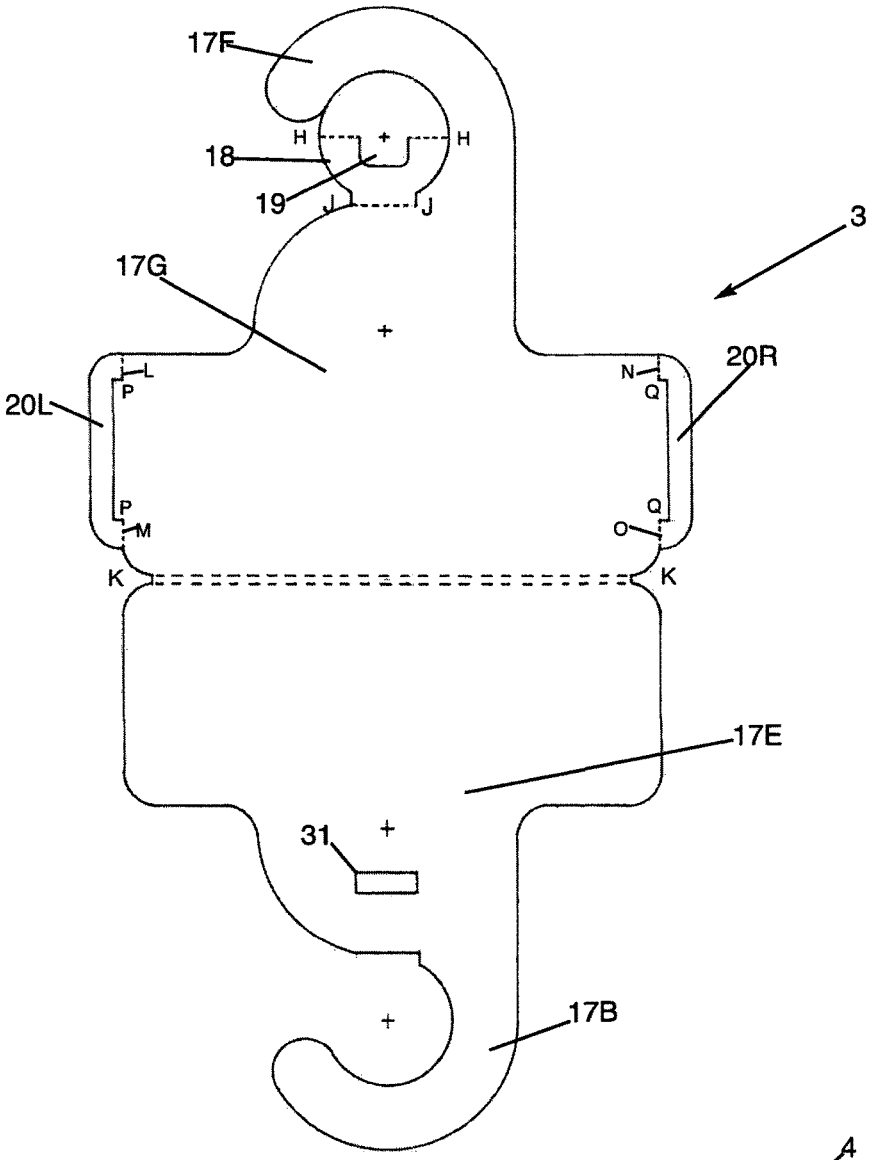

FIG. 76 is a profile of the hook/support section of the 'bra' hanger.

Figure 77:
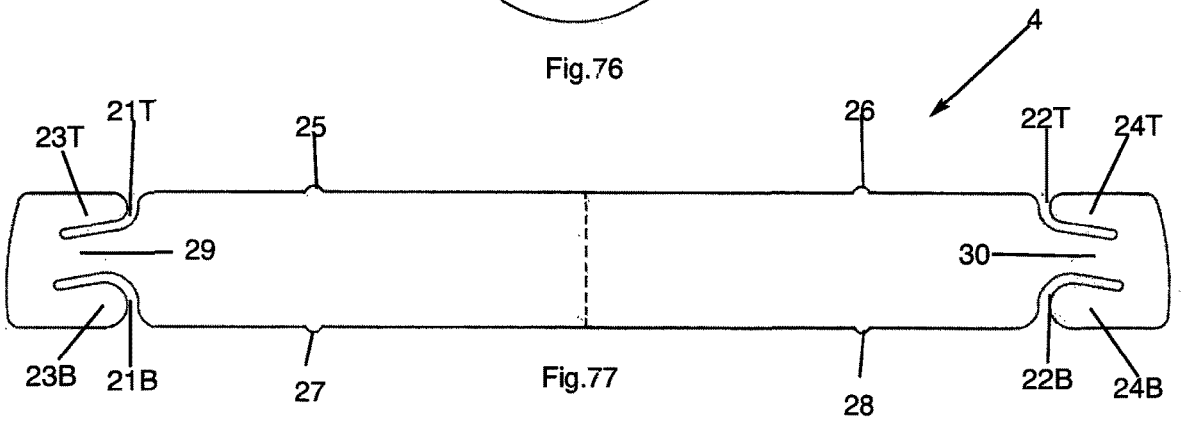

FIG. 77 is the crossbar for the bra hanger.

Figure 78:
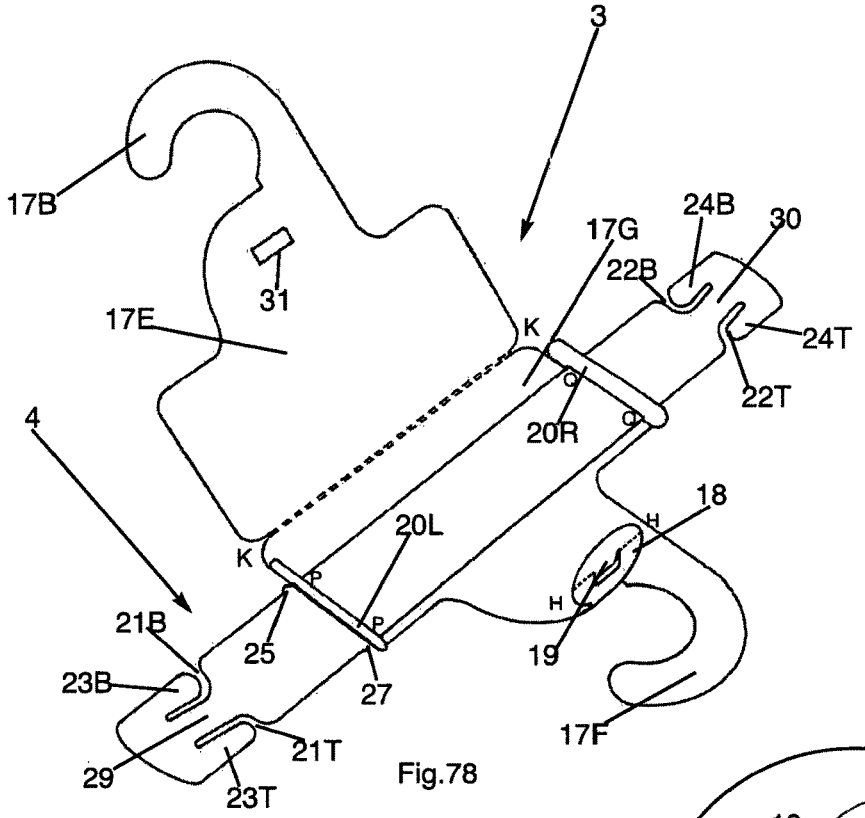
Figure 79:
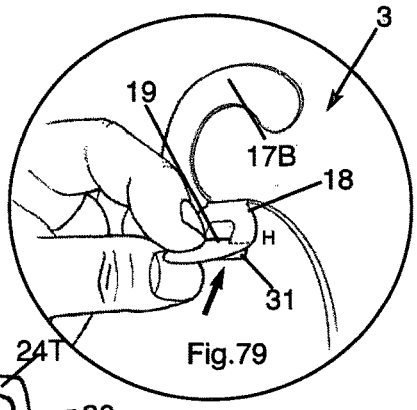

FIGS. 78 & 79 show the assembly of the bra hanger.

Figure 80:
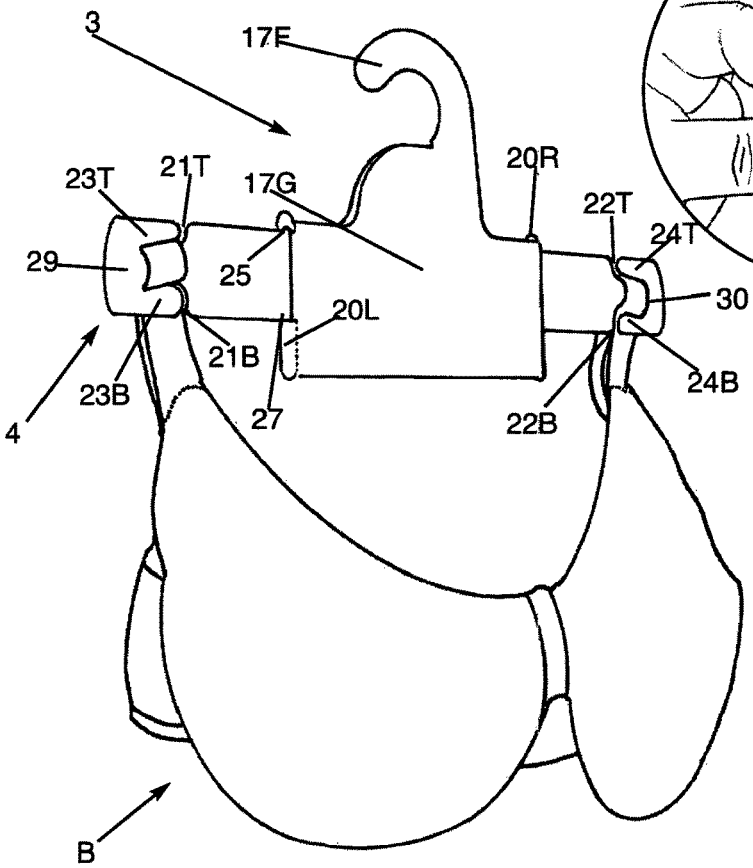

FIG. 80 shows the hanger deployed with a bra in situ.

FIG. 81 shows the crossbar of another embodiment of the pants hanger, with the 'L' section fold-line at the top, and two locking-tabs on the underside.

FIG. 82 is a variant with a single, central locking-tab.

FIG. 83 is a 3-dimensional drawing show how the 'L' section is folded down from the top of the bar prior to assembly.

FIG. 84 shows the flat profile of the single-panel hook/support section with the wings unfolded prior to assembly.

FIG. 85 shows how the 'L' section crossbar is deployed by sliding it through the apertures cut into the 'wings' on the hook/support section.

FIGS. 86 & 87 show a front and a back view of the assembled hanger, with the outer locking-tabs deployed to keep the hook/support section in situ.

Figure 88:
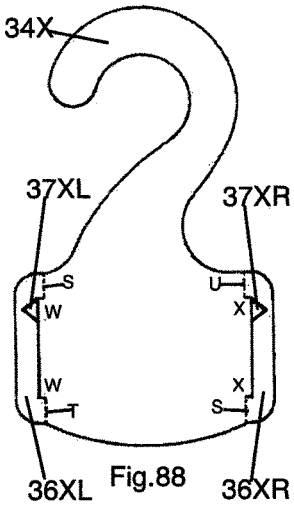

FIG. 88 is a variant of the previous hook/support section, where the apertures in the 'wings' are cut to hold a triangular section.

Figure 89:
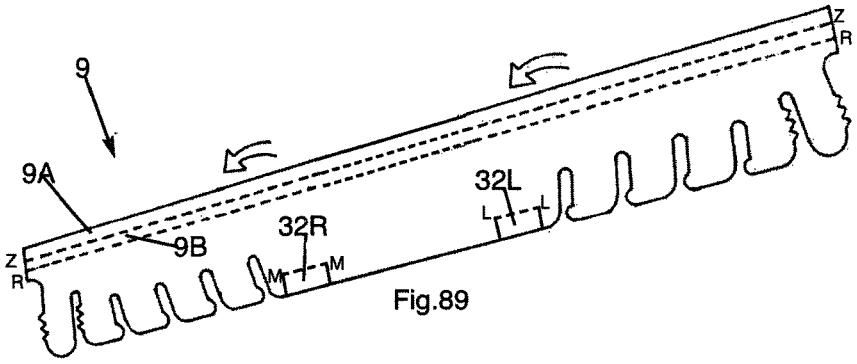

FIG. 89 shows a back view of another version of the crossbar with two extra horizontal top sections.

Figure 90:
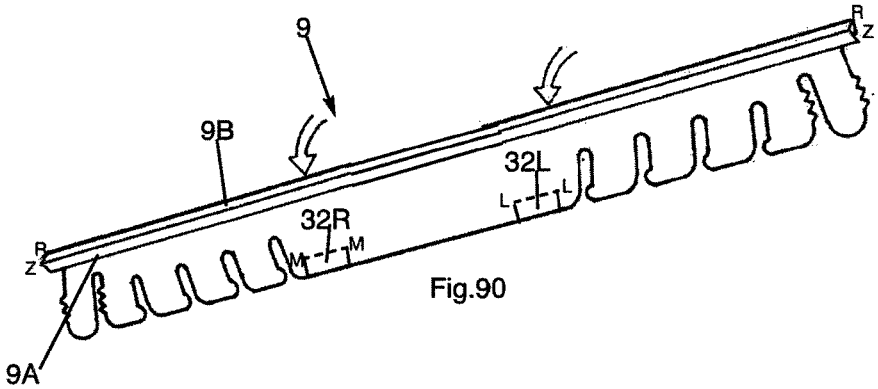

FIG. 90 is a back view which shows how the top-sections fold downward to form a box.

Figure 91:
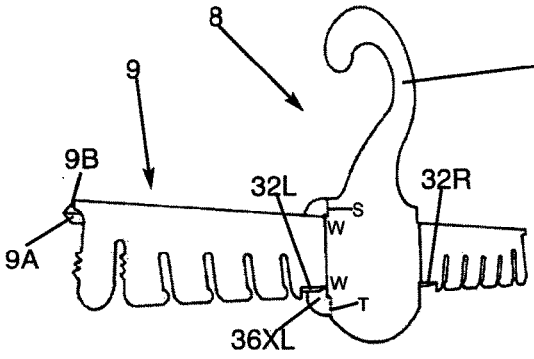
Figure 92:
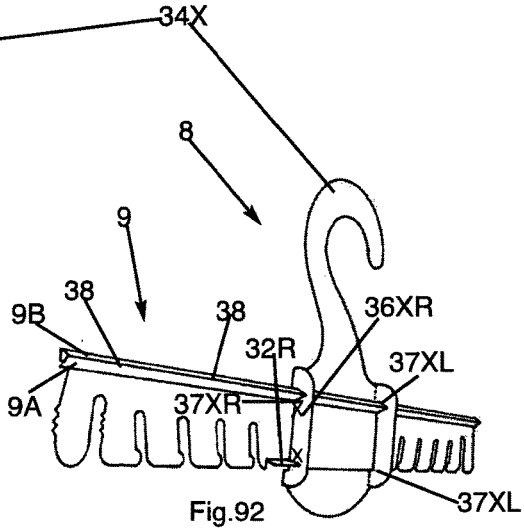

FIGS. 91 & 92 show a front and back view of the assembled hanger, and how the top-section 'box' is braced and retained by the wing-apertures.

Figure 93:
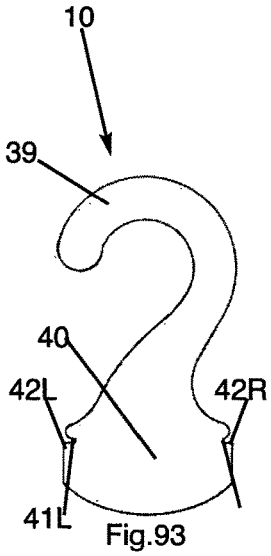

FIG. 93 shows another hook/support variant.

Figure 94:
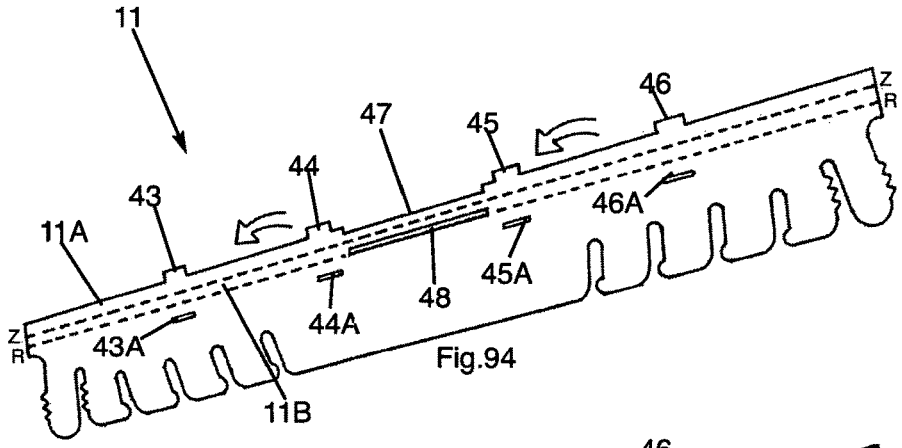
Figure 95:
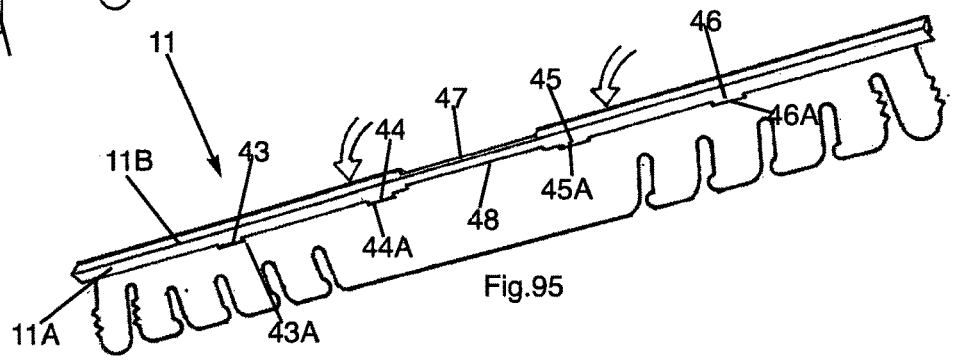

FIGS. 94 & 95 show a back-view of a strengthened variant of the previous 'box' section on the crossbar, with 'teeth' on the top edge, locking into slots cut below.

Figure 96:
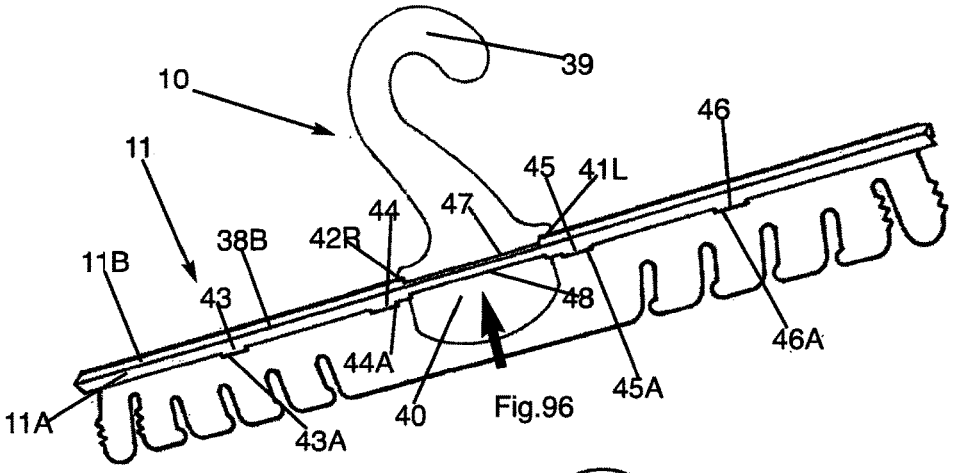

FIG. 96 shows how the hook section is inserted into slots cut across the box section, to be held at indents cut on either side of the hook section.

Figure 97:
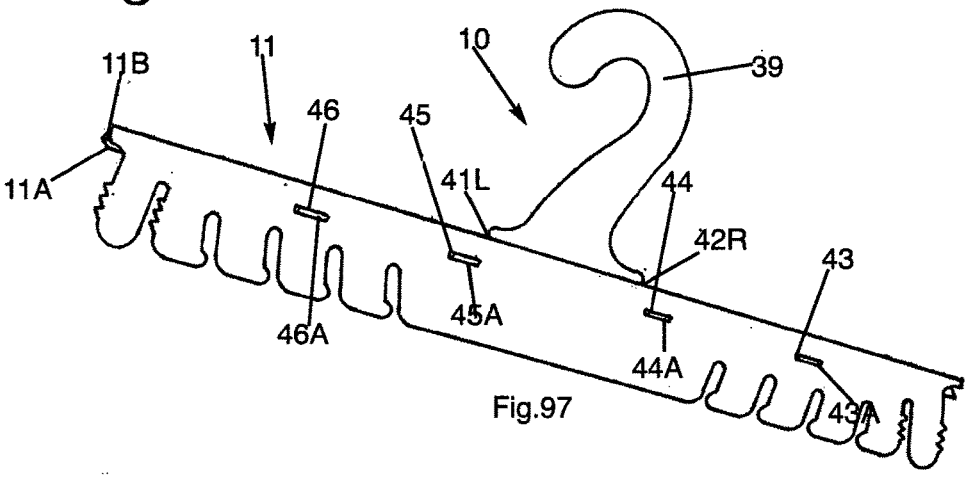

FIG. 97 is a front view.

Figure 98:
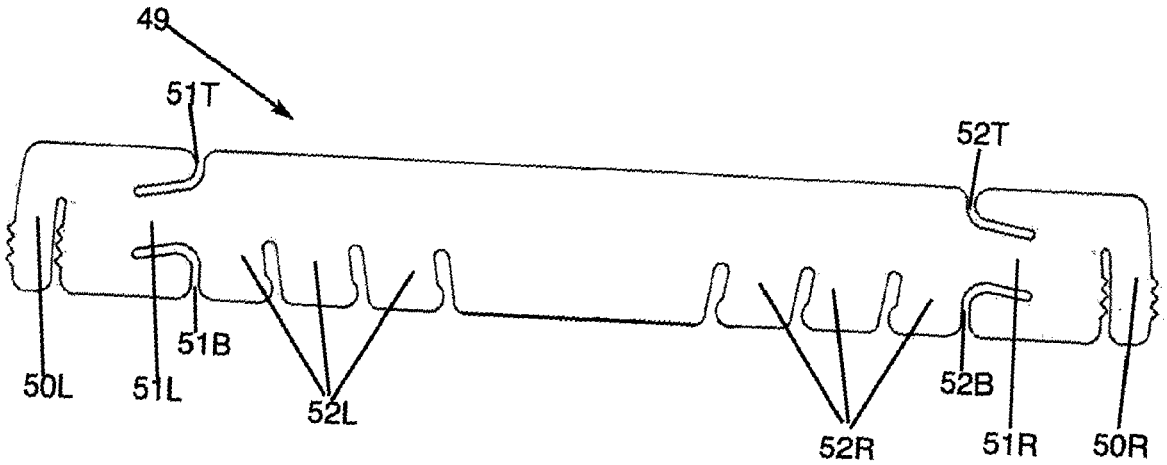

FIG. 98 shows the elevation of a variant where the crossbar is configured to hold both types of garment.

Figure 99:
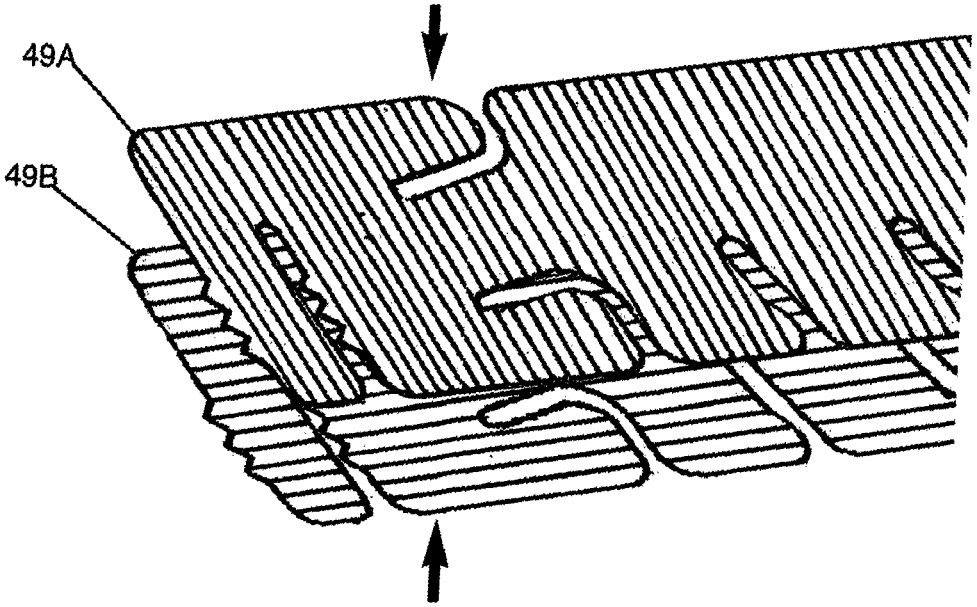

FIG. 99 shows how two layers of material with different grain-directions, or flute-board with the flutes running in different directions may be combined to give greater strength.

Figure 100:
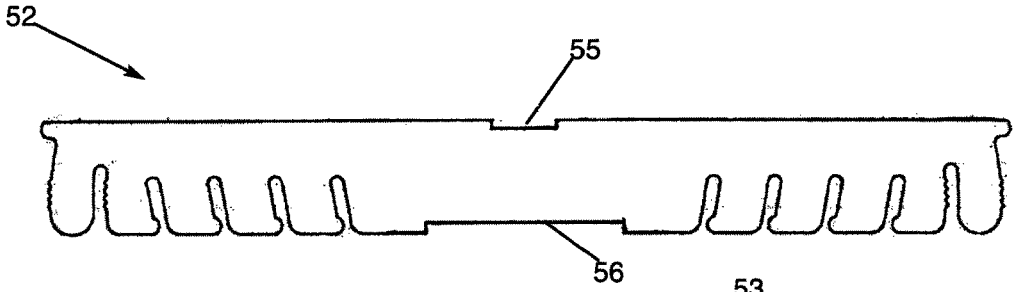

FIG. 100 shows a front elevation of another modification of the pants crossbar with indents top and bottom.

Figure 101:
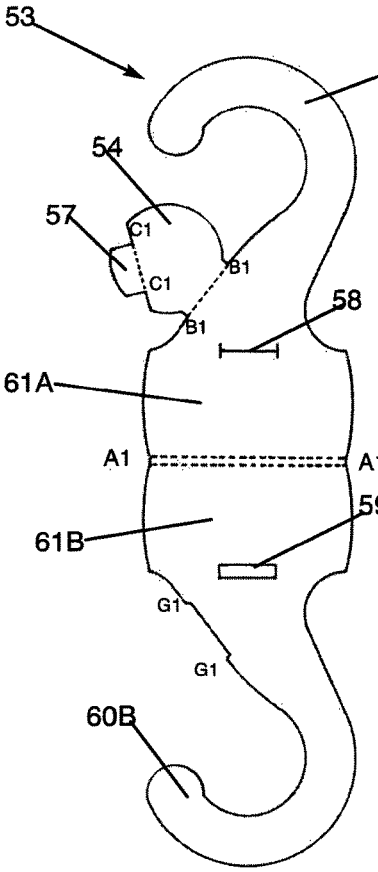

FIG. 101 shows a hook/sleeve assembly from the front prior to deployment featuring a tab/strap on the outer edge of the hook.

Figure 102:
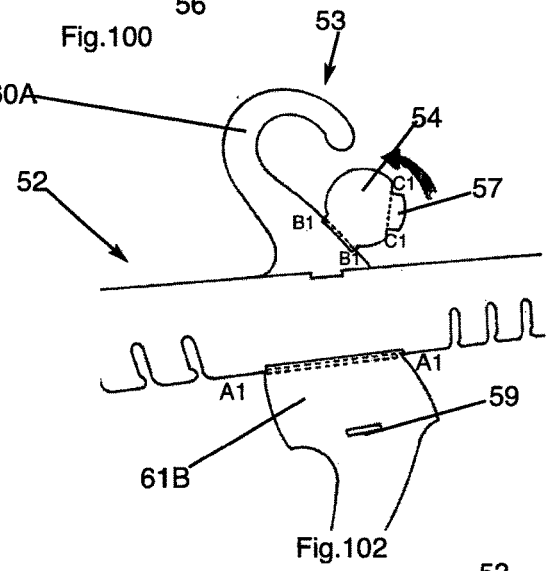

FIG. 102 shows the pants crossbar placed in situ on the inner surface of the hook/sleeve prior to folding.

Figure 103:
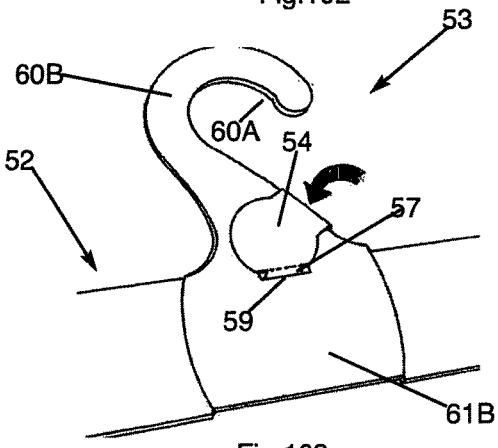

FIG. 103 shows the lower section of the hook/sleeve folded up to form the back of the hanger with the tab/strap in situ.

Figure 104:
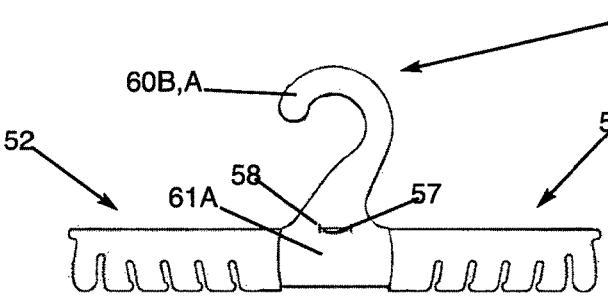
Figure 105:
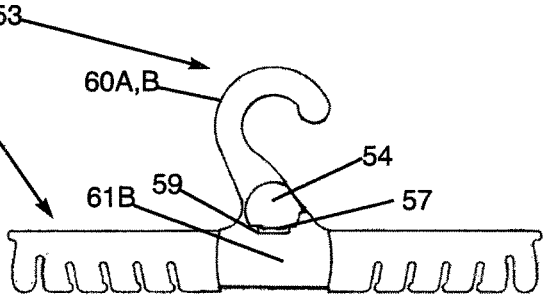

FIGS. 104 & 105 show the assembled hanger in front and back elevations.

Figure 106:
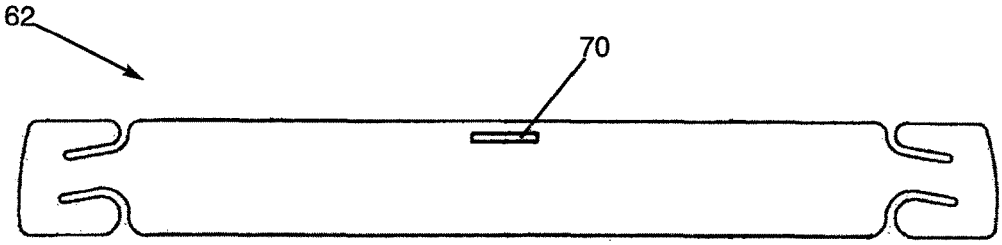

FIG. 106 shows the bra hanger crossbar, with a centrally cut aperture.

Figure 107:
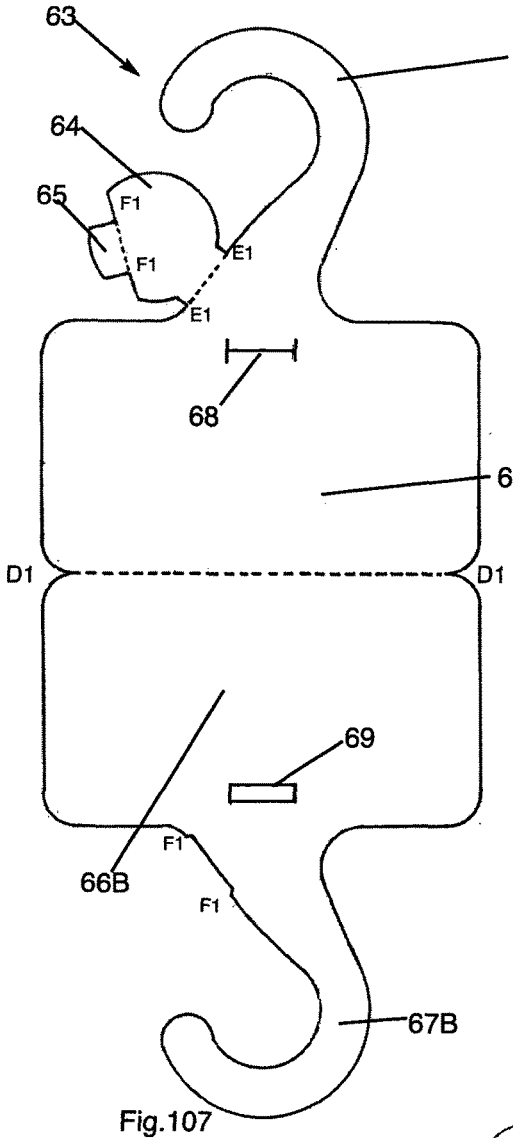

FIG. 107 shows the profile of the hook sleeve assembly.

Figure 108:
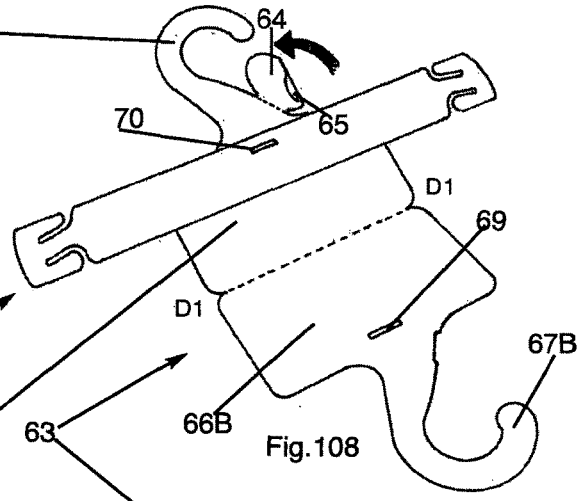

FIG. 108 shows the assembly of the hanger with crossbar being placed in situ prior to folding, with the aperture on the crossbar lined up with the apertures in the hook/sleeve.

Figure 109:
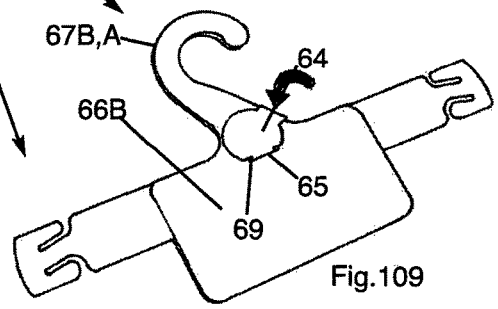

FIG. 109 shows the complete hanger with the tab/strap in situ.

Figure 110:
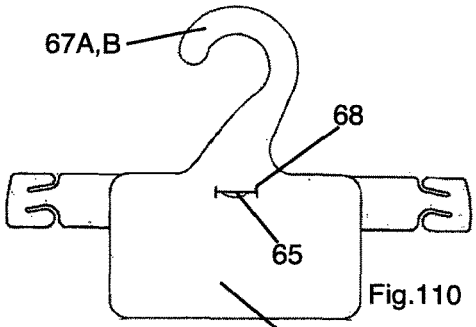
Figure 111:
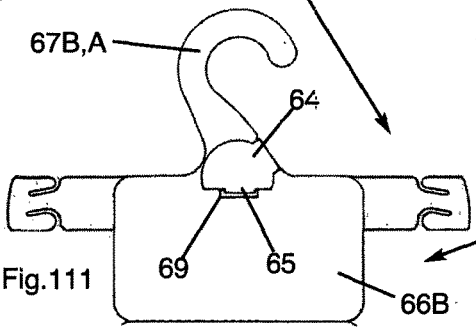

FIGS. 110 & 111 show the fully deployed hanger in front and Back elevations.

Figure 112:
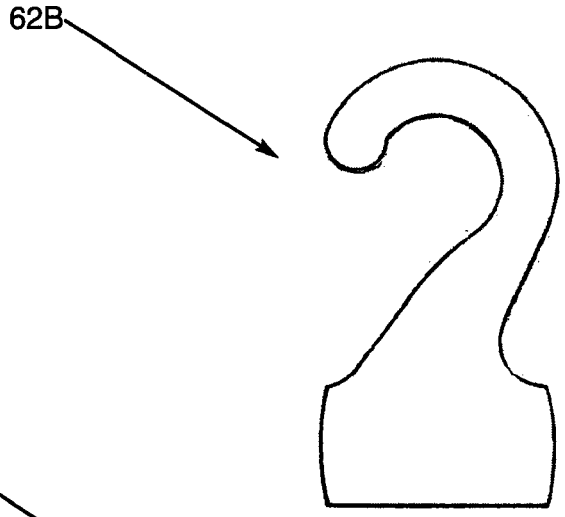

FIG. 112 shows a flat hook.

Figure 113:
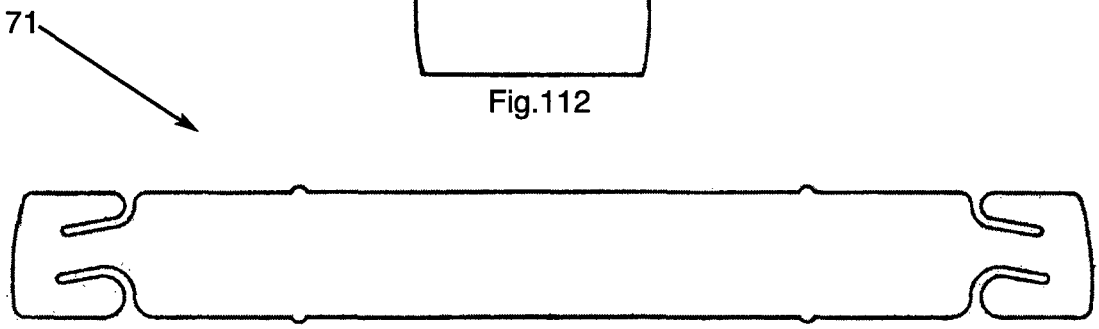

FIG. 113 shows a crossbar (bra-type).

Figure 114:
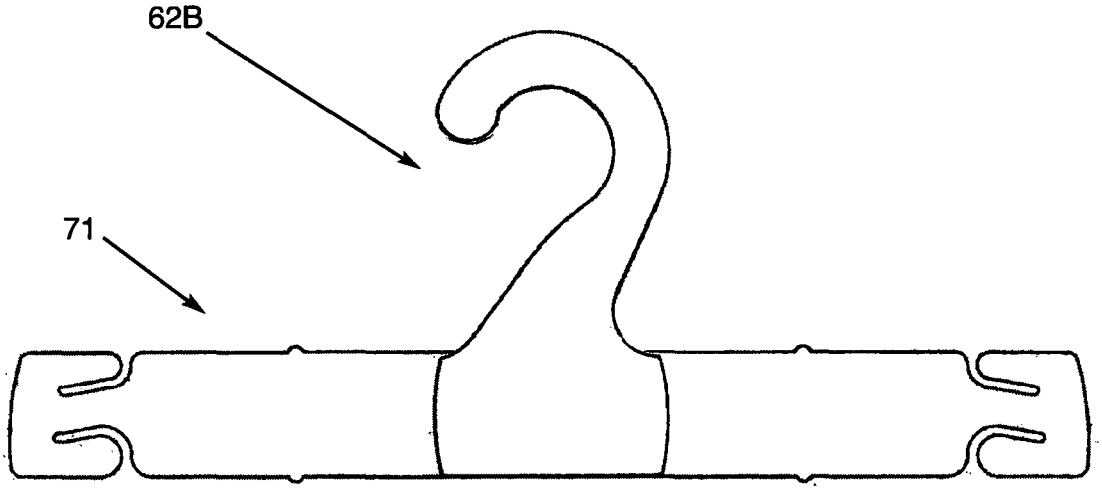

FIG. 114 shows the two joined together.

Sliding Clamp

Figure 115:
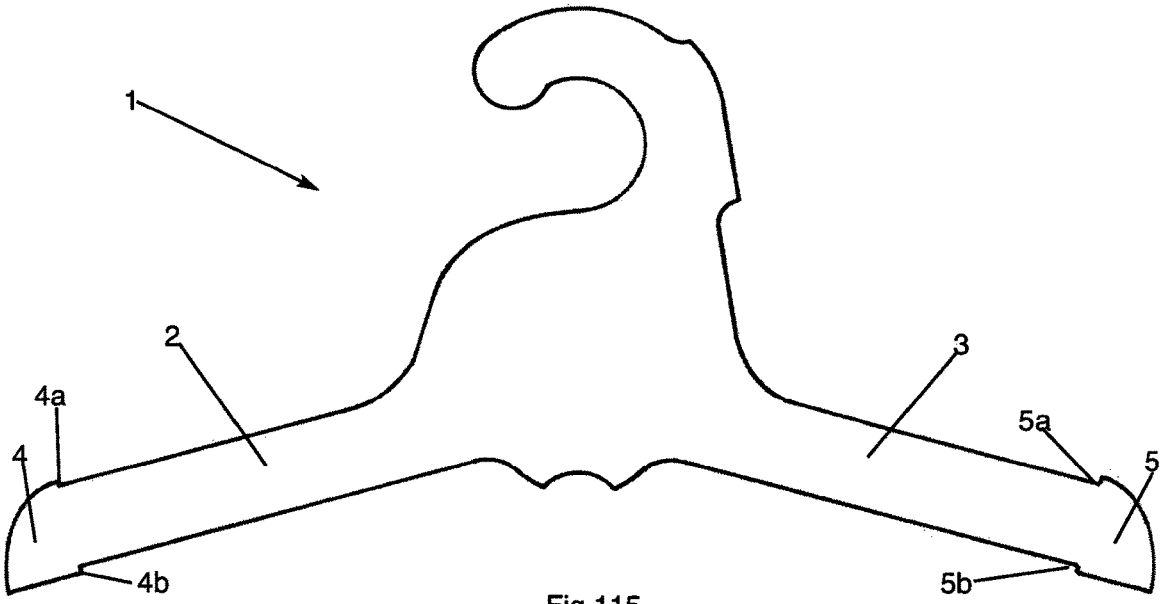

FIG. 115 is the hanger-frame.

Figure 116:
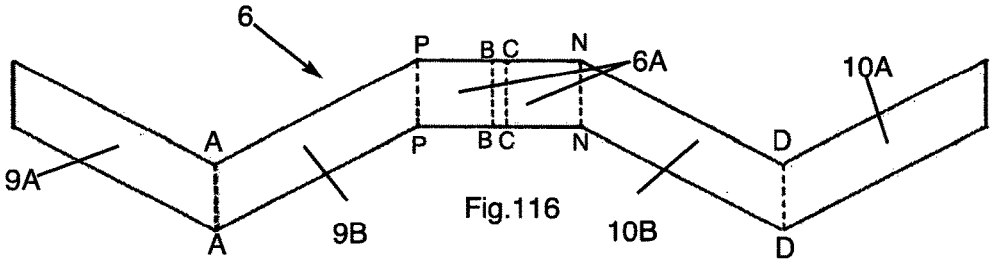

FIG. 116 shows a plan view of a single-leg extension prior to folding and bonding.

Figure 117:
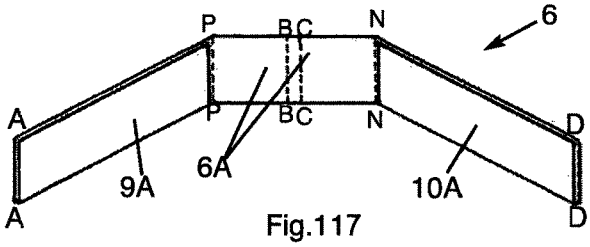

FIG. 117 shows the extension with first stage of folding complete.

Figure 118:
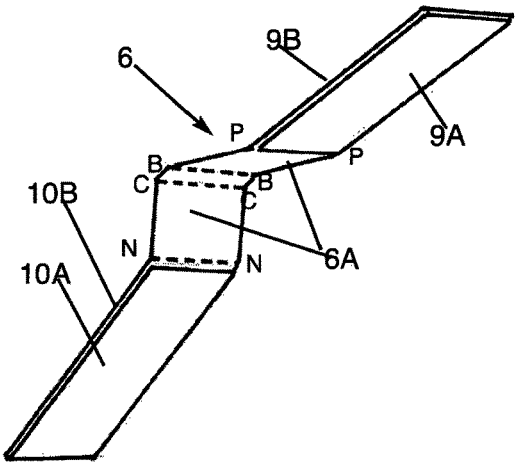

FIG. 118 shows a perspective view from beneath, with the second stage of folding beginning.

Figure 119:
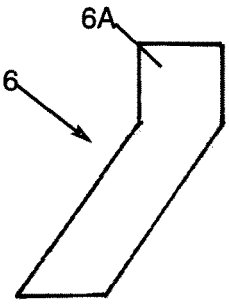

FIG. 119 shows a side view of the completed extension.

Figure 120:
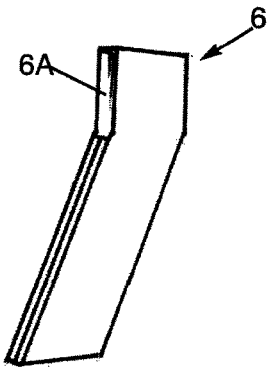

FIG. 120 shows a perspective view.

Figure 121:
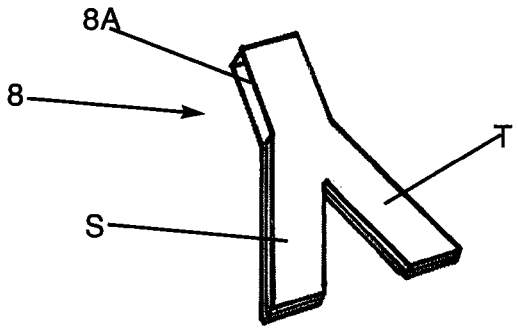

FIG. 121 shows a two-leg extension.

Figure 122:
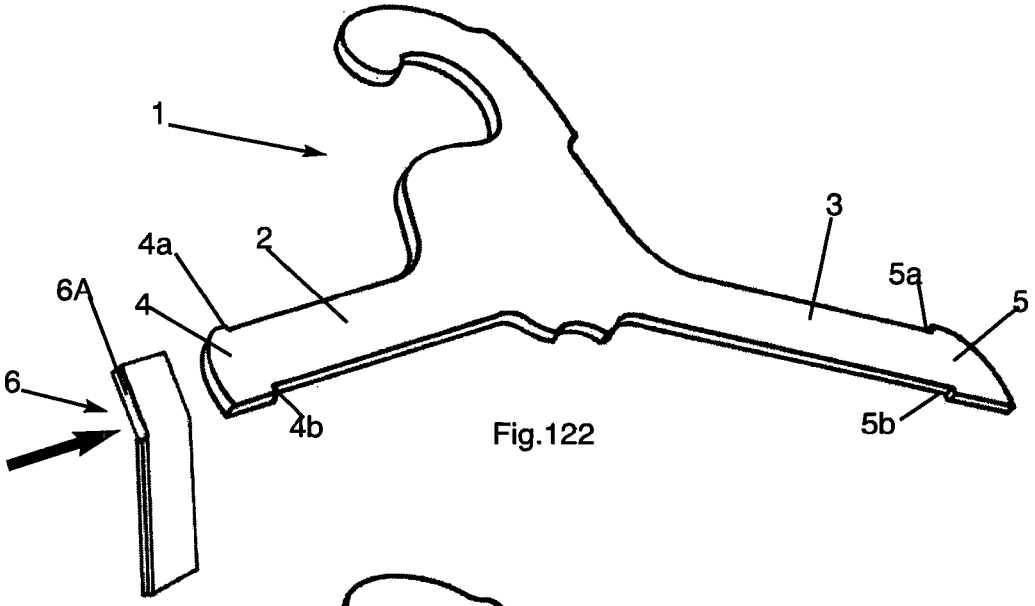

FIG. 122 shows the single-leg extension prior to being slid onto the arm of the hanger.

Figure 123:
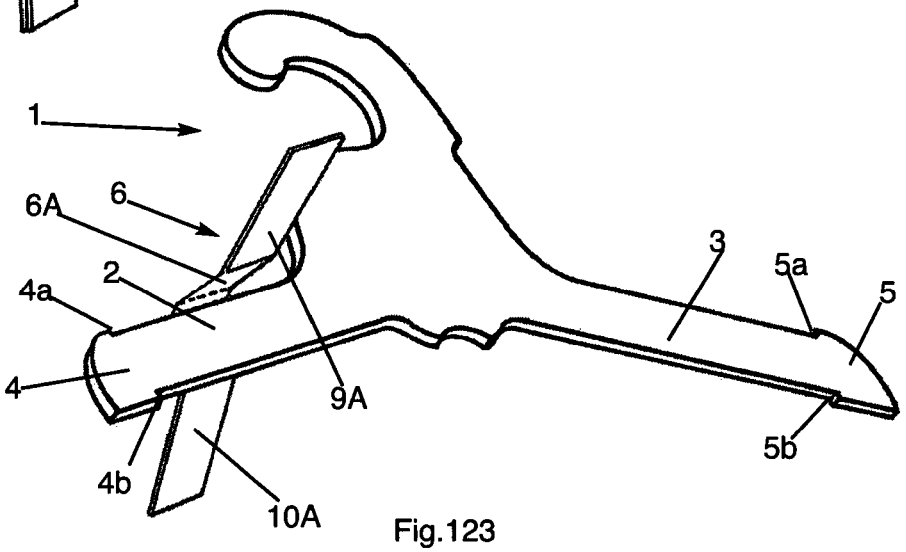

FIG. 123 shows how the single-leg extension may be wrapped around the hanger arm.

Figure 124:
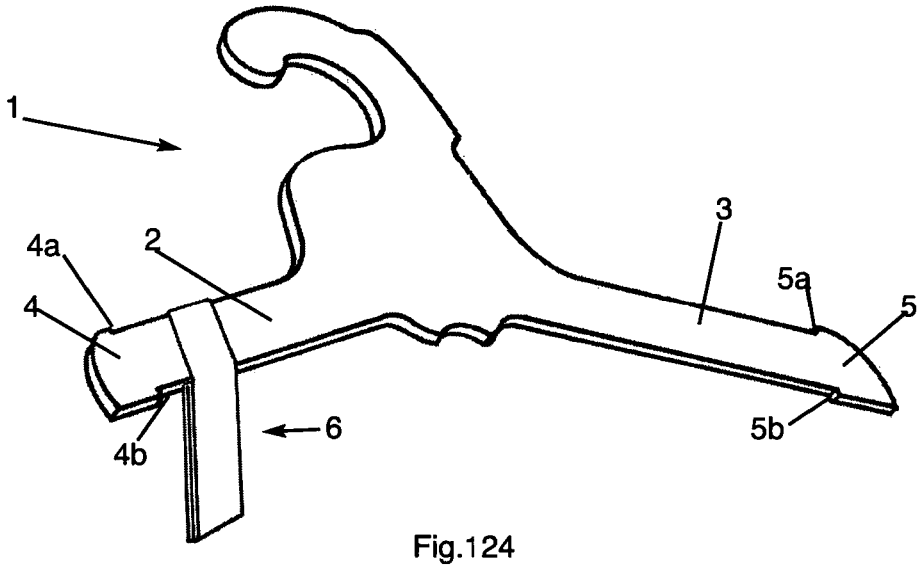

FIG. 124 shows the single-leg extension on one of the arms of the hanger.

Figure 125:
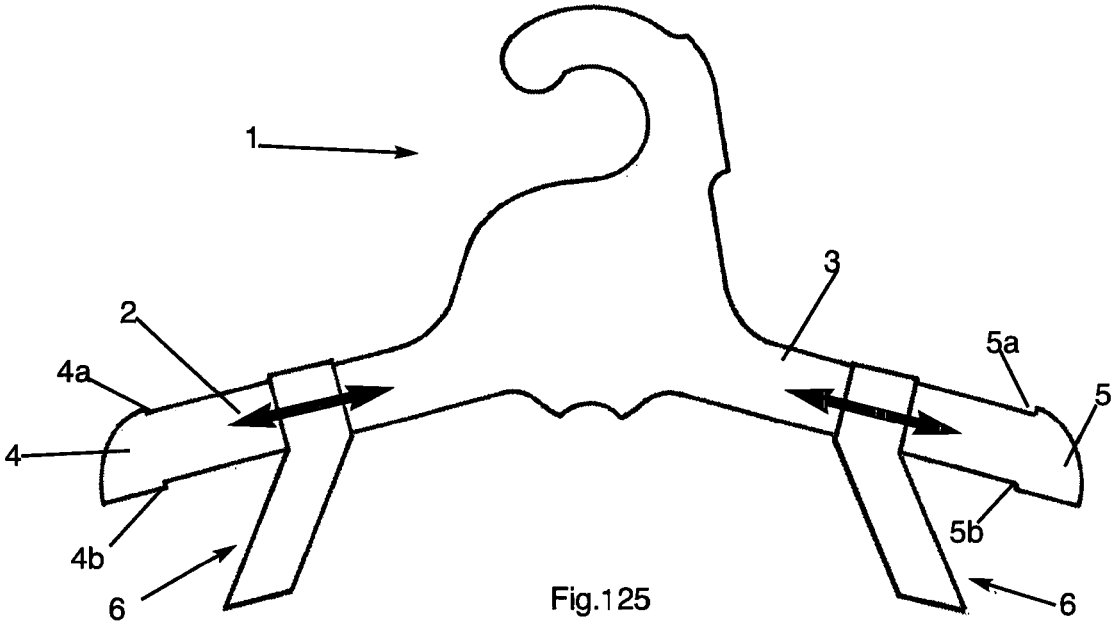

FIG. 125 shows an elevation view with both extensions in situ.

Figure 126:
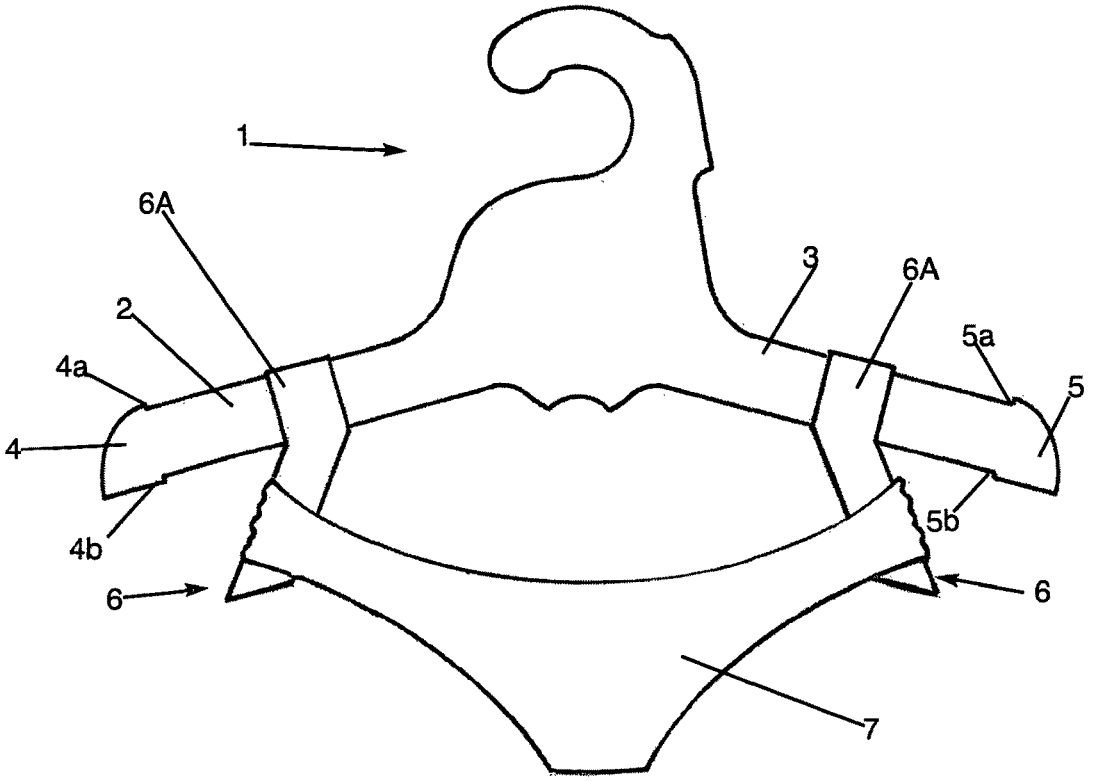

FIG. 126 shows the hanger with two single-leg extensions holding a garment prior to being pushed outwards.

Figure 127:
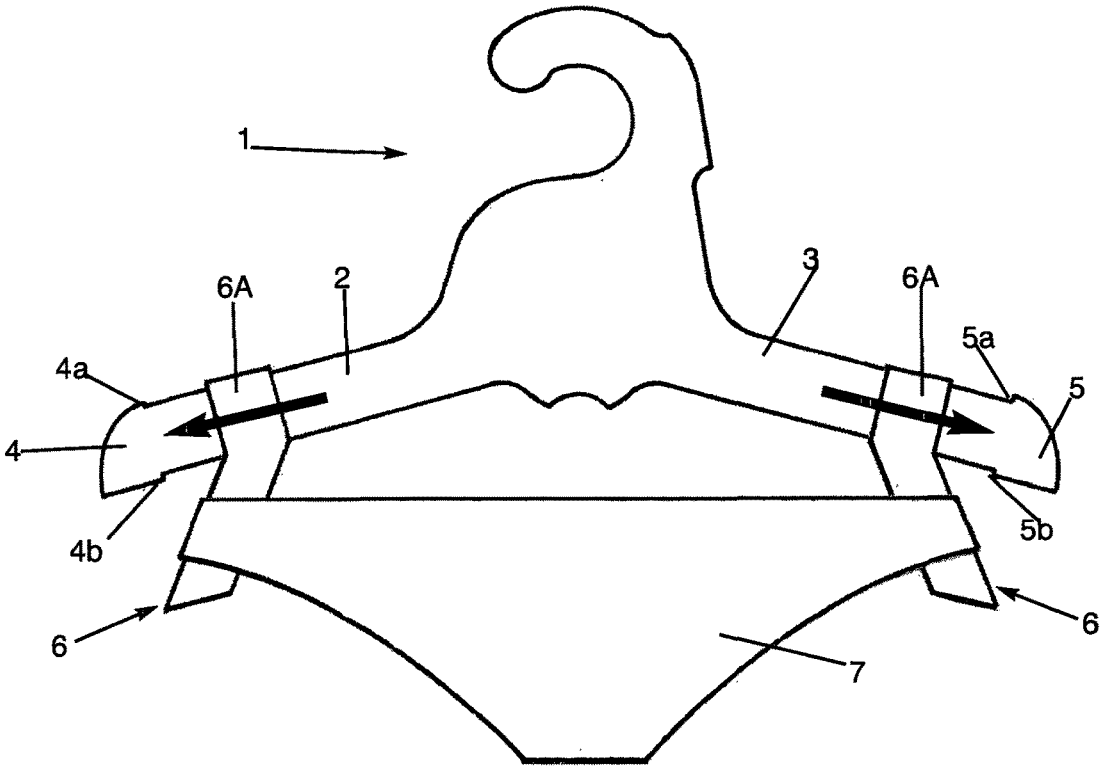

FIG. 127 shows how the garment is stretched and held in situ when the extensions are pushed outwards.

Figure 128:
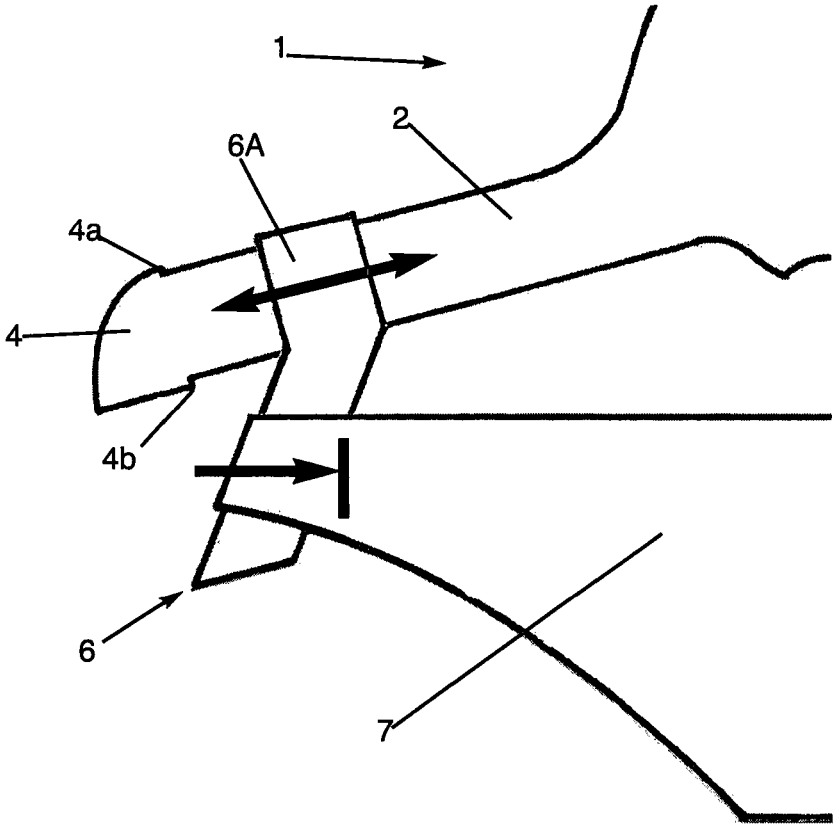

FIG. 128 shows a section of the hanger where the garment is located on the extension, and how the tension from the garment locks the extension in position.

Figure 128A:
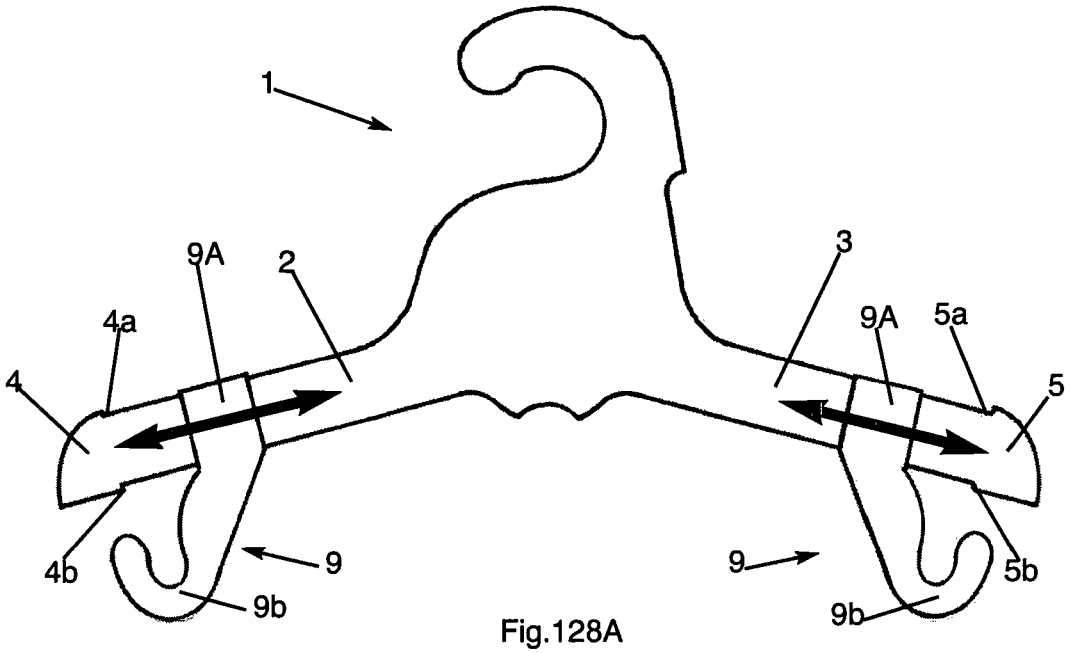

FIG. 128A shows alternative extensions with hooks

Figure 129:
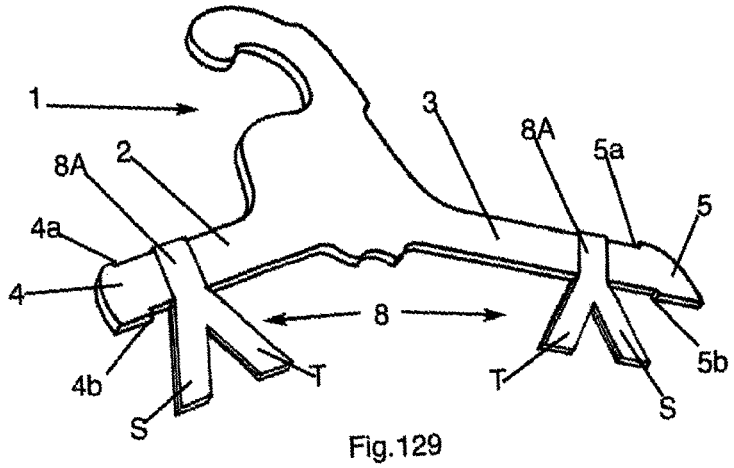

FIG. 129 shows the hanger with two double-leg extensions in situ.

Figure 130:
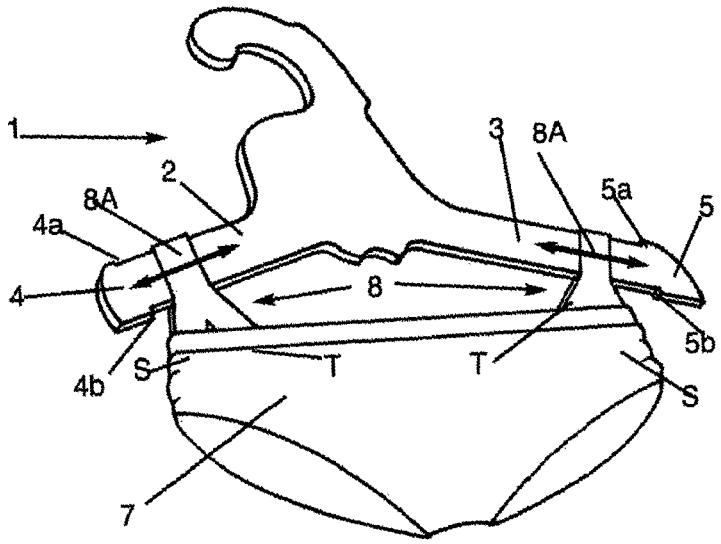

FIG. 130 shows a normal garment located on the extensions.

Figure 131:
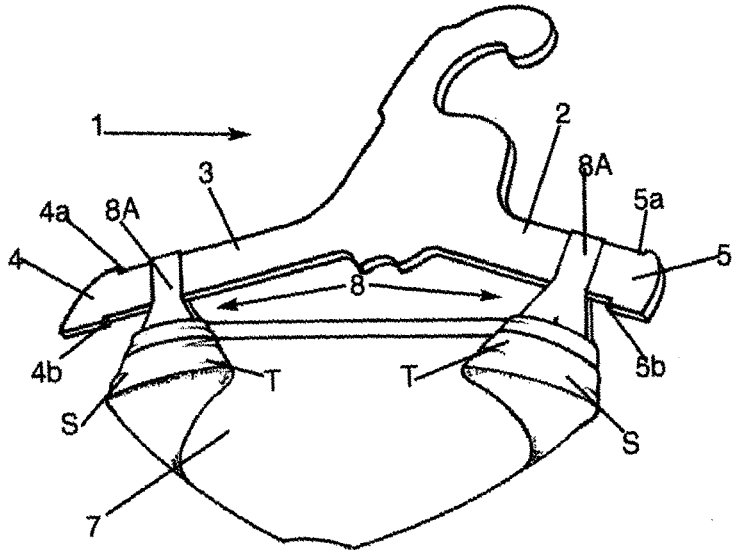

FIG. 131 shows how a larger garment may be hung using the other leg of the extension to take up the extra width of the garment.

Figure 132:
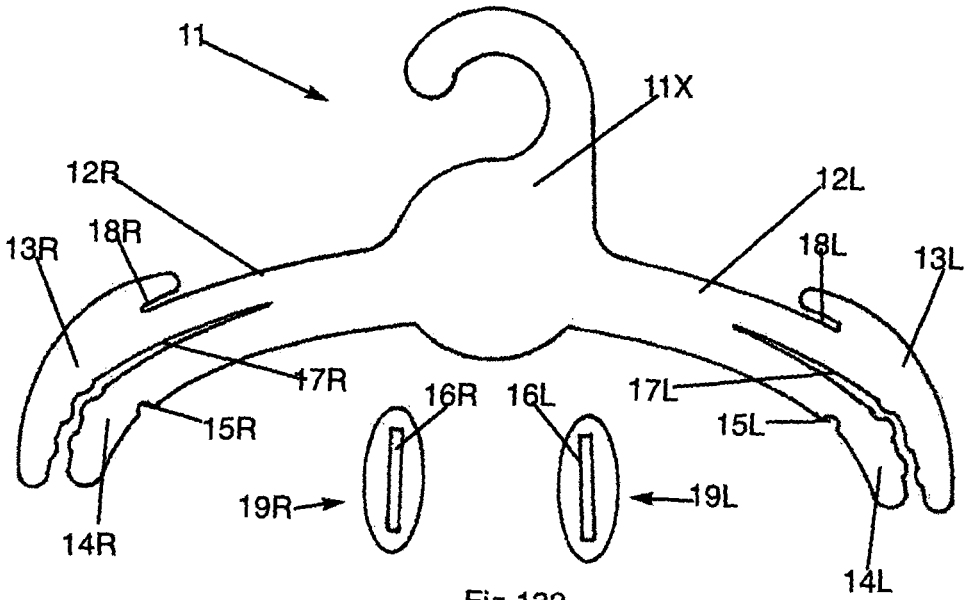

FIG. 132 shows a front elevation of a substantially planar hanger with each arm configured to form a set of 'jaws' at each end, and two clamping pieces in scale.

Figure 133:
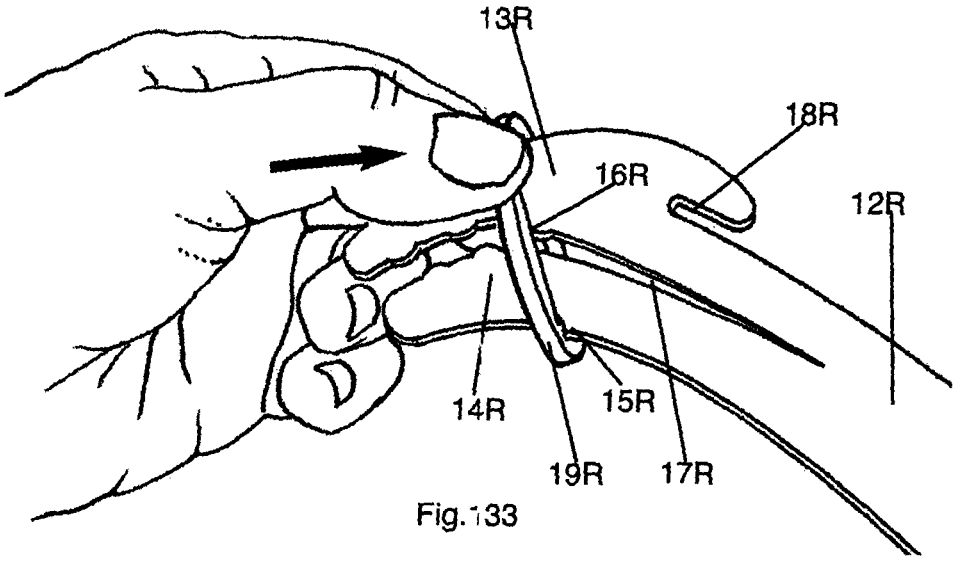

FIG. 133 shows the clamping piece having the jaw-tips inserted into the aperture.

Figure 134:
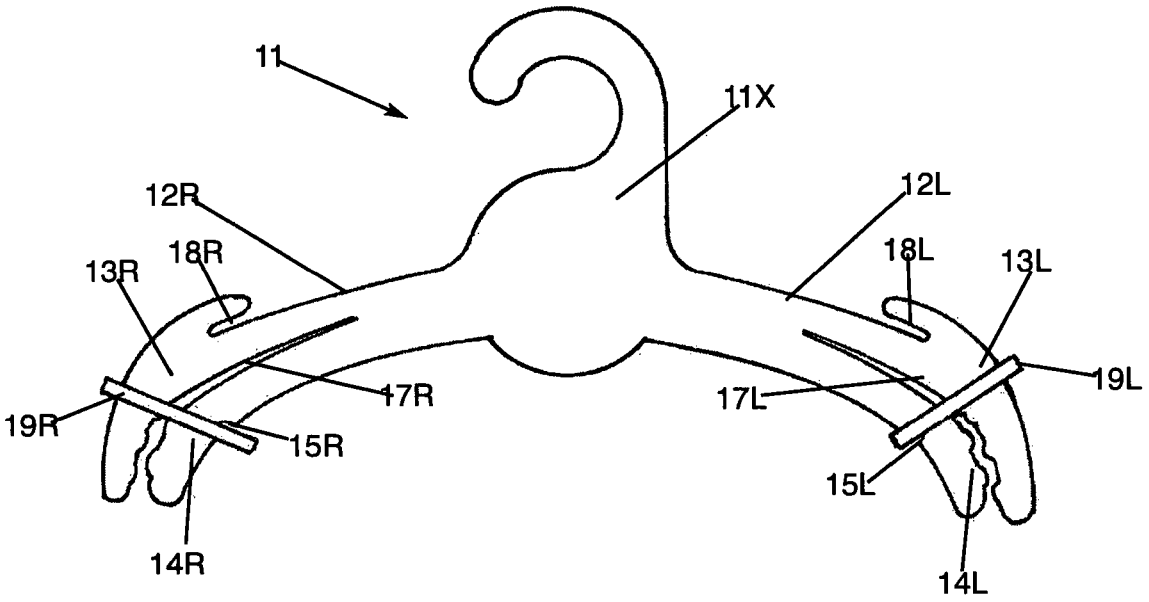

FIG. 134 shows a front elevation with the clamping pieces in situ.

Figure 135:
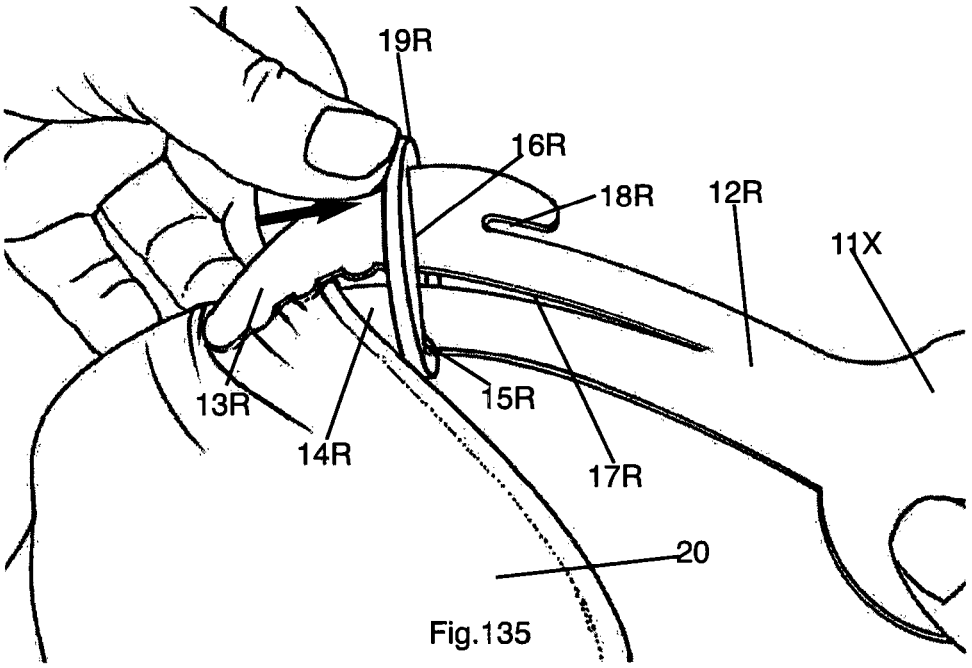

FIG. 135 shows a garment edge being inserted between the jaws and the clamping piece being pushed upwards to close the jaws.

Figure 136:
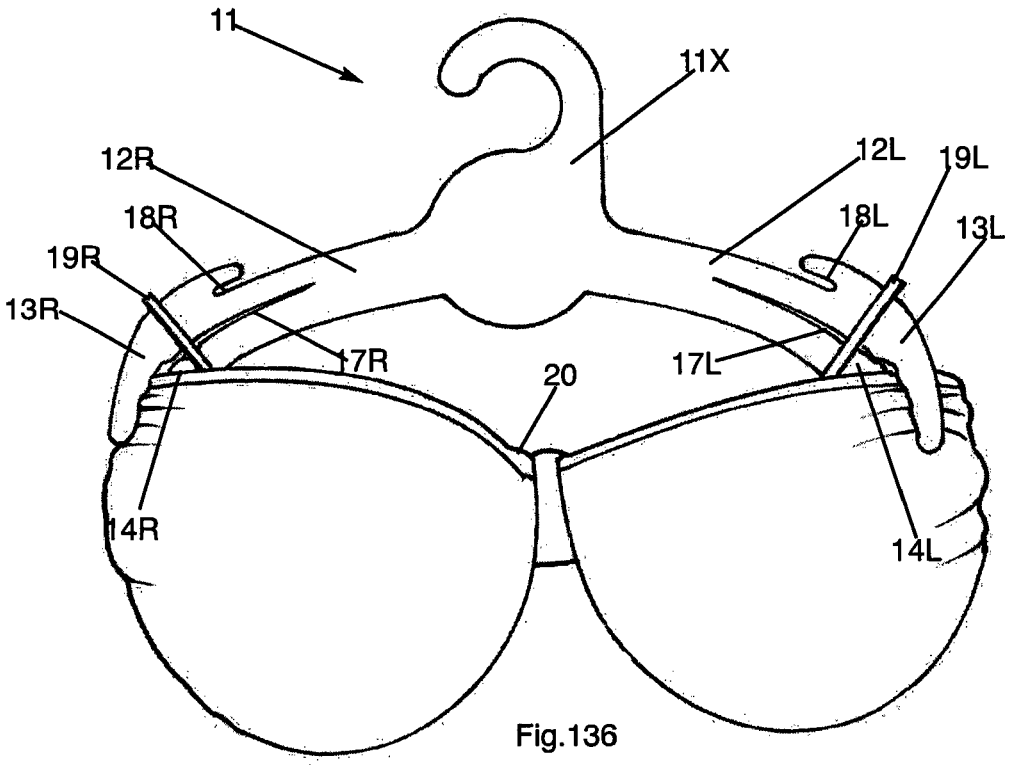

FIG. 136 shows the hanger fully deployed holding a ladies' swimming-top or bra.

Figure 137:
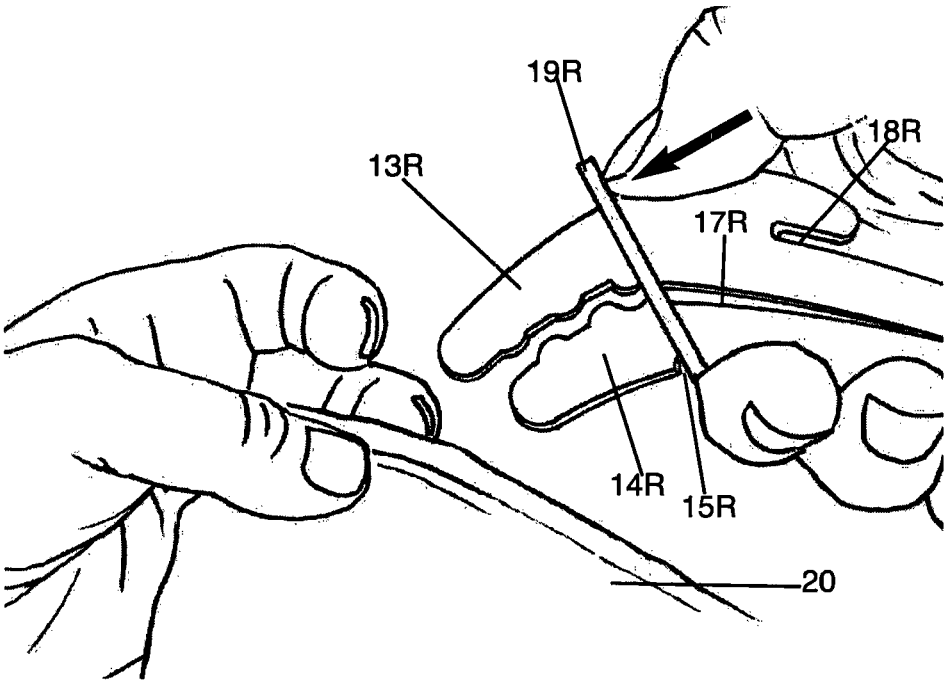

FIG. 137 shows the garment being released by pushing the clamping piece forward.

Figure 138:
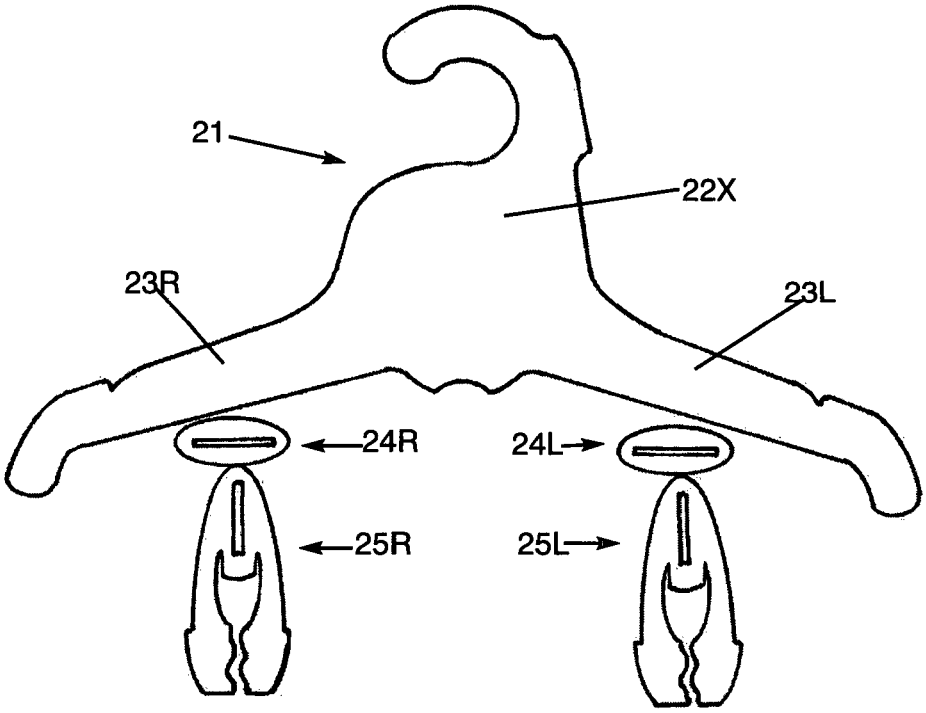

FIG. 138 shows a front elevation of a substantially planar hanger, two grippers and two clamping pieces.

Figure 139:
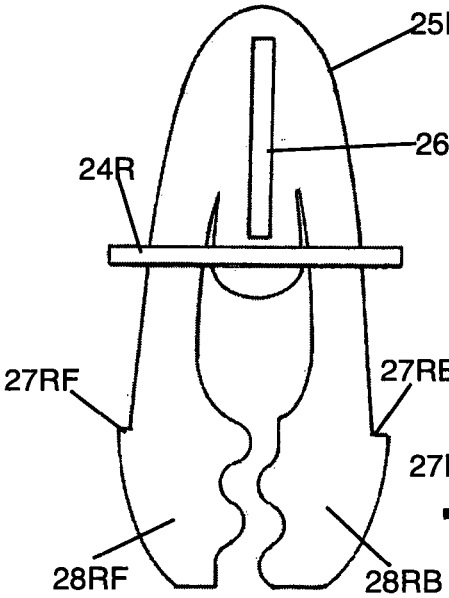

FIG. 139 shows an elevation of the gripper, with the clamping piece in situ prior to the gripper being attached to the hanger.

Figure 140:
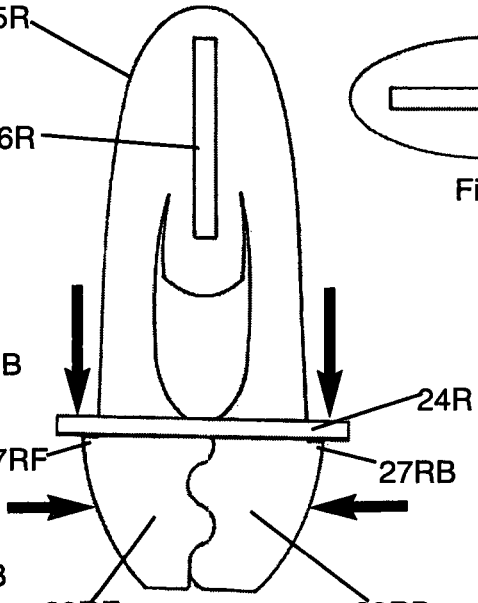

FIG. 140 shows how the clamping piece slides downward to close the jaws of the gripper.

Figure 141:
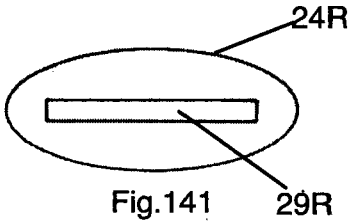

FIG. 141 shows the clamping piece with the aperture cut from its centre.

Figure 142:
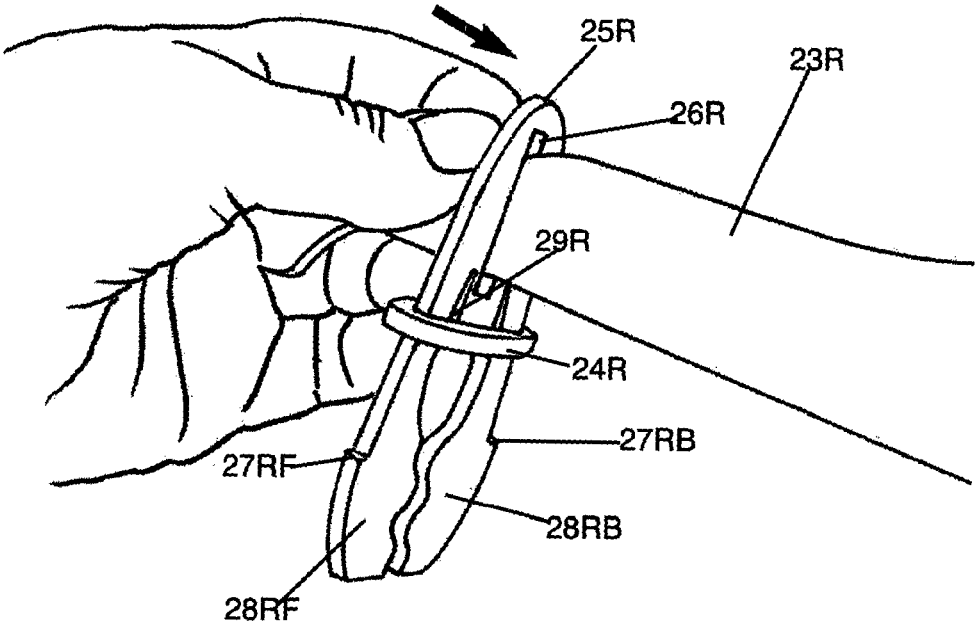

FIG. 142 shows the completed apparatus, the gripper and its clamping piece being attached to the arm of the hanger.

Figure 143:
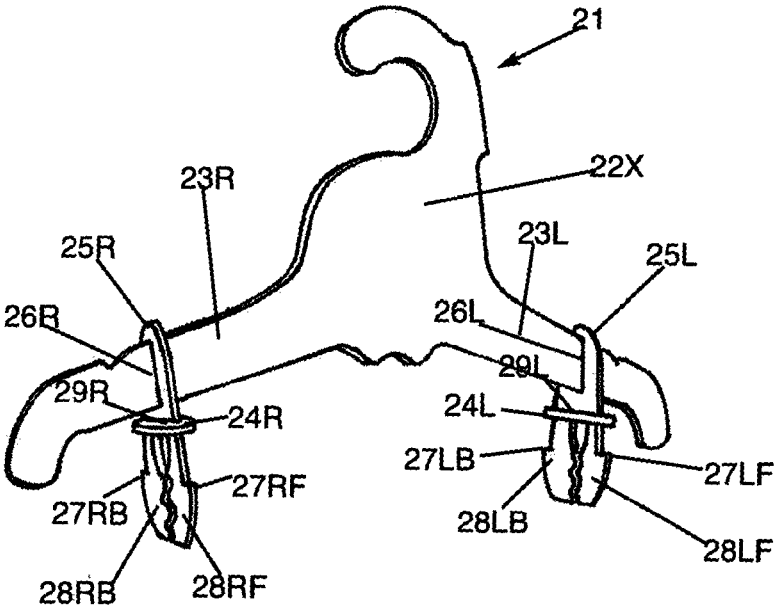

FIG. 143 shows the fully deployed hanger, prior to receiving a garment.

Figure 144:
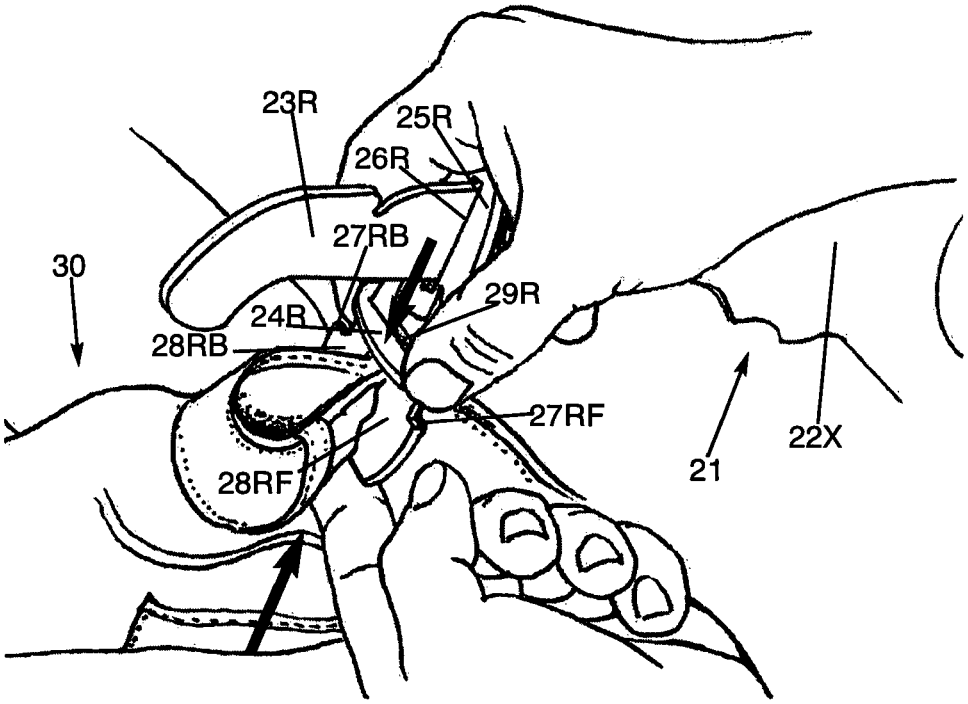

FIG. 144 shows a garment being deployed on the hanger, the gripper jaws being pushed down to trap the hem of a pair of jeans.

Figure 145:
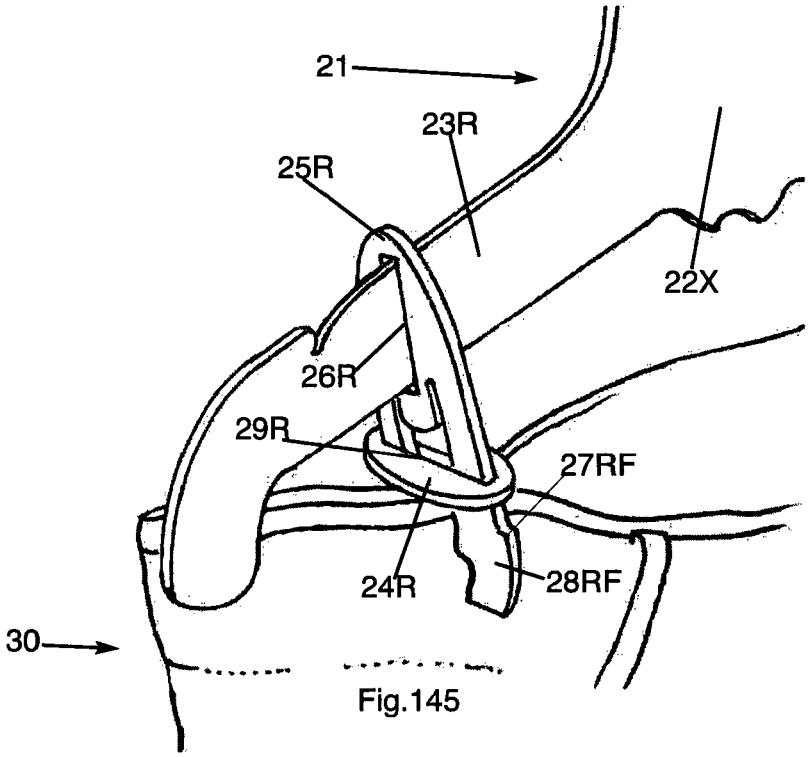

FIG. 145 is a close-up view of one of the fully deployed grippers holding the garment.

Figure 146:
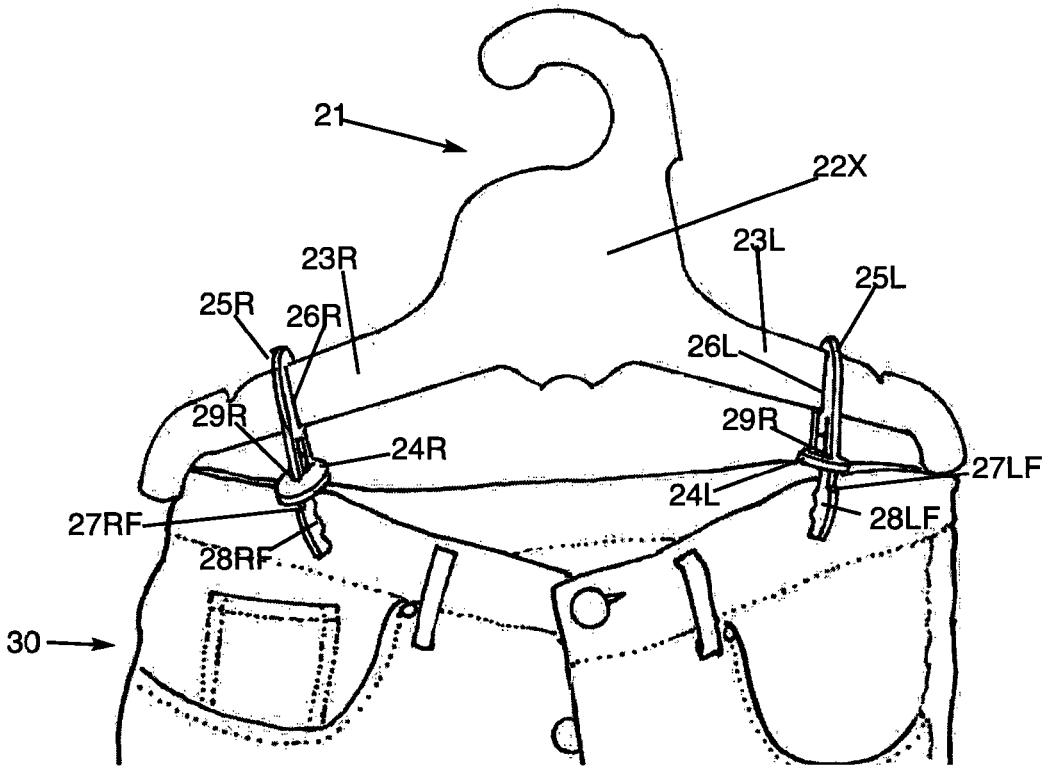

FIG. 146 is a front elevation of the fully deployed hanger with grippers holding a pair of jeans.

Clips

Figure 147:
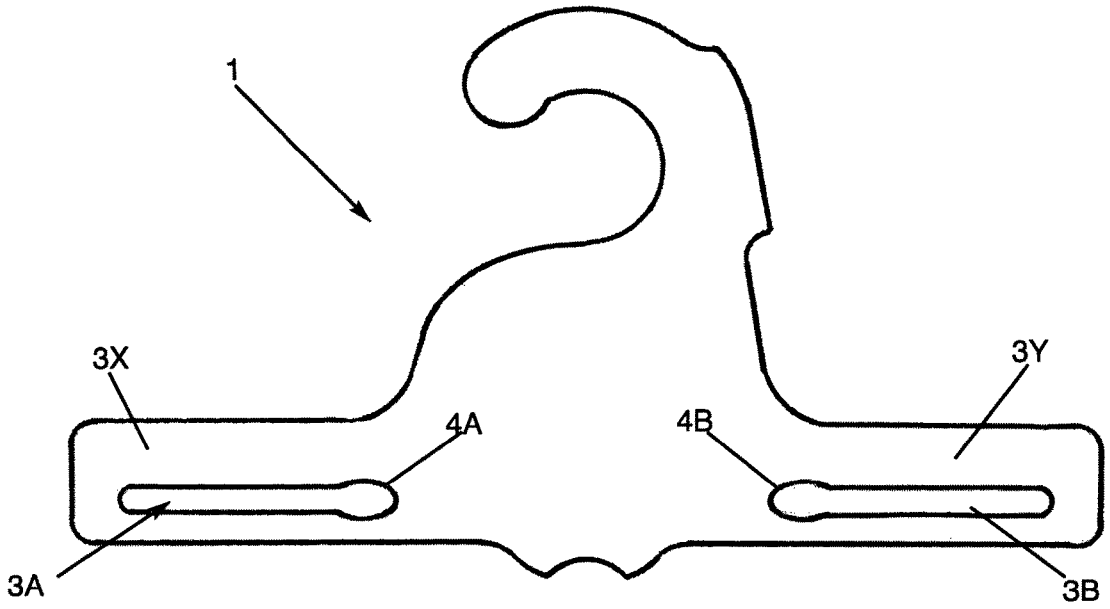

FIG. 147 is the hanger-frame showing the apertures into which the clips fit.

Figure 148:
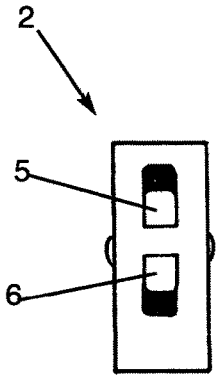

FIG. 148 shows the clip in elevation, with the hooks facing outwards towards the viewer.

Figure 149:
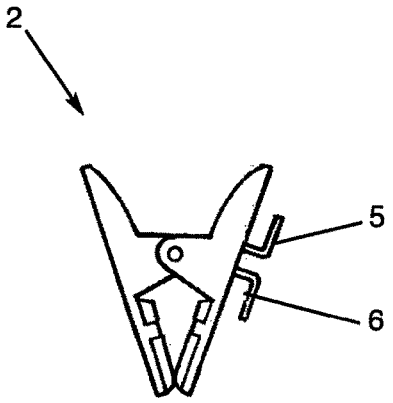
Figure 150:
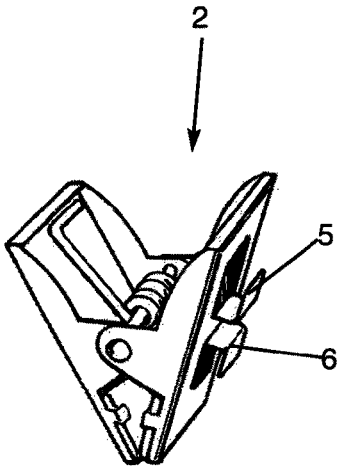

FIG. 149 shows the side elevation with the hooks pointing upwards & downwards FIG. 150 shows a perspective from the hook side.

Figure 151:
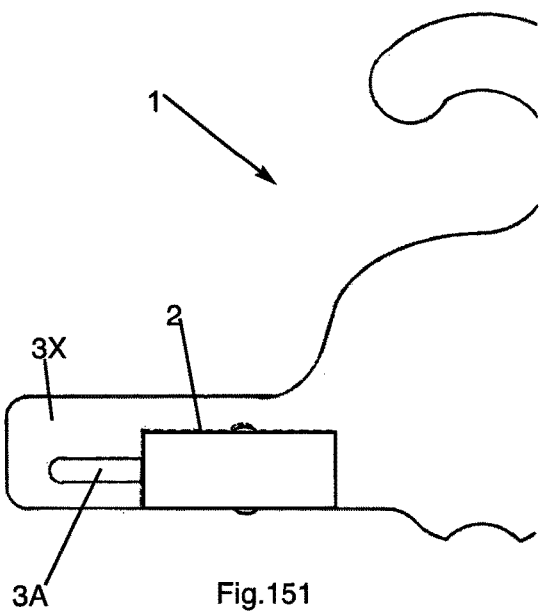

FIG. 151 shows the front of the hanger with the clip placed in the engaging position.

Figure 152:
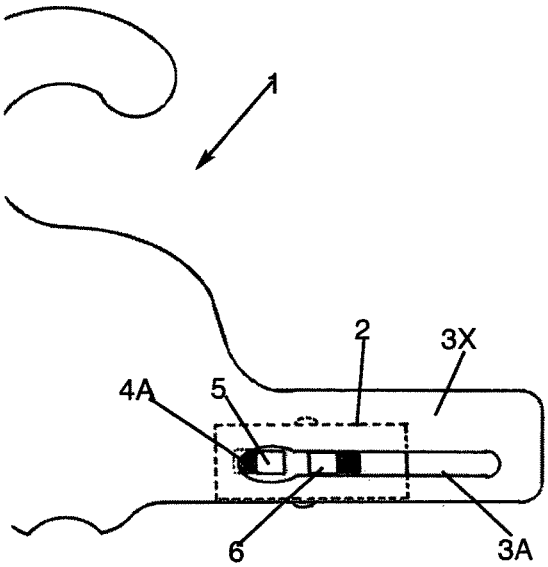

FIG. 152 shows the obverse with the hooks placed into the elliptical engaging hole.

Figure 153:
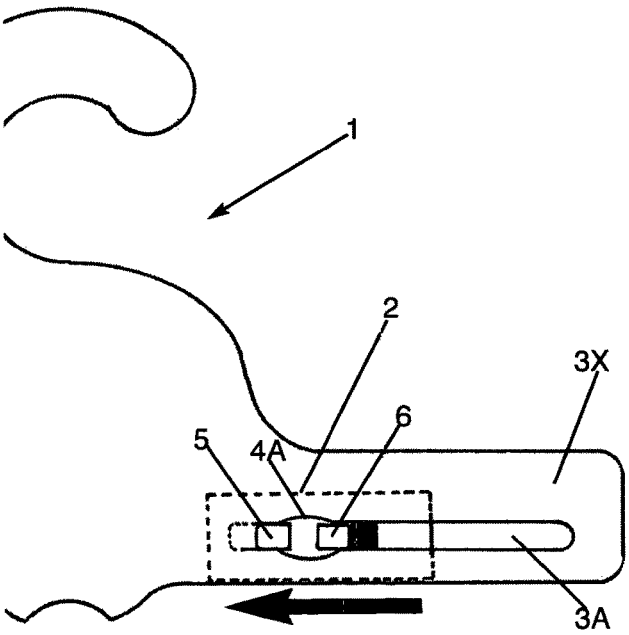

FIG. 153 shows the clip pushed into the turning position within the elliptical hole.

Figure 154:
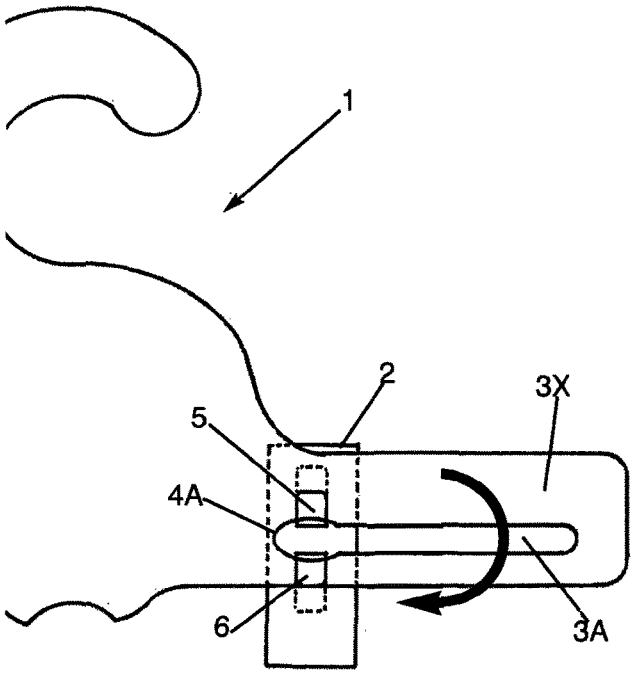

FIG. 154 shows from the back, how the clip is turned.

Figure 155:
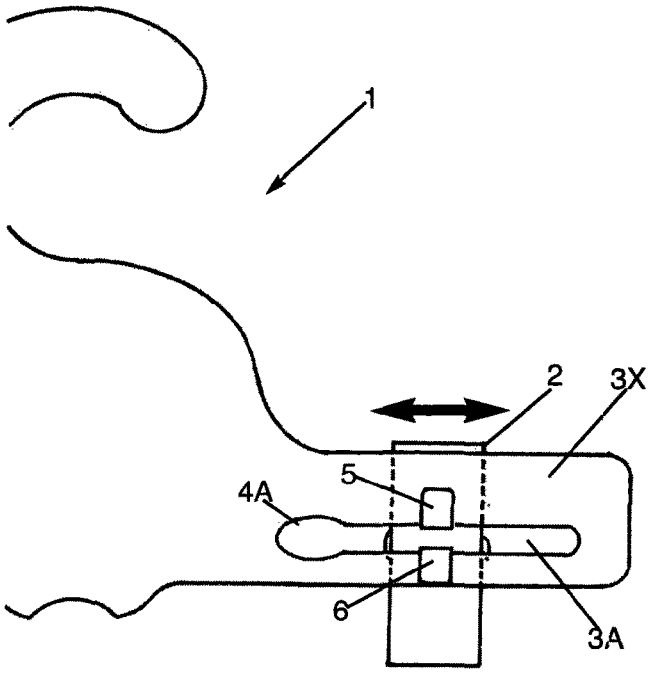

FIG. 155 shows again from the obverse, how the clip is slid horizontally along the apertures.

Figure 156:
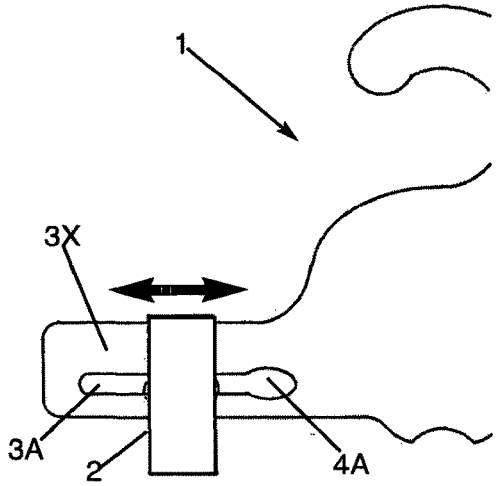

FIG. 156 shows the same from the front.

Figure 157:
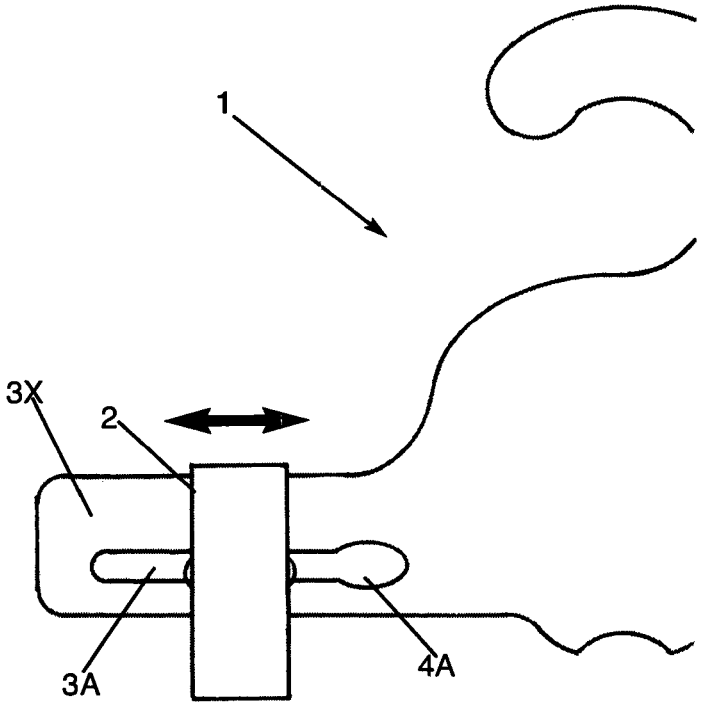

FIG. 157 shows the same front view with the clip in situ.

Figure 158:
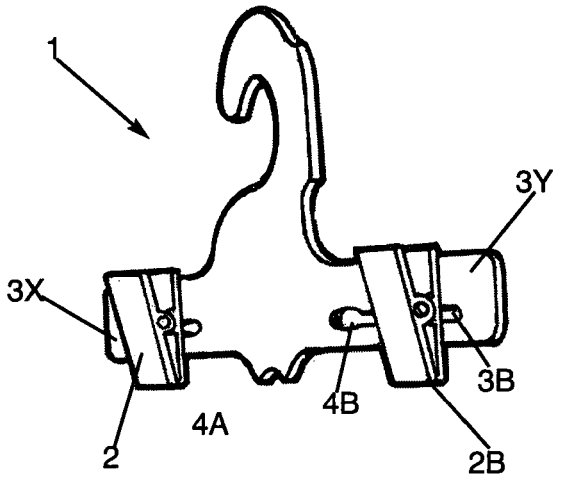

FIG. 158 shows the complete hanger ready to use.

Figure 159:
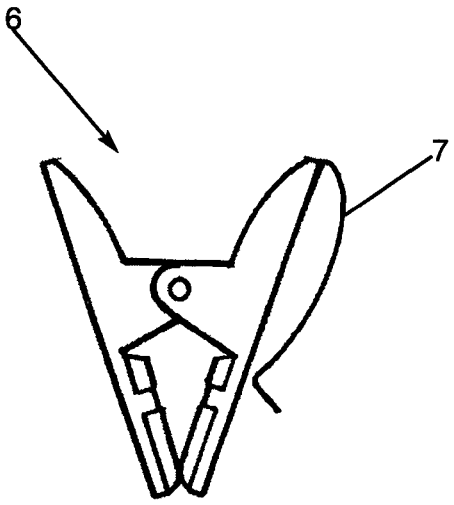

FIG. 159 shows an alternative clip with a variant attachment in side elevation.

Figure 160:
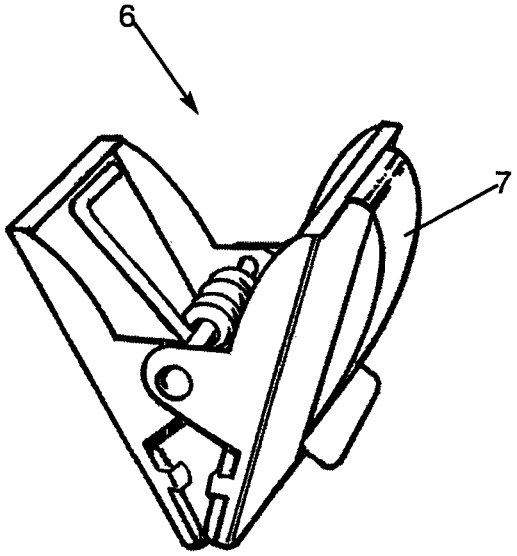

FIG. 160 shows the same in an angled view.

Figure 161:
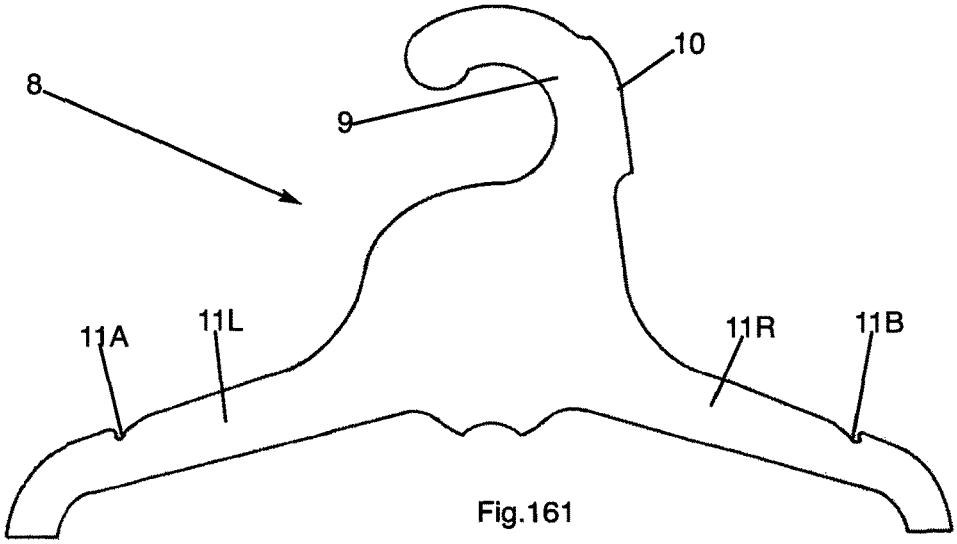

FIG. 161 shows a standard 'shouldered' hanger profile.

Figure 162:
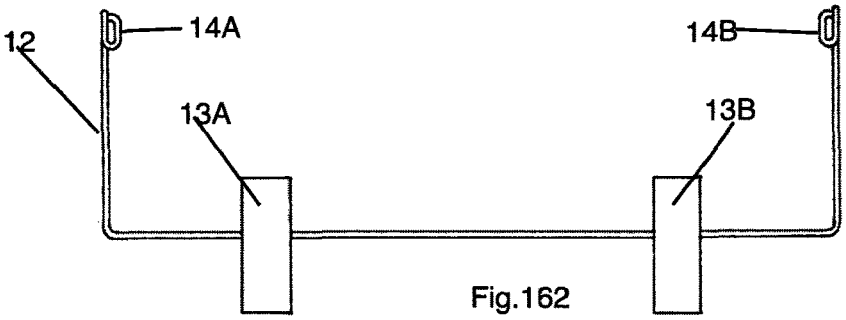

FIG. 162 shows a rail with two sprung grippers or clips located along the horizontal rail, and with gripping loops at either end.

Figure 163:
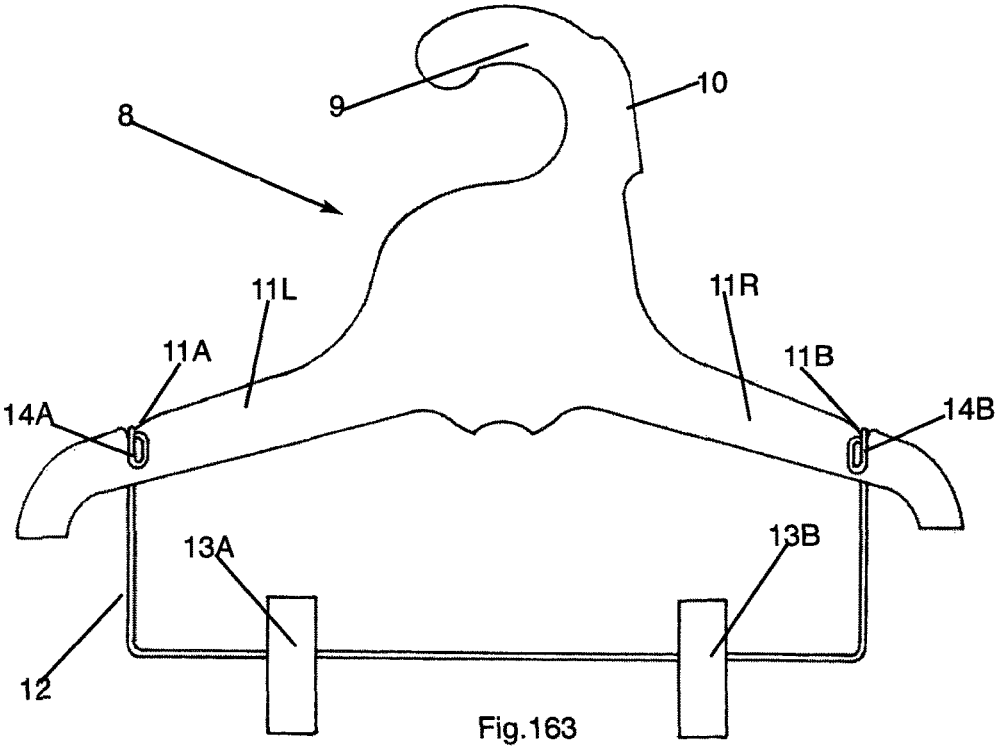

FIG. 163 shows the hanger with the clip-rail attached.

Figure 164:
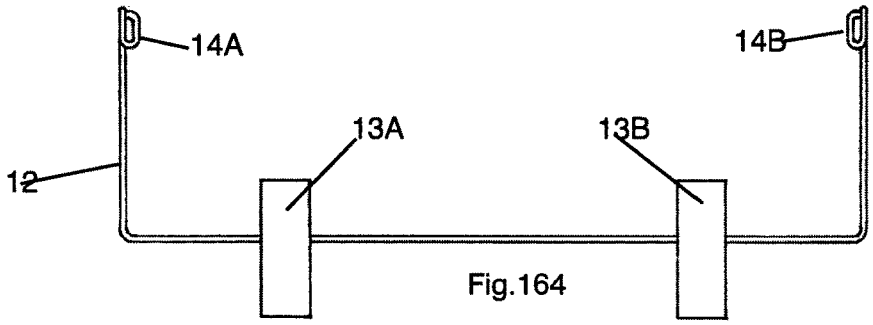

FIG. 164 shows the clip-rail again as a reference for the following FIGS. 165-169.

Figure 165:
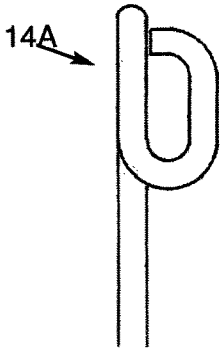

FIG. 165 shows an enlarged detail of the attachment 'loop' in front elevation.

Figure 166:
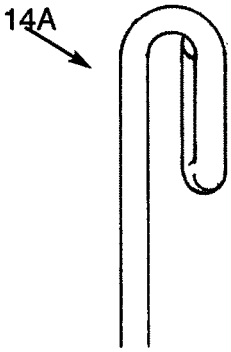

FIG. 166 shows a side elevation.

Figure 167:
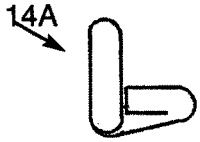

FIG. 167 shows a plan view, looking downwards from above.

Figure 168:
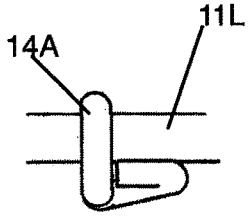

FIG. 168 shows also a plan view showing the gripping loop attached to the edge of a hanger.

Figure 169:
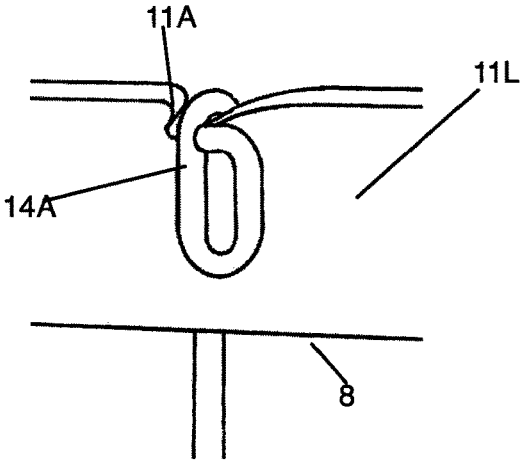

FIG. 169 shows a schematic view showing a side view in perspective.

Figure 170:
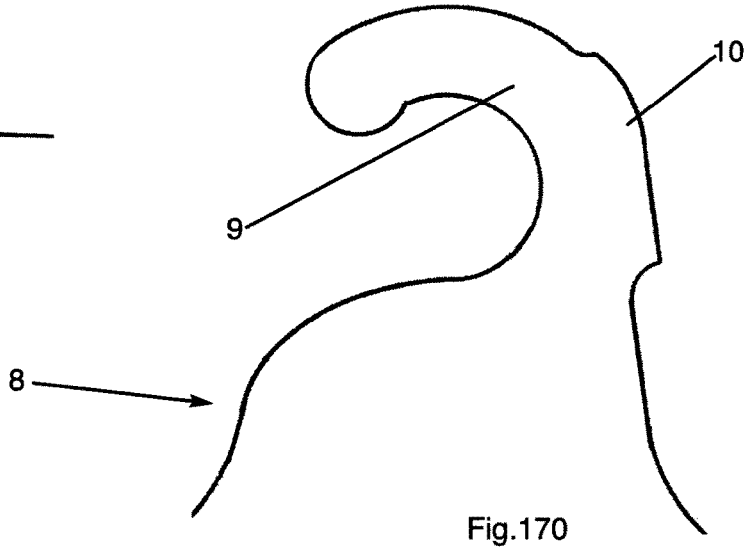

FIG. 170 shows the hook with the strengthening extension.

Hanger Tubes

FIG. 171 shows the substantially planar hanger.

FIG. 172 shows same hanger in a three-quarter view showing its depth dimension.

FIGS. 173 & 174 show the view from below, of the two tube-shoulder pieces.

FIGS. 175 & 176 show the plan view, or view from above.

FIGS. 177 & 178 show the side elevations.

FIG. 179 shows a perspective view of the tube-shoulder from the inner end.

Figure 180:
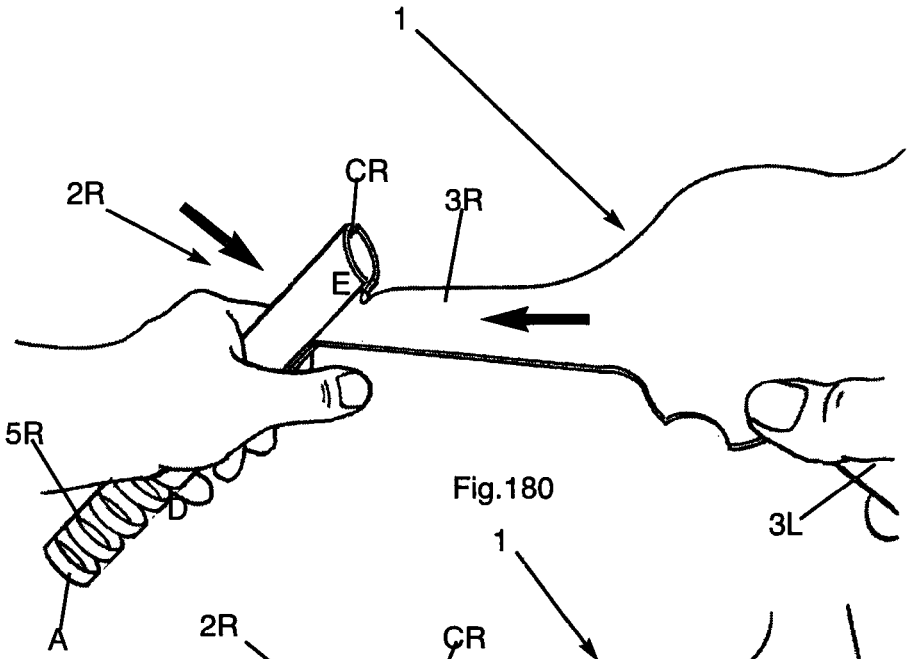
Figure 181:
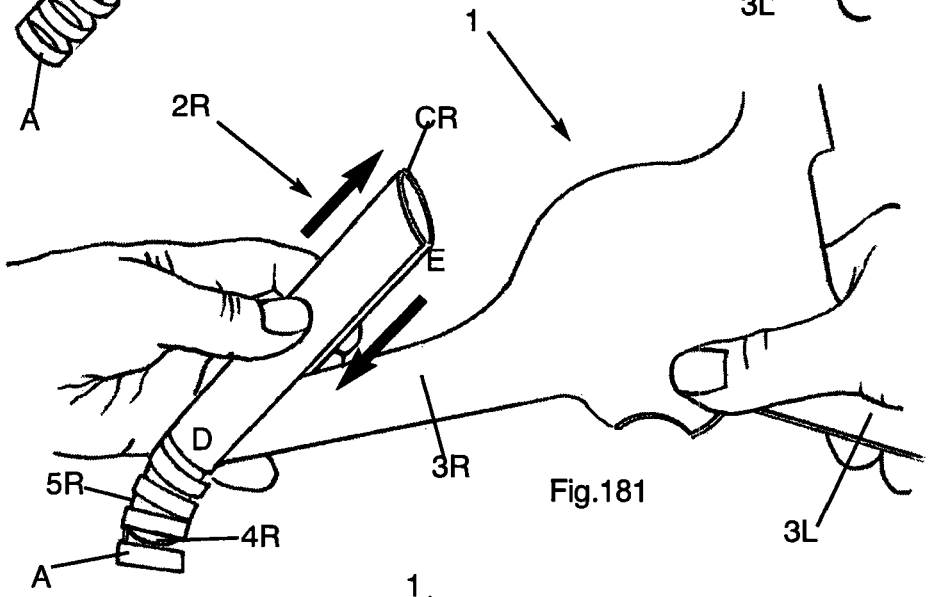
Figure 182:
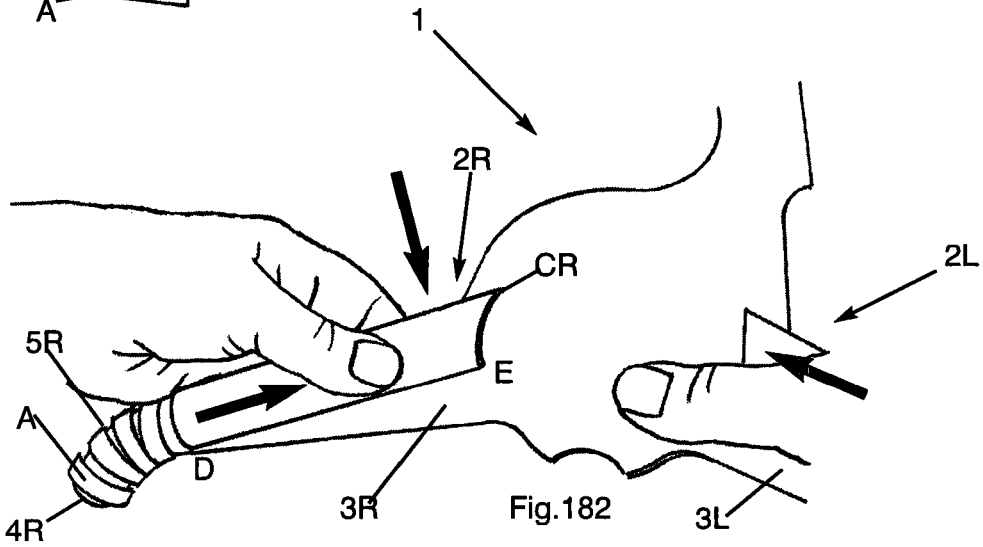
Figure 183:
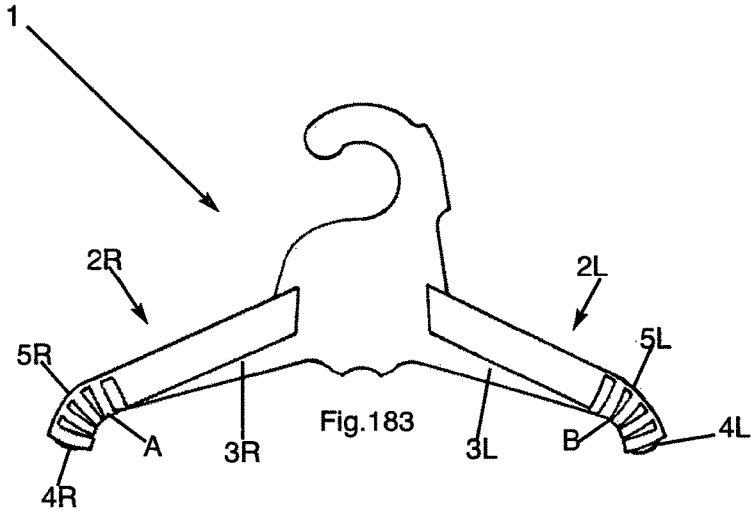
Figure 184:
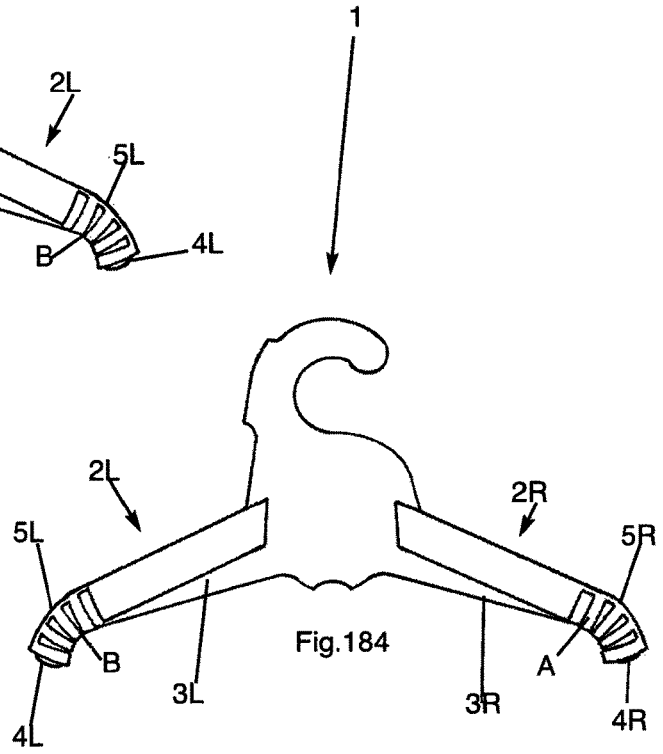

FIGS. 180-182 are schematic drawings showing how the tube-shoulder is attached to the hanger. FIGS. 183 & 184 are front and back views respectively of the hanger with the tube-shoulders deployed.

Figure 185:
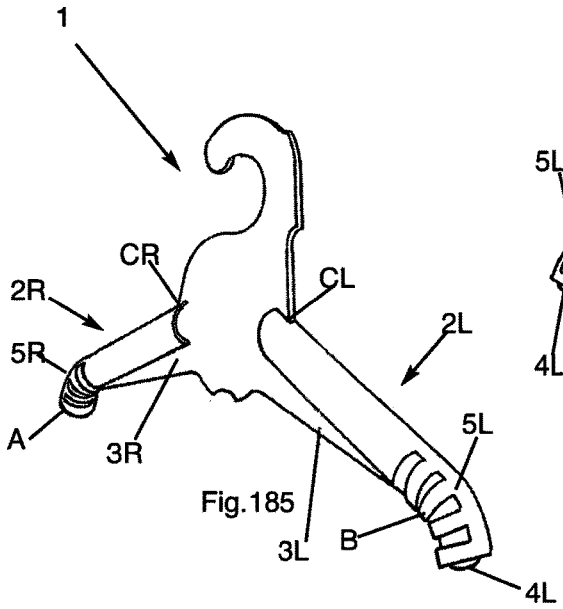

FIG. 185 is a perspective view.

Figure 186:
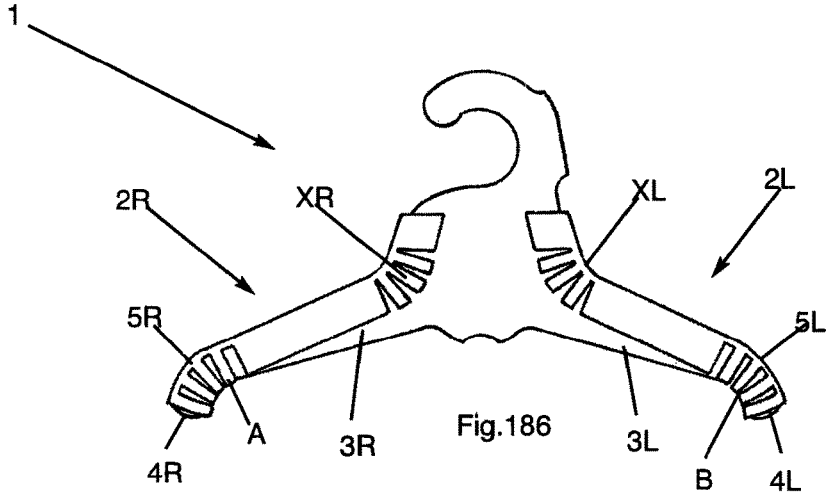

FIG. 186 shows a further development where the tube-shoulder is extended inwards towards the centre of the hanger to form a contoured neck.

FIG. 187 shows the substantially planar centre-section of a hanger incorporating a hook, and two outward-pointing members cut out from, and contained within, the centre-section.

FIG. 188 shows a side elevation of the sectioned tube. (Two identical tubes are provided, one for each shoulder).

FIG. 189 is a plan view of the tube.

FIG. 190 is a view from below.

FIG. 191 shows the stay, which holds the loops

FIGS. 192 & 193 are end elevations of the tube.

Figure 194:
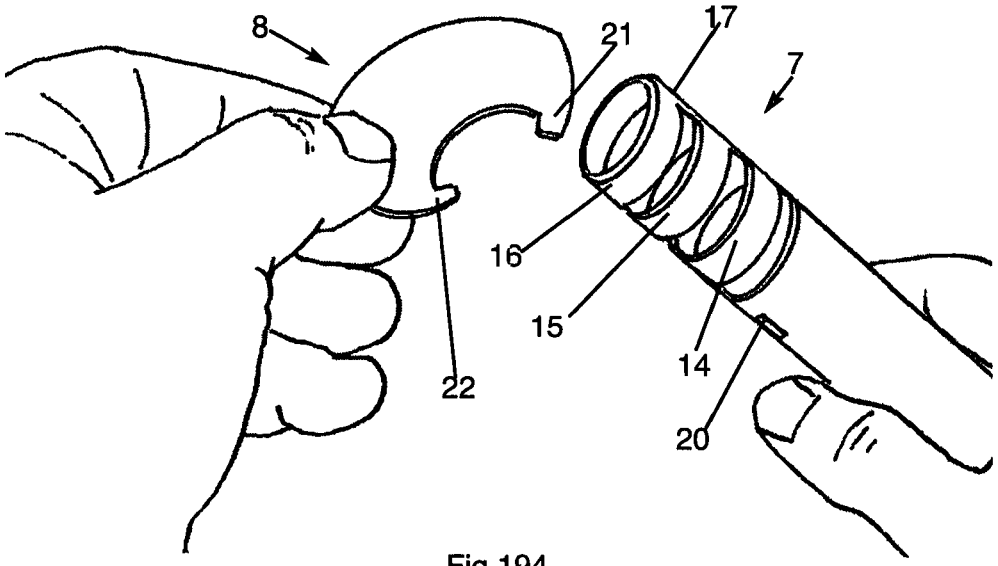
Figure 195:
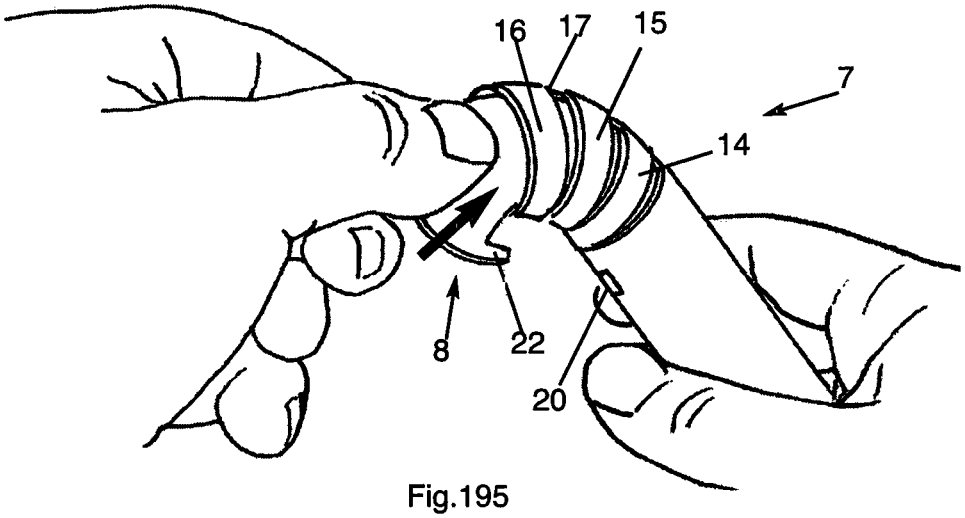
Figure 196:
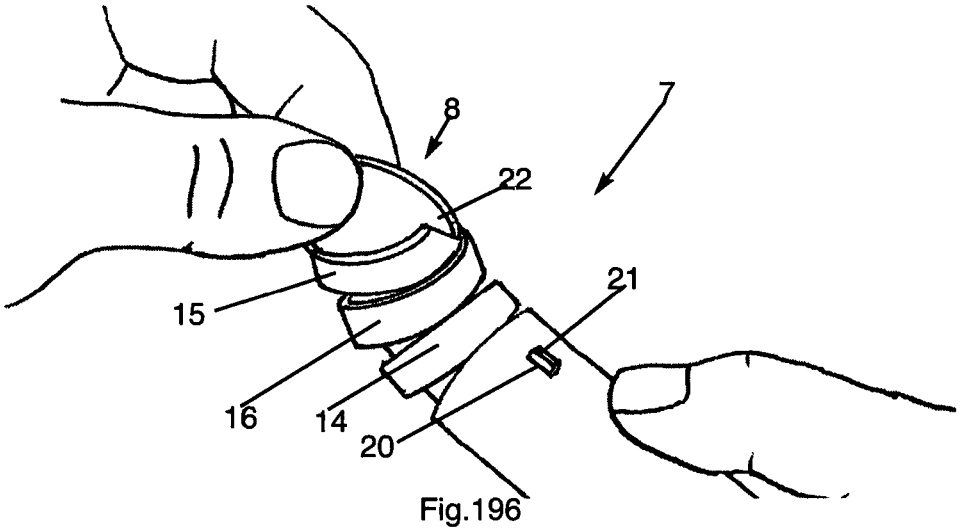
Figure 197:
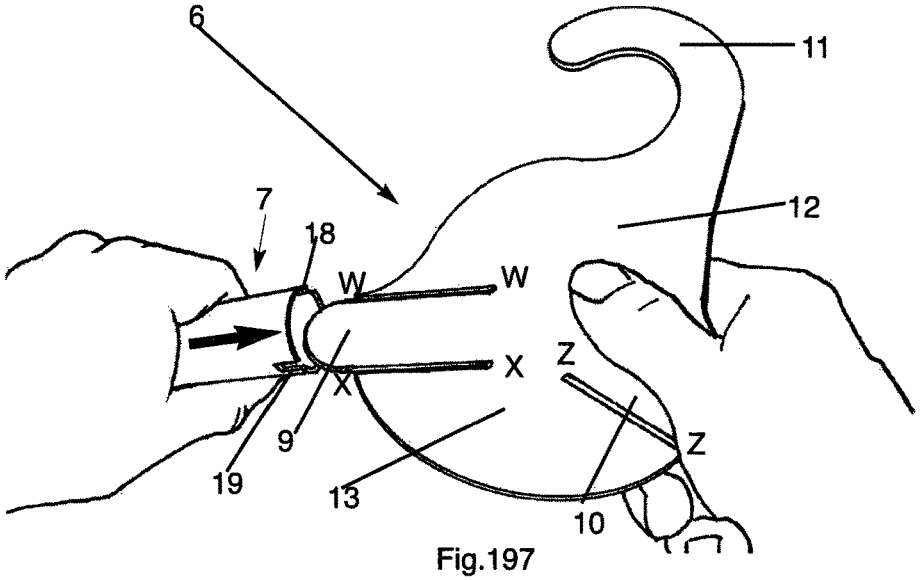
Figure 198:
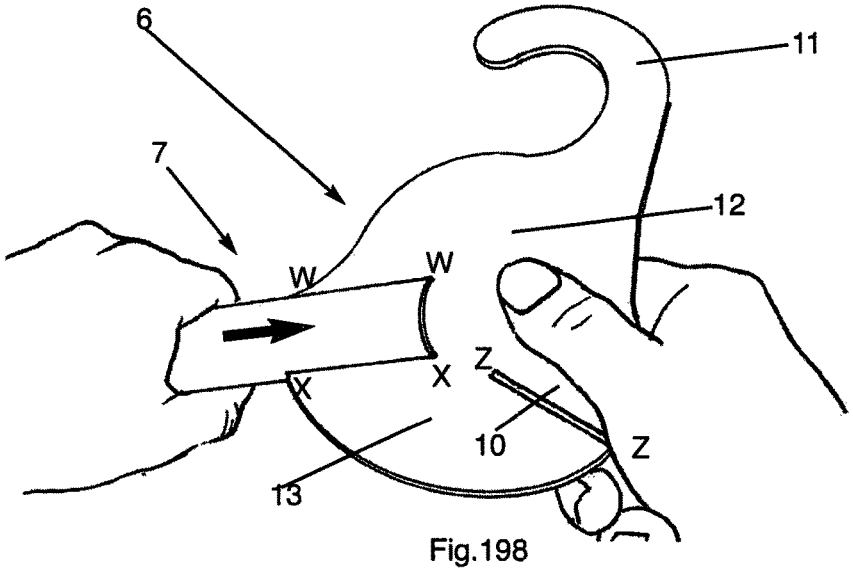
Figure 199:
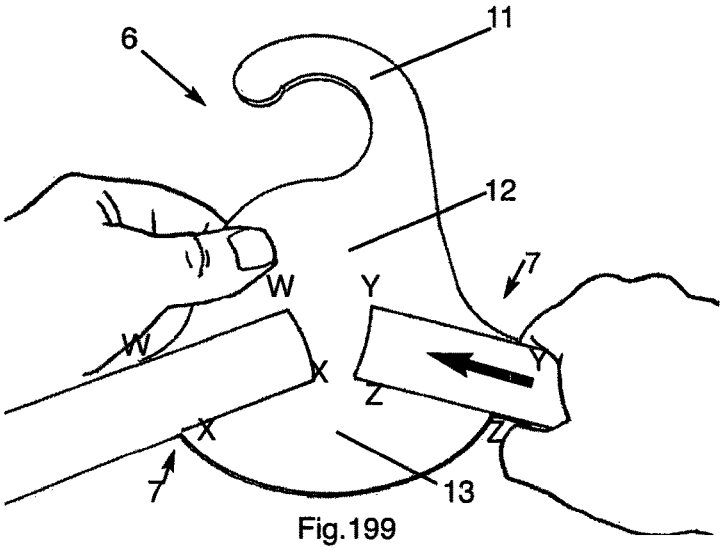

FIGS. 194-196 are schematic drawings showing how the stay is inserted and fixed into the loop-sections of the tubes FIGS. 197-199 show how the tubes are attached to the centre-section.

Figure 200:
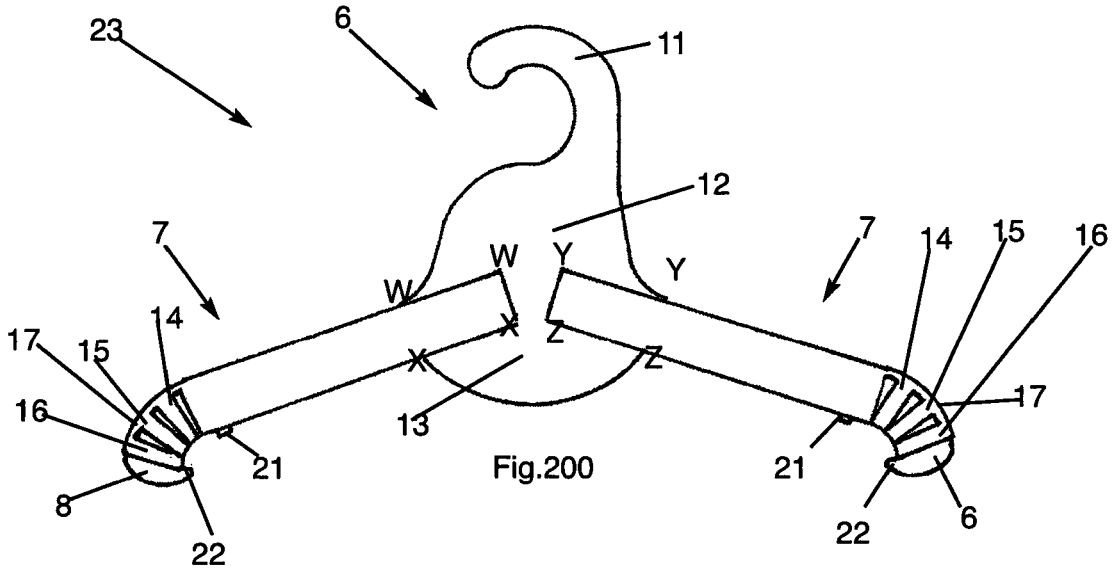
Figure 201:
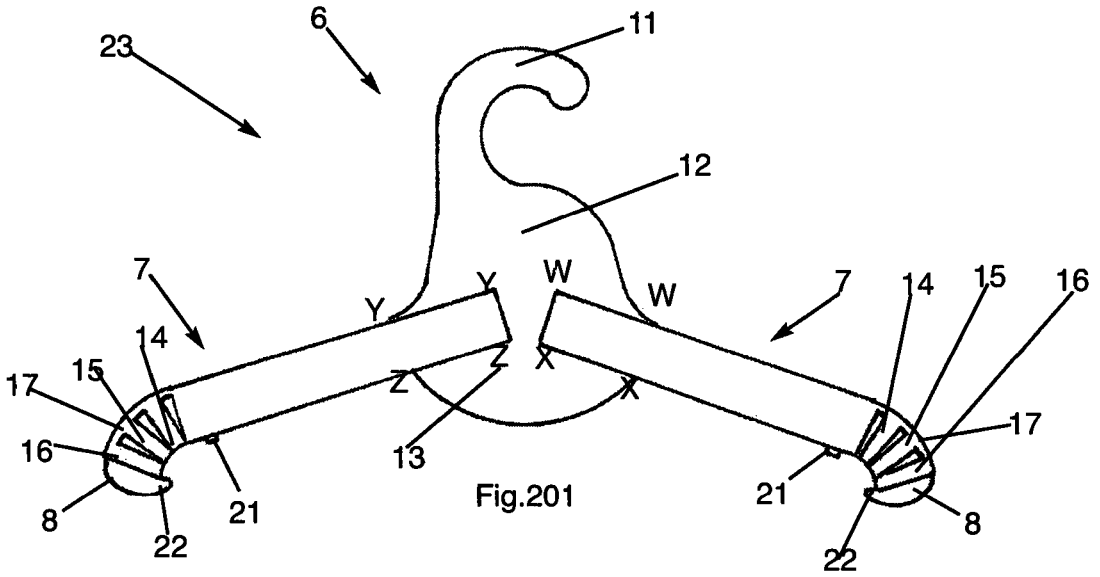

FIGS. 200 & 201 show front and back views of the complete hanger.

Quick Fix Hook

Figure 202:
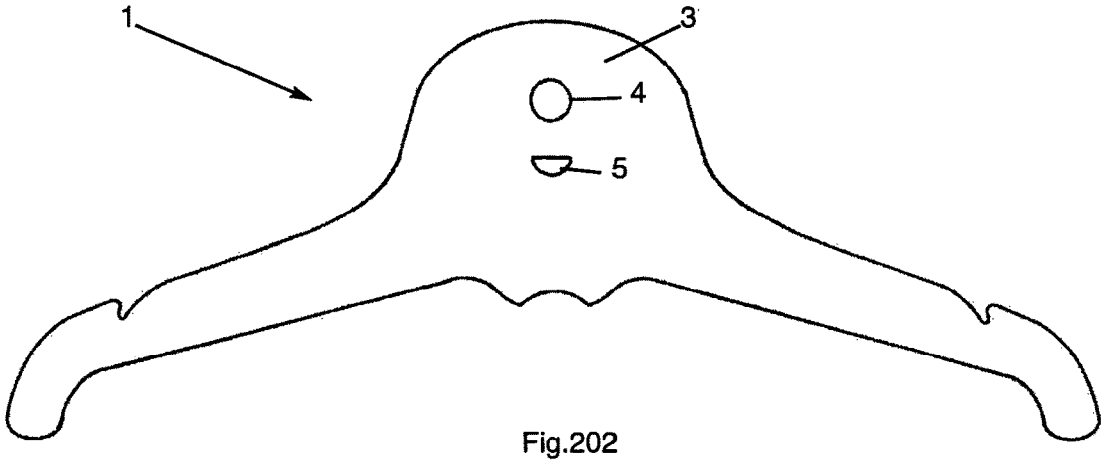

FIG. 202 shows a front elevation of the hanger with two apertures

Figure 203:
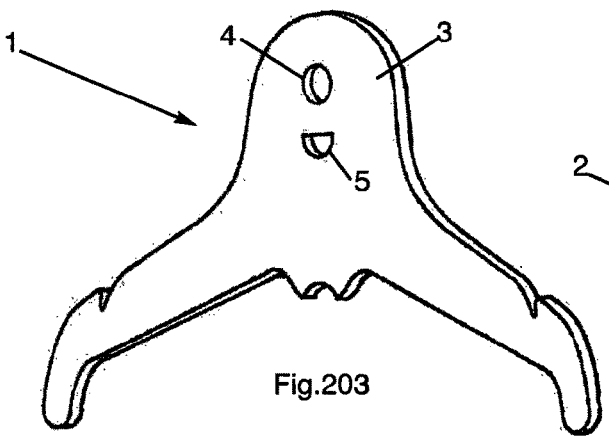

FIG. 203 shows a perspective view from one side

Figures 204, 205:
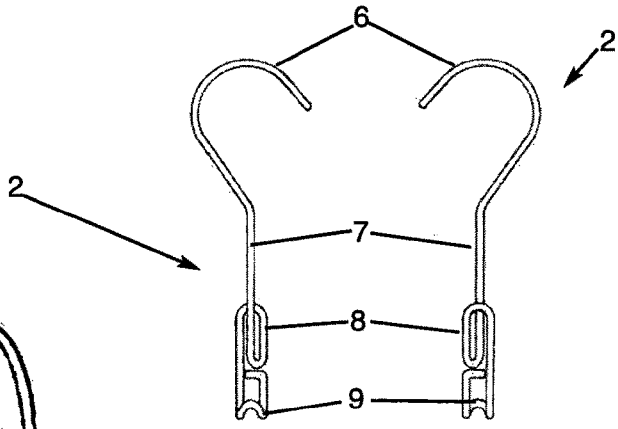

FIGS. 204 & 205 show a back and a front view of the hook apparatus

Figures 206, 207:
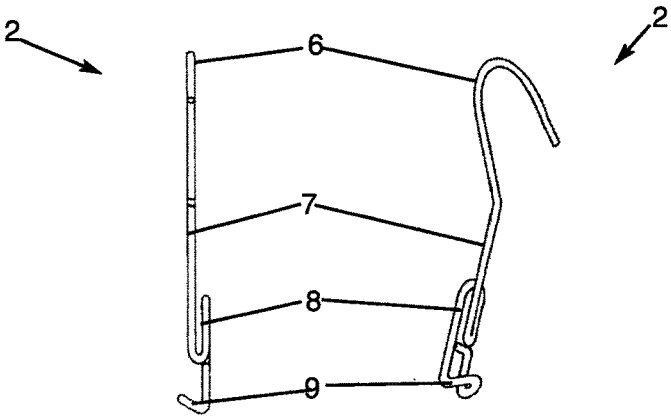

FIG. 206 shows a side elevation of the hook

FIG. 207 shows a perspective looking from slightly below

Figure 208:
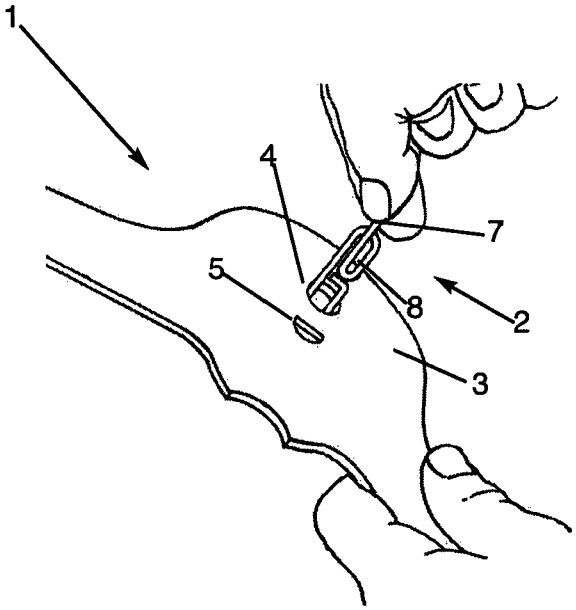
Figure 209:
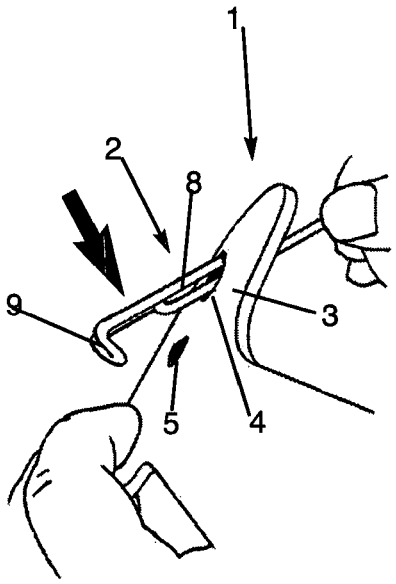
Figure 210:
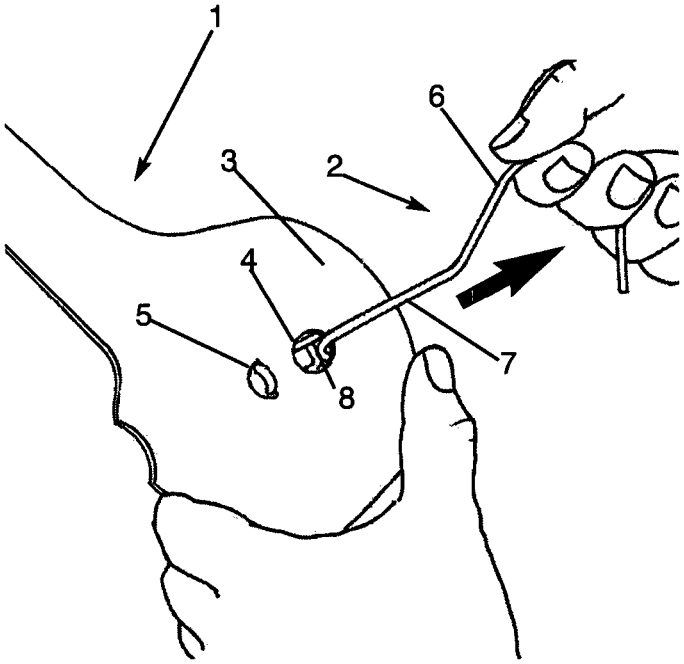
Figure 211:
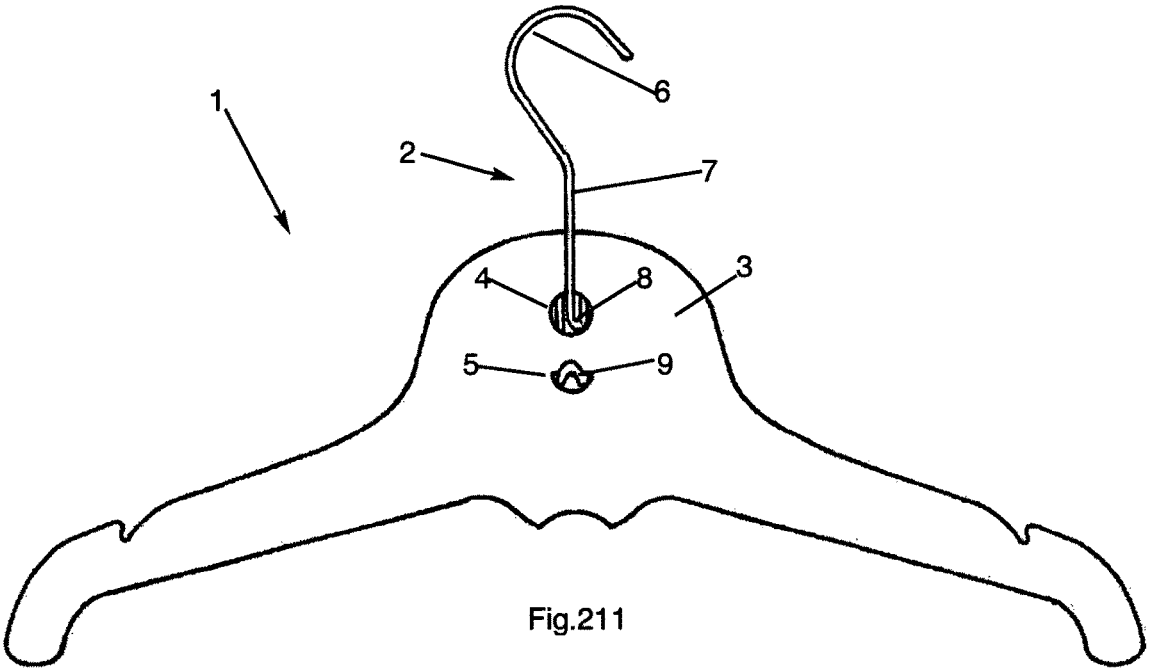
Figure 212:
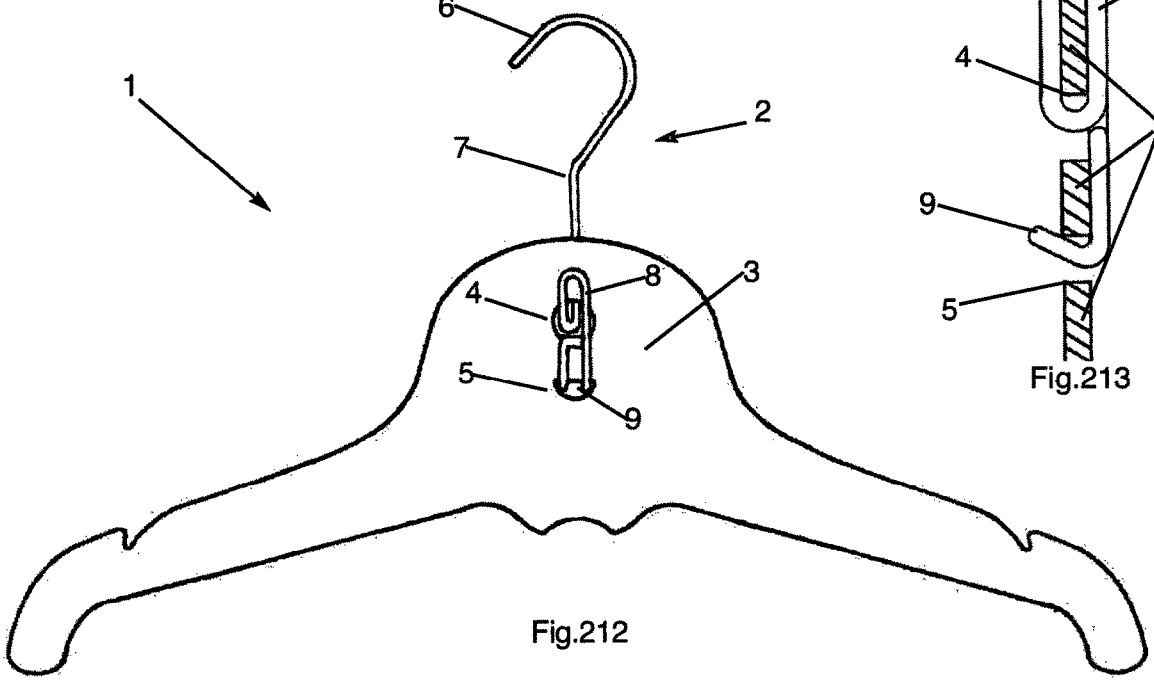
Figure 213:
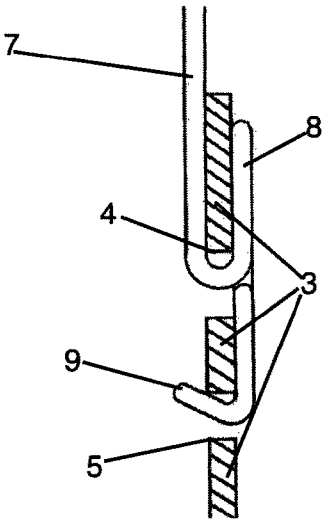
Figure 214:
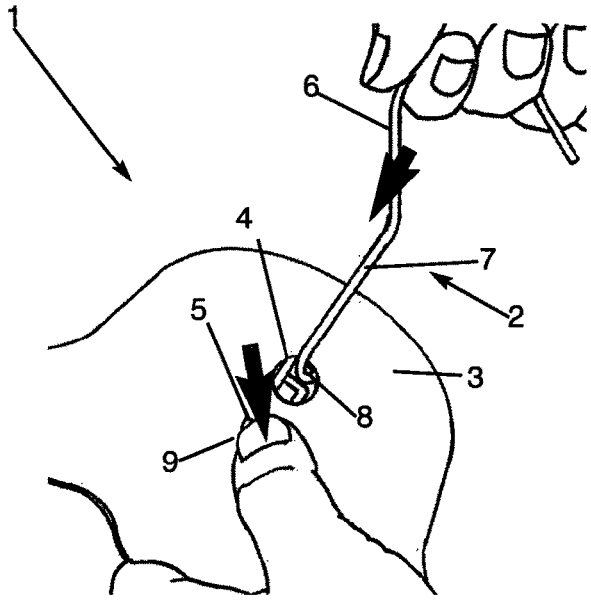
Figure 215:
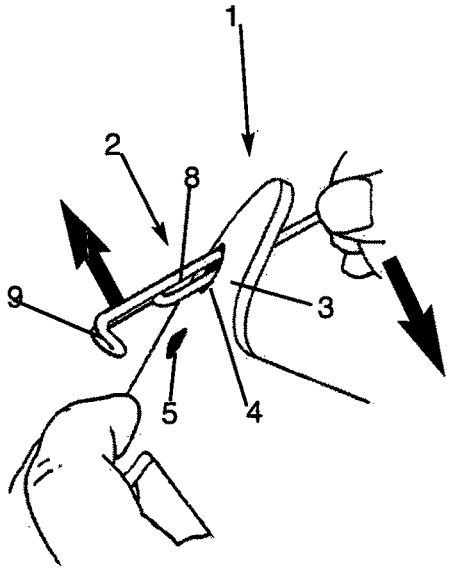

FIG. 208 shows how the apparatus is inserted through the upper aperture from one side FIG. 209 shows the insertion from the other side FIG. 210 shows the way the spur slots through the lower aperture when the hook is pulled upwards FIGS. 211 & 212 show front and back views of the hanger with the apparatus in situ FIG. 213 is a cross-section from the side showing how the apparatus is held in situ when deployed FIGS. 214 & 215 show how the apparatus is extracted from the hanger

DETAILED DESCRIPTION

Top Strip

According to FIGS. 1-7, there is provided a hook 2 (FIGS. 1, 3 & 6), a central or main section of a hanger 1, a bracket 4, and a top-strip 3 which form the hanger 1, 2, 3, 4, with a rotating hook 2. In FIGS. 1, 3, 6 a standard hook 2 is shown, with a pommel at the bottom end. In FIG. 4 a bracket 4 shaped like a letter lying on its side is shown in perspective. On the top inside surface of the upper leg A, and in the same position on the lower leg B, behind the fold-lines X-X on the upper leg, and Y-Y on the lower leg, holes 7,8 have been punched to accommodate the shaft of the hook 2. FIG. 5 shows how the bracket 4, which may be slid down the hook 2 from the tip 10, attaches to the lower end of the shaft of the hook 2, stopped from moving further by the pommel 6. FIG. 2 shows the main body or frame of the hanger 1 with arms 1L, 1R, extending outward, and a series of tabs, 1A-8A, projecting outwards from the top surface of the hanger frame 1.

FIG. 7 shows in plan view, the whole length of the top-strip 3, with apertures 1B-8B cut, in the present embodiment, centrally, along the length of the strip 3, at intervals corresponding in dimensions and position to the tabs 1A-8A projecting from the top surface of the hanger frame 1.

Figure 8:
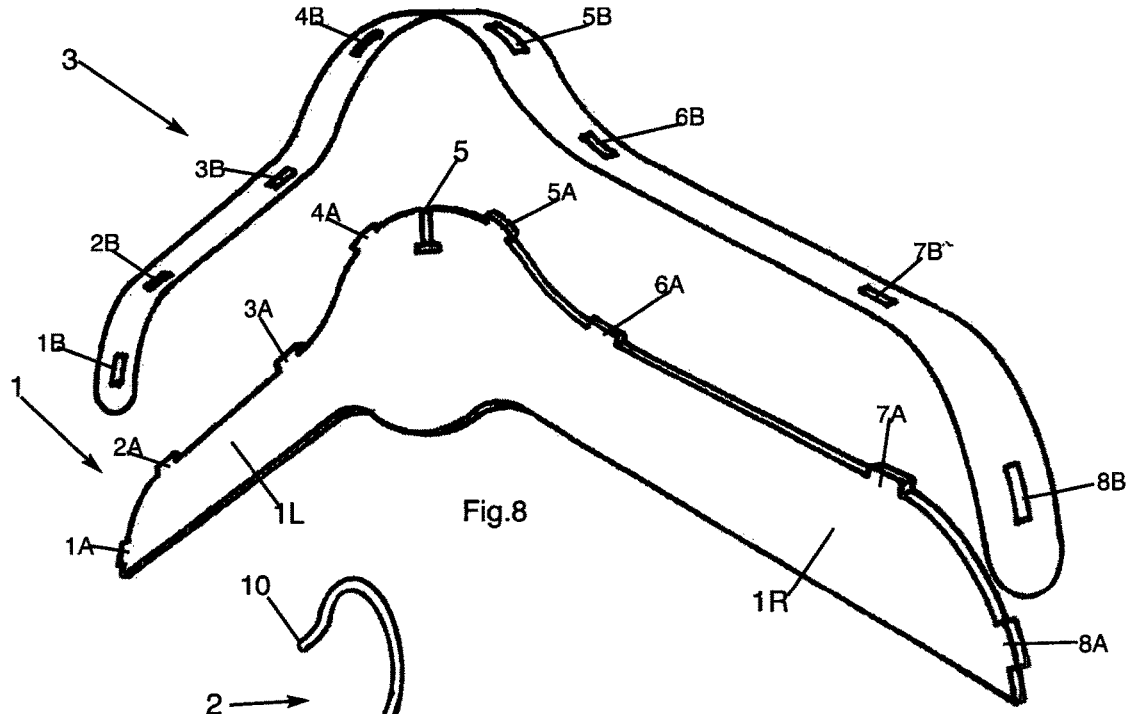
FIG. 8 shows the main planar section of the hanger, with the top-strip positioned prior to being attached to it.
Figure 9:
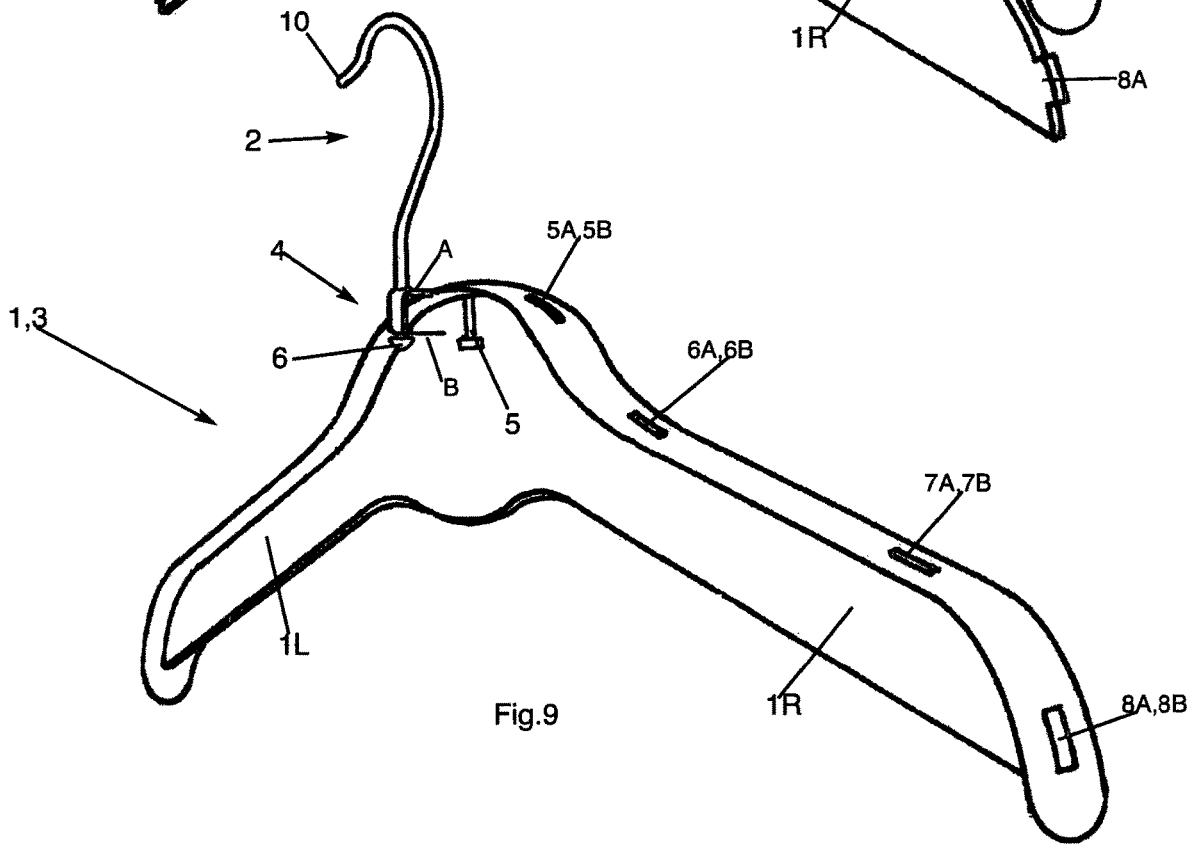
FIG. 9 shows the two parts, the main section and the top-strip joined along the length of the hanger, with the tabs engaged with the slots, and the hook with bracket attached in position to be inserted into the slot provided on the main section of the hanger.

In FIG. 8 the top strip 3 is shown in position prior to being brought together with the hanger-frame 1, and in FIG. 9 the two parts 1, 3 are brought together with the tabs 1A-8A on the hanger frame 1 engaging with the apertures 1B-8B, to form a stronger and more rigid 'T-section'. The tabs 1A-8A may be cut either to stand proud of the upper surface of the top-strip 3, or to be set at the same level. In FIG. 9 also, the hook 2 is shown with the bracket 4 in position, prior to being pushed through the slot 5, at the indent 9 cut into the outer front edge of the top strip 3, the slot 5 being cut downwards and vertically into the hanger frame 1 in the shape of an inverted letter 'T' and set into the hanger frame 1 in the centre of the top surface.

Figure 10:
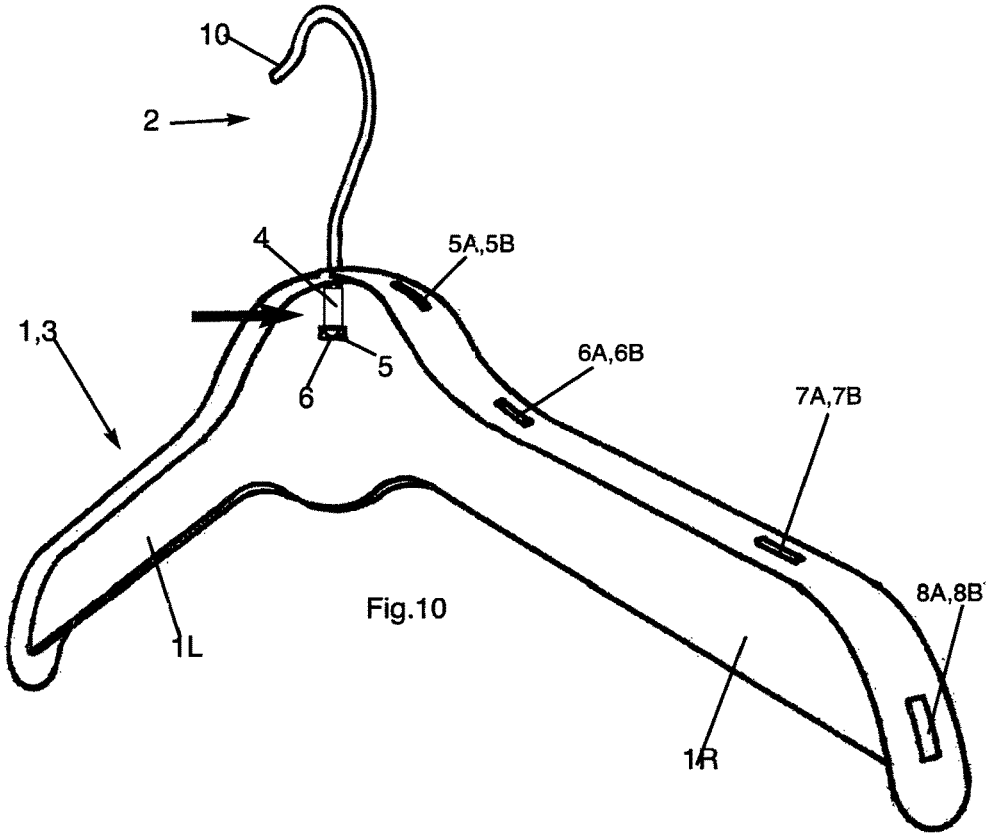
FIG. 10 shows the hook and bracket, set into the hanger.
Figure 11:
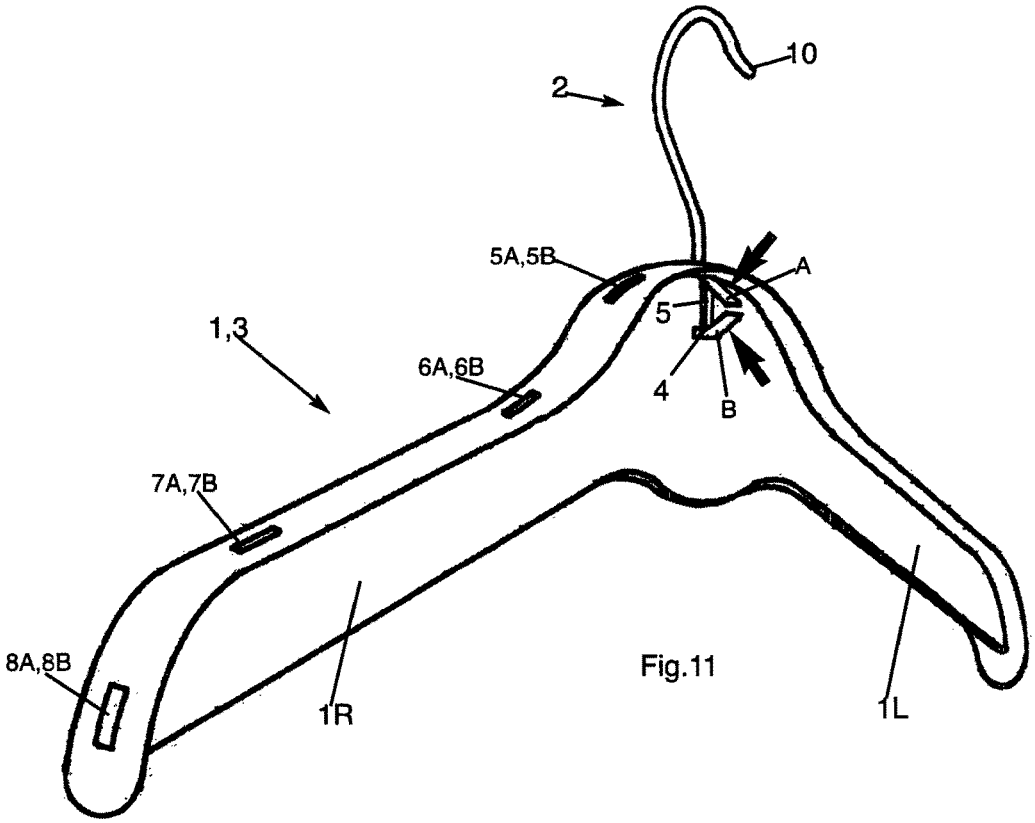
FIG. 11 shows the other side of the hanger prior to the tabs on the bracket being pushed inwards to fix the hook in place.

In FIG. 10 the front of the fully assembled hanger 1, 2, 3, 4 is shown with the hook 2 and bracket 4 in situ, and in FIG. 11 the arms A, B of the bracket 4 are shown being pushed together to lock the bracket 4 and hook 2 in position, allowing the hook 2 to rotate within the holes 7.8 cut into the upper and lower arms of the bracket 4.

Figure 12:
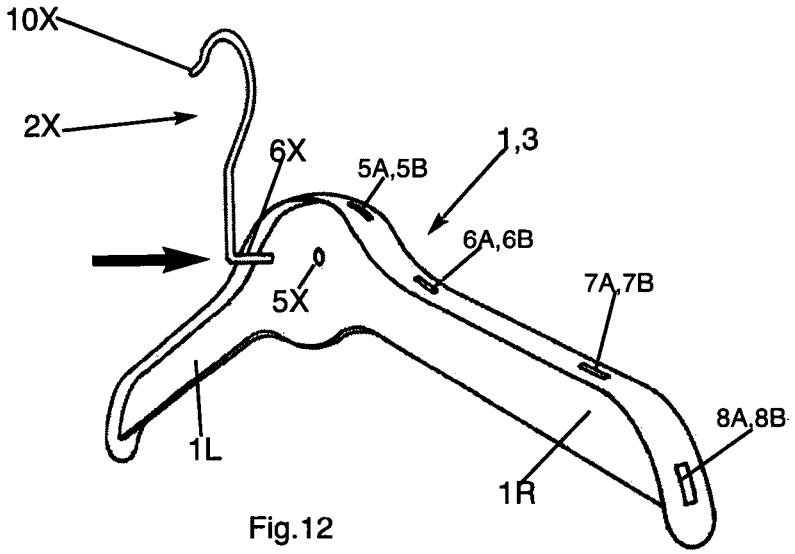
FIG. 12 shows an alternative non-rotating hook, without the pommel, with the end section bent upwards at 90 degrees to the shaft, ready to be inserted into a hole set into the main section of the hanger.
Figure 13:
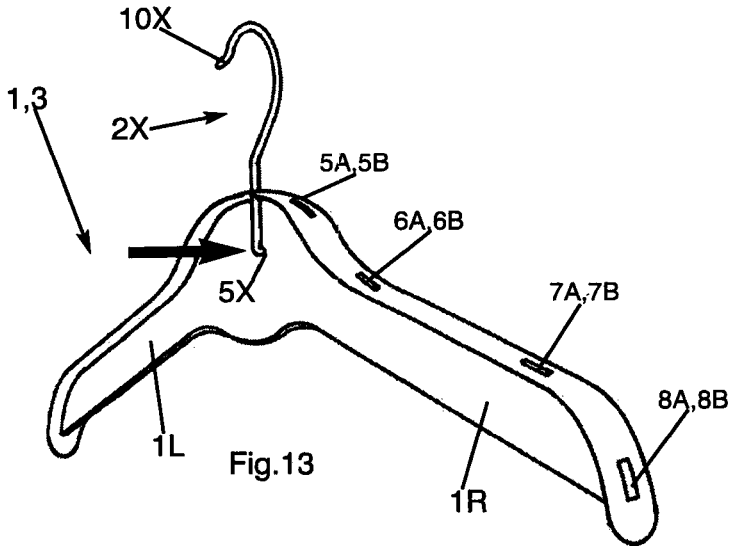
FIG. 13 shows the hook set into the hanger from the front.
Figure 14:
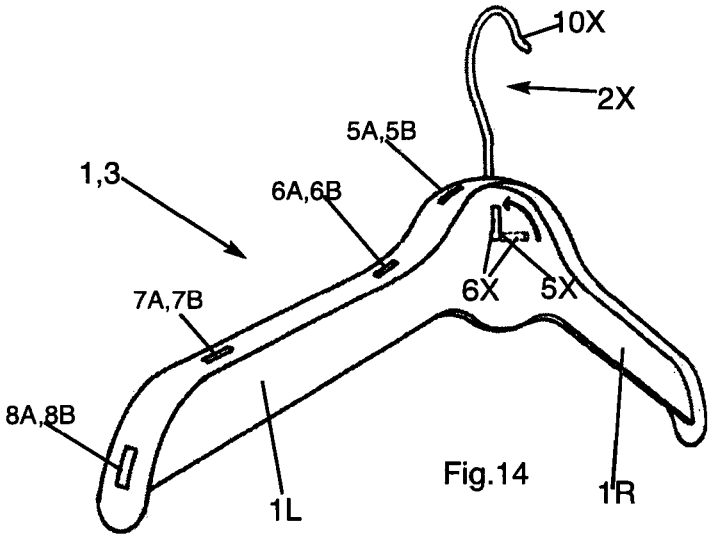
FIG. 14 shows the other side where the end section is pushed upwards, to become parallel to the shaft, thereby fixing the hook in position.

FIGS. 12-14 show a simpler alternative to the previous embodiment, insofar as it dispenses with the bracket 4 and pommel on the hook 6, in favour of a short length of the bottom of the hook shaft 2X being bent upwards at 90 degrees (FIG. 12) and attaching to the hanger 1, 3 by being inserted into a small hole 5X bored through the centre of the hanger frame, 1 (FIG. 13) and then on the other side (FIG. 14) being bent upwards parallel to the hook-shaft 2X, to fix the hook 2X in position. This hook 2X is non-rotatable.

Figure 15:
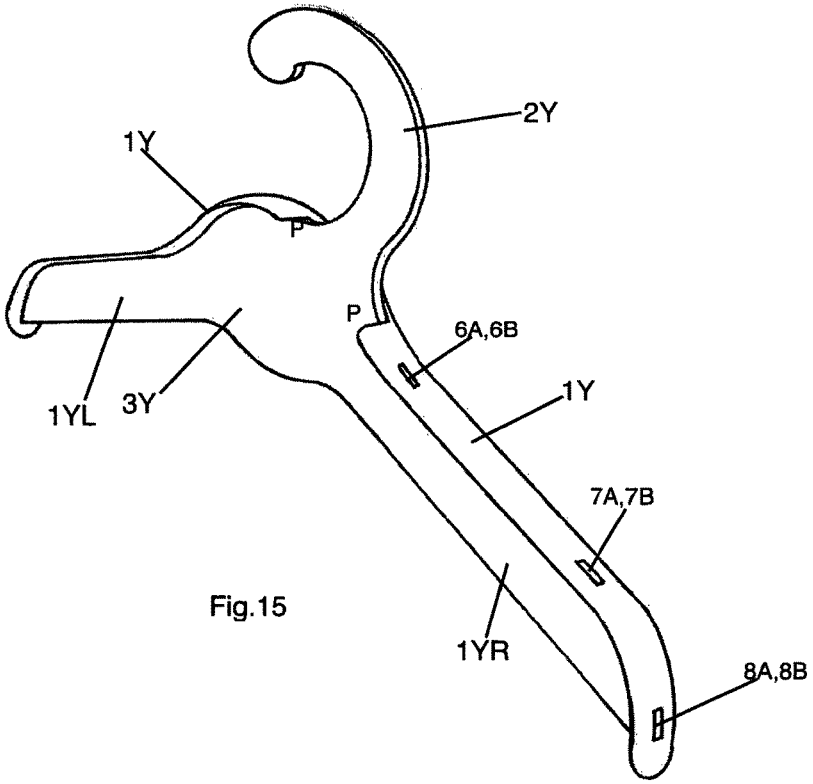
FIG. 15 shows the hanger with an incorporated hook extended from the main body of the hanger, and projecting through a slot cut into the top-strip, which may also be an opening created between two separate strips.

FIG. 15 shows the version of the hanger 1Y, 2Y, 3Y where the hook 2Y is made by creating it as an extension of the hanger frame 3Y, and accommodating the incorporated hook at a slot or gap P-P created on an outer edge of the top-strip 1Y.

Figure 16:
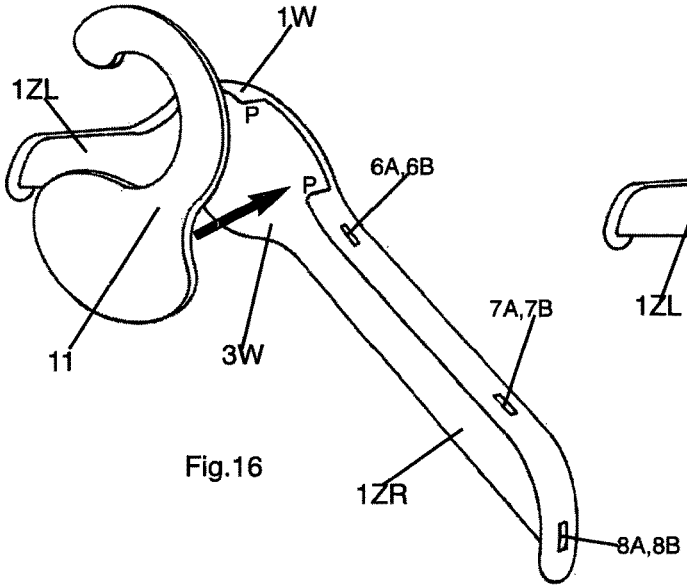
FIGS. 16 & 17 show how a planar hook may also be attached to the hanger which has been provided with a gap on an outer edge of the top strip to accommodate it.
Figure 17:
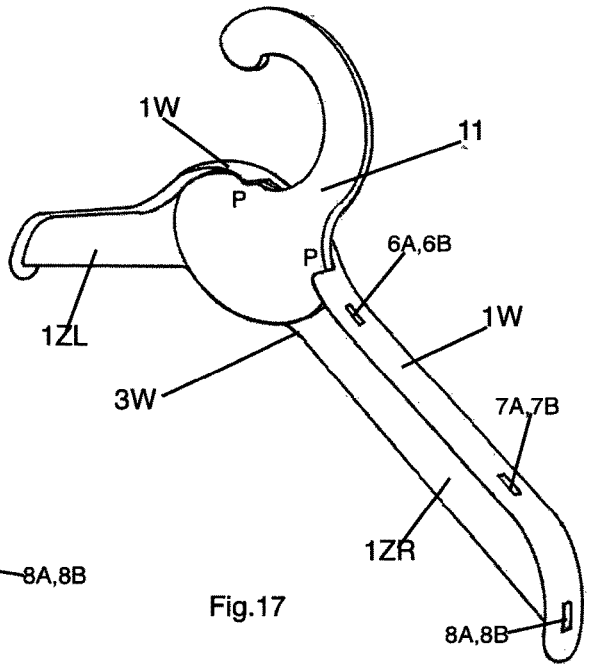

FIG. 16 shows another combination, where a planar, non-integral hook 11 is joined onto a 'T-section' hanger 1W, 3W by being attached to the front surface of the hanger 1W, 3W, the upward sweep of the hook 11 being accommodated at the same slot or gap P-P formed on an outer edge of the top-strip 1W.

Planar Grippers

According to FIG. 18, therefore, a hanger 1, has been designed with grippers L4, L5 and R5, R4 positioned on the underside, and on either side of the hanger bar 3L, 3R of the hanger 1. The outer grippers L4, R4 are made wider for thicker material, the inner grippers L5, R5 are narrower for thinner material. Each gripper, L4, L5, R5, R4 has teeth 1ZZ, 1YY, 2ZZ, 2YY and 3ZZ, 3YY, 4ZZ, 4YY. Taking one gripper L4, set between projections L1 and L2 on the left of the hanger 1, a set of upward pointing teeth 1ZZ and 1YY have been positioned. The teeth 1ZZ and 1YY project inwards and upwards from the channel walls L4, with the lower surfaces of the teeth 1ZZ, 1YY at an upward angle, to meet the top surface of the said teeth 1ZZ, 1YY, which projects outwards from the channel wall L4 horizontally, or near horizontally, to create a sharp point. This design forms a 'zig-zag' channel between the teeth 1ZZ, 1YY, up which material, such as a garment seam A (FIG. 21) may be pushed without obstruction. The weight, however, of the garment tends to pull it downwards, thereby engaging the garment A with the upward-pointing teeth 1ZZ, 1YY which act as 'barbs' retaining the garment A in the gripper L4. In FIG. 20 release is effected by pulling down sharply on the garment A. If the gripper L4 is made from paper or board, the teeth 1ZZ, 1YY will be able to 'flex' slightly, and will be more 'forgiving' than such a gripper made from plastic would be, and therefore, no damage would occur to a normal piece of material. FIGS. 21, 22, 23 are generic drawings showing how this works. FIG. 21 is a side elevation of a section 3 comprising the gripper 4, with staggered teeth Z, Y projecting inwards from either side of the gripper channel 4, and in FIG. 22 a piece of material/garment A is pushed upwards into the gripper channel 4 where it pushes outwards over the tops of the inward facing teeth Z, Y (FIG. 23). In FIG. 24, the hanger 1 is shown in one of the ways a garment A may be held.

FIGS. 25 & 26 show a box 5 configuration of the grippers 7,8 set opposite each other on either side of the box 5, comprising teeth 5ZZ, 5YY and 6ZZ, 6YY set in the same configuration as discussed in relation to FIGS. 18-23. The box 5 is shown located on a hanger bar 6. This configuration provides a double gripper 7, 8 set across from and vertically parallel to each other making a stronger hold on the garment. This kind of box-gripper 5 may be used singly suspended from a hook/string etc., or attached to a bar-hanger 6. The configuration may also be applied to a cylinder. FIG. 26B shows the flat gripper 5B as an attachable unit deployed on the hanger bar 6B.

According to FIG. 27 there is provided a platform 9, into which two upright pins 10A, 10B have been set a short distance from each other. The pins 10A, 10B may be cylindrical and may be identical in width and height. In FIG. 28 a hanger bar 11 is shown with its underside facing the pins 10A, 10B. Into the underside of the hanger bar 11 have been cut two indents 11A, 11B corresponding exactly in size and distance apart, to the pins 10A, 10B set into the bed 9. The hanger bar 11 is pushed towards and onto the pins 10A, 10B, so that the pins 10A, 10B sit within the indents 11A, 11B on the underside of hanger bar 11 (FIG. 29), and glue X may be applied to the center section of the hanger bar 11 at this point. The hook 12 is seen on the bed/tray 9 prior to location on top of the hanger bar 11. The hook 12 may be configured at its base in a similar shape to the underside of the hanger bar 11, and two indents12A, 12B the same size, shape and distance apart as the indents 11A,11B on the underside of the hanger bar 11, are cut, such that when the hook 12 is located onto the pins 10A, 10B at the indents 12A, 12B (FIG. 30) the two parts of the hanger, the bar 11, and the hook 12 are configured to the form of the complete hanger 11, 12. If an adhesive X is being used to join the two sections 11, 12, pressure may be applied at this point to join the sections 11, 12. The two sections 11, 12, however may also be joined in a number of other ways, e.g., staple, pin, locking section, clip etc. The complete hanger 11, 12 is shown in FIG. 31.

Tubular Grippers

According to FIGS. 32-35, there is provided apparatus 1 of a substantially cylindrical form, configured at the lower end to form two 'jaws' 1F, 1B created by cutting two parallel slits or apertures 6, 7 on either side of the apparatus 1 and running along the length of the cylinder, a short distance upwards from the lower end, facing each other across the diameter of the apparatus 1. One or both of the inner edges of these slits 6, 7 may be configured with 'teeth' X. At the open or lower end of these slits 6, 7 an inverted 'V' shape has been cut form a 'mouth' 8, 9 to allow a garment 10 to be inserted (FIG. 35) between the jaws 1F, 1B. In this embodiment, the apparatus 1 has also another two parallel slits or apertures 4, 5 cut into the upper section and facing each other across the diameter of the cylinder to allow the apparatus 1 to attach to a hanger 2 (FIG. 36), or to any other display system, such as a hook 3. In FIGS. 37A & 6B an alternative configuration of the apparatus 1 has cut a recess 5X into the rear of the apparatus 1, allowing the apparatus 1 to be dropped onto a bar 2L (FIG. 37B) so that it may be used on a closed-loop hanger (one with a cross-bar where no 'end' is accessible on the bar.). In FIGS. 7-10 the side elevations of an unassembled alternative apparatus 1A, 2A are shown. In FIGS. 38 & 41 are shown side elevations of the inner tube 1A, and in FIGS. 39 & 40, side elevations of the outer tube 2A are shown. FIG. 42 shows the assembled apparatus 1A, 2A, prior to deployment, and FIG. 43 shows how it is deployed on a hanger bar 11L. FIG. 44 shows how the outer cylinder 2A is rotated to cause the apertures 6B, 7B to overlap the apertures 6A, 7A on the inner cylinder 1A, and FIG. 45 shows the same with a garment 10 in situ between the jaws 9F, 8F and 9B, 8B with apparatus 1A, 2A in the closed position.

In FIGS. 46-49, both side elevations of the inner 1B and outer 2B cylinders of similar type of cylindrical gripper 1B, 2B are shown. In FIGS. 50 and 51 a perspective view of the assembly of the apparatus 1B, 2B shows how the slits and apertures are lined up prior to attachment to a hanger bar 11L or other support (FIG. 52). In FIG. 53 a garment 10 has been inserted into the apertures 6D, 6C, 7D, 7C between the jaws 7F, 6F and 7R, 6R. FIG. 54 shows the first movement of the outer cylinder 2B, being turned to trap the garment 10 between the converging edges of the outer slits 6D, 7D, and those of the inner slits 6C, 7C. In FIG. 55, the downward drop of the outer cylinder 2B, allows the top of the bar 11L to rise into the locking slots 12C, 12D extending from the top right side of the apertures 12A, 12B to keep the apparatus 1B, 2B in a locked position. 9 See FIGS. 56-58 for views of other side of apparatus 2B, 1B) Release is effected by pushing up on the outer cylinder 2B and turning it back to release the garment 10 from the jaws 7F, 7R and 6F, 6R.

FIGS. 56-58 show those same movements in perspective from the other side of the apparatus 1B, 2B. FIGS. 59-61 show in cross-section from below, the action of trapping the garment 10 between the jaws 7F, 6F and 7R, 6R, when the outer cylinder 2B is rotated around the inner cylinder 1B. FIGS. 59-61 also illustrate how the apparatus 1A, 2A disclosed in FIGS. 38-45 works to hold a garment 10.

A further development, is disclosed in FIGS. 62-66, where a short section of tube 14 is slit along its length X-Y to form a gripper 14 which may be widened at either end with a 'V' cut to allow a garment 10 to be forced (FIG. 63) between the two parts of the cylinder 14 along the cut X-Y. FIG. 64 shows a possible deployment of the apparatus 14 as a pair located into slits A-A, B-B on a hanger 13. FIG. 65 shows this apparatus 13, 14 deployed to hold a garment 10.

In FIG. 66 the apparatus 14 is shown deployed as a single unit supported by an 'S' hook 3.

Developments in Garment Display

FIG. 67 shows the profile of the unfolded support section 1, and FIG. 69 is an elevation of the crossbar 2 with legs 1L, 2L, 3L and 1R, 2R, 3R cut from the underside of the crossbar 2. FIG. 68 shows the support section 1 folding along a double fold-line A-A, and a latch-panel 12 folding inwards from the front hook 13F. In FIG. 70 the crossbar 2 is inserted into the central fold-line A-A of the support section 1, which sits within the indent D-D supported below and on either side, by the projections 16L, 16R. In FIG. 71 the two hooks 13F & 13B are brought together and latched by folding the latch-section 12 from out of the hook 13F along fold-line B-B, and through the hook 13B so that the tab 15 can be inserted upwards into the slot 14 on the panel 13G, holding the two sides 13G, 13E and two hooks 13B, 13F of the support section 1 together around the crossbar 2. FIGS. 72 & 73 are front and back elevations of the assembled hanger 1,2. Located on the outer edges of the two legs 1L, 2L, 1R, 2R of the crossbar 2, are some small 'teeth' 1L, 17L, 1R, 17R, which may help to keep a garment from moving or falling off the hanger 1, 2. This feature has been retained on all the embodiments of this type. FIG. 74 shows how a garment P is located on the hanger 1, 2, and FIG. 75 shows how a larger garment P may be deployed on the hanger 1, 2. Again, this is the way garments hang on this type of hanger.

FIG. 76 is a profile of the unfolded support section 3 featuring above the double fold-line K-K, at the top, one half of the hook 17F with the latch-section 18 set within it, and the front panel 17G, with, 'wings' 20L, 20R on either side, which fold inwards along vertical fold-lines L, M and N, O leaving apertures P-P and Q-Q formed as the cuts P-P and Q-Q are set outwards a short distance from the fold lines L, M and N, O. The width of the apertures P-P and Q-Q is set to the thickness of the crossbar 4 (FIG. 77) as is their height set to the width of the crossbar 4. Below the fold-line K-K, is the other half of the support section 3 with the hook 17B at the far end, and incorporating the slot 31 for engaging the latch 18 on the other hook 17F. FIG. 77 shows the crossbar 4 in elevation, with the ends 29, 30 each configured with two parallel slits 21T, 21B and 22T, 22B, accessible from top and bottom of the hanger. The slits 21T, 21B and 22T, 22B may be horizontal, but in this version they are angled downwards to keep the garment secure. Small projections 25, 26 and 27, 28 have been formed on the top and bottom edges of the crossbar 4 to constrict the wings 20L, 20R during deployment.

FIG. 78 shows the first stage of assembly of the hanger 3,4 with the crossbar 4 having been slid through apertures P-P and Q-Q in the wings 20R, 20L of the support section 3, such that the small projections 25, 26 and 27, 28 lie outside the wings 20L, 20R, and the back section panel 17E and hook 17B being folded along fold-lines K-K towards its neighbour the panel 17G with hook 17F. FIG. 79 is the same as FIG. 71, showing how the exact same latch 12, 18 functions. FIG. 80 shows the fully deployed hanger where a ladies bra has been supported by slipping the straps of the garment through the slits 21T, 21B and 22T, 22B, around the centre bar 29, 30 at either end of the crossbar 4.

FIGS. 81-99 concern variants of the support section of the first type of hanger 1, 2, concerning various methods of increasing rigidity, but will clearly have application across a wide range of product. FIG. 81 shows a front elevation of the crossbar 6 including an extra horizontal top-section 6A, running along the entire length of the crossbar 6 divided from it by a fold-line R-R. Additionally, two small tabs 32L, 32R cut into the lower edge of the crossbar 6, and set centrally, a short distance apart on the lower edge of the crossbar 6, between the leg-groups 3L and 3R, and attached by horizontal fold-lines L-L, M-M, will fold along fold-lines L-L, M-M after assembly, to constrict the wings 36L, 36R on the support section 5 (FIG. 84) and hold the support section 5 in the central position on the crossbar 6. FIG. 82 shows an alternative crossbar 7, where there is a single locking-tab 33, designed to fold upwards along fold-line N-N between the wings 36L, 36R, keeping the support section 5 centred. FIG. 83 shows a view of the obverse of the crossbar 6, where the top-section 6A is folded downwards along fold-line R-R to form an 'L' section.

FIG. 84 shows the support section 5, with the hook 34 surmounting the lower panel 35. Extending outwards from either side of the lower panel 35 of the support section 5, are wings 36L, 36R which, when folded inwards along vertical fold-lines S, T and U, V, open vertical apertures W-W and X-X between the wings and the central panel 35, as the cuts, W-W and X-X are set slightly outwards from the fold-lines S, T and U, V. The width of the apertures corresponds to the thickness of the material of the crossbar 6, just as the height of the apertures W-W, X-X corresponds to its width. At the top of the vertical apertures W-W, X-X, smaller apertures 37L, 37R contained within the wings 36L, 36R, set horizontally and at 90 degrees to, and continuous from, the vertical apertures W-W, X-X have been cleared to accommodate the 'L' section 6A (FIGS. 81-83) now folded downwards at 90 degrees to the top of the crossbar 6 along fold-line R-R. FIG. 85 shows how the crossbar 6 slides into and through, the apertures W-W and X-X, on the support section 5 with the top section 6A of the crossbar 6 being braced at 90 degrees by the small clearance 37L. The support section 5 is set at the centre of the crossbar 6 and locked into position by folding the locking tabs 32L, 32R upwards towards the back of the hanger 5, 6 (FIG. 86).

FIGS. 86 and 87 show the fully assembled hanger, 5, 6 from the front and back respectively. These hang garments in exactly the same way as shown in FIGS. 74 & 75.

FIGS. 88-92 show a similar variant, except that the fold-down section 9B on the crossbar 9, has had another section 9A added to it, above another fold-line Z-Z, making two parallel sections 9A, 9B running along the entire top edge of the crossbar 9 and separated from the crossbar 9 by fold-lines R-R and Z-Z, which when folded downwards, form a triangular 'box' 9A,9B with the surface of the crossbar 9. The support section 8 has been modified by replacing the two small cleared rectangles 37L, 37R (FIG. 84) by two small triangular apertures 37XL, 37XR, (FIG. 88) located at, and continuous from, the top of vertical apertures W-W, X-X located in the wings 36XL, 36XR. The positioning and locking tabs 32L,32R have been retained from the previous embodiment 5, 6 (FIGS. 86 & 87) and in FIGS. 25 & 26 the front and back views of the fully assembled hanger 8, 9 are shown with these tabs 32L, 32R pushed inwards along fold-lines L-L, M-M to lock the support section 8 at the centre of the crossbar 9.

With the development of the box structure 9A, 9B on the crossbar 9 (FIGS. 90-92) another variant, 10, 11 becomes possible as shown in FIGS. 95-99.

FIG. 93 shows in elevation, a new support section 10, comprising a hook 39 and a lower section 40 with indents 41L, 41R positioned above small 'shoulders' 42L, 42R. FIG. 94 shows a rear view of the modified crossbar 11, which retains the two additional extensions 11A, 11B from the previous crossbar 9 (FIGS. 89-92), divided by fold-lines R-R,Z-Z. With this embodiment 11, a series of 'teeth' 43, 44, 45, 46 have been extended from the outer edge of the top panel 11A on the crossbar 11, and below the fold line R-R, a series of slots 43A, 44A, 45A, 46A have been cut directly beneath the 43, 44, 45, 46. On the top edge of the section 11A, an indent 47 has been created between the teeth 44 and 45, at the centre of the crossbar 11. Also, at the centre of the fold-line R-R a slit 48 has been cut which may be slightly narrower than the indent 47 above.

When the two top sections 11A, 11B are folded downwards (FIGS. 94, 95) in the same way as the previous embodiment 9 (FIGS. 89, 90) the teeth 43, 44, 45, 46 projecting from the top outer section 11A are inserted into their corresponding slots 43A, 44A, 45A, 46A on the back surface of the crossbar 11, a box section 11A, 11B is created with surface of the crossbar 11 (FIG. 95). Being locked in this way provides the crossbar 11 with greater rigidity than the previous crossbar 9 (FIG. 90) which relied on the 'bracing' from its support section 8 to retain the form of the box 9A, 9B (FIGS. 91, 92).

In the new embodiment 10, 11, however, the box section 11A, 11B, being fixed to the main crossbar 11 at both the fold-line Z-Z, and by the teeth 43, 44, 45, 46 engaged with slots 43A, 44A, 45A, 46A, a smaller support section 10 may be inserted upwards (FIG. 96) through the indent 47 to engage at the indents 41L, 41R being retained at the shoulders 42L, 42R by the slot 48 which is now at the top-centre of the folded crossbar 11 and lying along fold-line R-R, and which may be cut slightly narrower than the width of the shoulders 42L, 42R on the support section 10. The fully assembled hanger is seen back and front in FIGS. 96 & 97 respectively.

FIGS. 98 & 99 show a variant crossbar 49 which combines characteristics from the types of crossbar discussed previously. On the outside is the outer leg 50L, around which the tensioned garments, e.g., pants may be wrapped around, prior to being hooked, depending on size, around any of the legs 52L, 52R. Between the legs 52L, 52R and the outer legs 50L, 50R are the sections 51L, 51R upon which hanging garments may be hung, e.g., a ladies bra, by any of the garments appendages being looped around the central section 51L, 51R, by being looped through the slits 51T, 51B and 52T, 52B.

FIG. 99 shows how profiles of any element requiring rigidity, in this case the crossbar 49, may be laminated, having been cut, either with different directions of 'grain' or, if having being created from any type of flute-board, cut with the 'flutes' running in different directions for the purpose of providing greater strength and rigidity. 49A is an example of a crossbar which has been cut with the flutes or grain running vertically, while below the same profile 49B has been cut with the flutes or grain running horizontally, prior to being laminated. In the current example, the flutes/grain are shown as vertical/horizontal, but it will be understood that these may simply be at any angle as long as each layer differs from the other.

In FIGS. 100-105, another fold-over hook/sleeve assembly 53 (FIG. 101) has been developed to attach to a modified crossbar 52, (FIG. 100). This fold-over 53 has attached to the lower inner edge of the front hook 60A, at fold-line B1-B1 a circular extension 54, and which in turn, has on its outer edge extending from fold-line C1-C1 a tab 57. In FIG. 102 the crossbar 52 is seen placed in situ on the inner surface of the 61A of the hook/sleeve assembly 53, prior to folding.

FIG. 102 shows the hook/sleeve 53 folded in position around the crossbar 52 at double fold-lines A1-A1, with base A1-A1 of the hook/sleeve 53 pushed up into the indent 56 cut into the lower edge of the crossbar 52, and the circular tab 54 folded inwards along fold-lines B1-B1 around the back of the hook/sleeve 53 to strap the front hook 60A to the back hook 60B. The tab extension 57, which extends outwards from the tab 54 is also folded inwards along fold-lines C1-C1 so that it enters aperture 59 cut into the upper back surface 61B, and thereafter traverses across the upper edge of the crossbar 52, at the indent 55, ending when it is pushed through an 'H' slit 58 cut horizontally into the upper section of the front panel 61A, at a height which corresponds to the position of the aperture 59 on the back panel 61B. Since the 'H' slit 58 has no clearance between the upper and lower sections separated by the horizontal slit, and the outer vertical cuts of the 'H' slit 58 allow both upper and lower sections of the slit to spread outwards when the tab 57 is in situ, this makes it difficult to retract the tab 57 from its grip, creating a secure pinning of the apparatus 52, 53 together. FIGS. 104 & 105 show front and back elevations of the assembled hanger 52, 53.

FIGS. 106-111 show an almost similar mechanism applied to the hanger 62, 63 for hanging garments, e.g., a ladies bra, where there is a requirement for a larger surface area 66A, 66B on the hook/sleeve 63. In this embodiment there may be a requirement, in order to save vertical space, that the crossbar 62 is set at the top edge of the panels 66A, 66B. This has been achieved by creating a slot 70 at the centre of the crossbar 62 in a position corresponding to the aperture 69 cut into the top-surface of the panel 66B, and the 'H' slit 68 cut into the opposite panel 66A, such that when the apparatus 62, 63 is assembled (FIGS. 108, 43) in exactly the same way as the previous embodiment 52, 53, with the extension 64 folded inwards along fold-lines E1-E1, strapping the hooks 67A, 67B together. However, unlike the previous embodiment 52, 53 the tab 65, after being inserted through the aperture 69 in the back panel 66B, penetrates through the aperture 70 cut into the crossbar 62, before ending its journey inserted into the 'H' slit 68 on the front panel 66A of the hook/sleeve 63, thereby suspending the crossbar 62 between the two panels 66A, 66B from the tab 65.

FIGS. 110 & 111 show the front and back elevations respectively, of the assembled hangers 62, 63.

In FIG. 112A planar hook 62B is shown in elevation, and in FIG. 112 a planar crossbar 71 of the bra-type is shown also in elevation.

In FIG. 114 the hook 62B and the crossbar 71 are shown joined together. These sections 62B, 71 may simply be glued, pinned, stapled and held together.

Sliding Clamp

According to FIG. 115 a hanger 1 is shown in elevation, showing the two arms 2, 3 extending from the centre of the hanger 1, and ending in a slightly larger end-piece or 'pommel' 4, 5 at steps 4*a*, 4*b* & 5*a*, 5*b*. In FIG. 116 a plan view of an extension 6 is shown prior to assembly, where the outer limbs 9A, 10A are folded inwards at fold lines A-A, D-D and fixed (FIG. 117) to the inner limbs 9B, 10B on either side of the lines P-P, N-N, (which are not folds) stopping short of the 'box' section 6A at lines P-P, N-N. FIG. 118 shows a perspective from below as the extension 6 is folded at fold-lines B-B, C-C so that the inner surfaces 9A, 10A meet and fit together to form the downward projecting leg of the extension 6, and leaving the top section formed now as a 'box' or loop 6A open at both sides, made to a height and width which will comfortably slide along the hanger arms 2, 3. FIG. 119 shows a front-elevation, and FIG. 120 is a perspective showing one open side of the box 6A. FIG. 121 shows an alternative extension 8, which has two legs S, T instead of one, with the same box 8A on top, made like the single-leg extension 6 to fit on the arms 2, 3 of the hanger 1 in the same way. FIGS. 122 & 123 show two methods of attaching the extensions 6. In FIG. 122 the box part 6A is simply forced over the pommel 4, 5 to slide onto and along the hanger arms 2, 3 and in FIG. 123 the extension 6 is wrapped around the arm, the two panels 9A, 10A being stuck together at that point perhaps with some kind of dry-adhesive. Both the single and double-leg extensions 6, 8 would be fitted in the same way. The extensions 6 may be retained on the arms 2, 3 by means of the small steps 4*a*, 4*b*, 5*a*, 5*b* located on the upper and lower edges of the pommels 4, 5.

FIG. 124 shows in perspective the extension 6 fitted to the hanger arm 2, while FIG. 125 is an elevation showing two single-leg extensions 6 located on the hanger and being capable of being slid in either direction along the length of the arms 2, 3 by applying horizontal pressure to either side of the box section 6A.

In FIGS. 126 & 127, the apparatus 1, 6 is deployed using a standard garment, in this case briefs 7, which are in FIG. 126 located on the extensions 6, and in FIG. 127 the extensions have been moved outward tensioning the garment 7 and causing the extensions 6 to lock in a position which will retain and display the garment 7 flat-on, so that its shape and appearance are seen to greatest advantage. FIG. 128 is a close-up showing the locking principle as the garment 7 pulls the extensions 6 into anchored mode. FIG. 128A shows an alternative extension 9 which ends in a hook 9*b*, which may be used to hang heavier garments such as jeans, skirts by utilising the belt-loops on jeans or loops on other garments. The same principle applies to the extent that the weight of the garment on the hook 9*b* which is set outwards from the extension 9 will also lock the extension against the arms 2, 3 in the same way as the extensions 6 and 8 which utilise the tension of a garment.

FIGS. 129-131 show the double-arm extensions 8 deployed to display a larger garment 7. These work in exactly the same way as the single-leg version, but with two legs S, T, projecting downwards and in this case, in different directions. FIG. 129 shows the extensions 8 located on each hanger-arm 2, 3 and FIG. 130 shows a standard size garment 7 deployed on the hanger 1. FIG. 130 shows a view from the obverse of a larger garment and how it may be deployed to retain tension while displaying as much of the front of the garment 7 as possible. In the case of a pair of briefs 7 the outer top is first located on the inner leg T of the extension 8, and then wrapped around the front outer leg S before being drawn back across the front of the hanger 1, wrapped around the outer legs of the opposite extension 8, and hooked on the inner leg T of that extension 8 to provide a display of as much of the front of the garment as possible. As in the first, single-leg extension 6, tension may be increased or decreased by moving the extensions 8 at the 'box' section 8A, inwards to release the garment 7, outwards to secure it.

In FIG. 132, is shown the front elevation of a substantially planar hanger 11 where each arm 12R, 12L has been split horizontally at some distance from the central body 11X of the hanger by means of a cut 17R, 17L to form 'jaws', 13R, 14R and 13L, 14L at each end. These jaws 13R, 14R and 13L, 14L may be roughened or contoured on their inner sides. Below the hanger 11 are shown, to scale, two clamping pieces 19R, 19L also flat, and with apertures 16R, 16L cut into their centres.

In FIG. 133, the clamping piece 19R is shown being slid onto the jaws 13R, 14R, and the lower end of the aperture 16R being located into the indent 15R cut into the outer edge of the lower jaw 14R, and pushed upwards in an arc, rotating around the centre of the radius centered on the indent 15R. FIG. 134 shows the hanger 11 with the clamping pieces 19R, 19L in situ ready to receive a garment. FIG. 135 shows a garment 20 being inserted into the space between the jaws 13R, 14R and the clamping piece 19R pushed upwards to close the jaws 13R, 14R to grip the garment. The fully deployed hanger 11, with the Jaws 13R, 14R and 13L, 14L and clamping pieces 16R, 16L all in the closed position holding a garment 20 (in this case a ladies swimming top) is shown in FIG. 136. FIG. 137 shows how the garment 20 is released by pushing outwards and downwards on the top of the clamping piece 19R to separate the jaws 13R, 14R.

FIG. 138 shows another version of the mechanism. A substantially planar hanger 21 is shown in elevation, and to scale immediately below, the grippers 25R, 25L and their clamping pieces 24R, 24L.

FIG. 139 is a side elevation of the flat gripper 25R with the clamping piece 24R in situ as it would be prior to attaching to the hanger arm 23R. The clamping piece 24R is slid onto the gripper 25R from the top, through the aperture 29R on the clamping piece 24R. FIG. 140 shows how the clamping piece 24R is deployed to close the jaws 28RF, 28RB by sliding it downwards along the increasing downwards-width of the gripper 25R forcing the jaws 28RF, 28RB to come together.

The clamping piece 24R is prevented from sliding off the lower end of the gripper 25R, by a small 'shelf' created by extending the form of the lower jaws 28RF, 28RB outwards a small distance to create checks 27RF, 27 RB.

FIG. 141 is a plan view of the clamping piece 24R.

In FIG. 142 the assembled gripper 25R, with its clamping piece 24R in situ just below the aperture 26R, is attached to the hanger arm 23R and slid inwards to any desired position along the arm 23R.

A side view of the fully deployed hanger 21 with its grippers 25R, 25L, and clamping pieces 24R, 24L is shown prior to its receiving a garment, with the clamping pieces 24R, 24L in the up position, and jaws 28RF, 28RB and 28LF, 28LB being open.

A garment 30, (a pair of jeans) is shown in FIG. 144, being inserted into the jaws 28RF, 28RB of the gripper 25R, and the clamping piece 24R being forced downward to close the jaws 28RF, 28RB on the edge of the garment 30, effectively trapping the garment 30. A close-up view of the gripper 25R holding the garment 30 is shown in FIG. 145.

FIG. 146 shows the fully deployed hanger 21, holding the garment 30 on the grippers 25R, 25L. Garments are released by pulling upwards on the clamping pieces 24R, 24L.

Clips

According to FIG. 147, the hanger frame 1 is shown in a front elevation, featuring two apertures 3A, 3B cut into the hanger 1 running horizontally along the two arms 3X, 3Y ending near the centre of the apparatus 1 in an elliptical access 4A, 4B, and stopping short of the outer edges of the arms 3X, 3Y. FIGS. 148-150, show a spring clip 2, where one side of the clip 2, has two 'arms' 5, 6 incised from the surface, (or which may be formed as an attachment) lifted outwards and folded to form two 'hooks' 5, 6 facing in opposite directions along the length of the clip 2. FIG. 148 shows the 'hooks' 5, 6 in front elevation, and FIG. 149 shows the side elevation. FIG. 150 shows an angled view.

FIG. 151 shows the clip 2 being placed on the front surface of the arm 3X of the apparatus 1, in the position for engagement with the aperture3A and access 4A, and FIG. 152 shows the same from the obverse, with the hooks 5, 6 being inserted into the access 4A. FIG. 153 shows, also from the obverse, how the clip 2 is pushed inwards so that the top hook 5 grips the section of the apparatus 1, prior to being turned downward (FIG. 154) so that the grip-end of the clip 2 points down, and the hooks 5, 6 engage with the upper & lower edges of the aperture 3A, 3B, allowing the clip 2, to be slid (FIG. 155) along the arms 3X, 3Y to any position the user requires. FIG. 157 shows the clip 2 located mid aperture on the arm 3X of the apparatus 1. FIG. 158 shows a schematic view of the completed hanger 1 with two clips 2, 2B located on each arm 3X, 3Y ready for use.

FIGS. 159, 160 show an alternative clip 6 configuration, where a gripper 7 has been formed, either as an extension of one of sides of the clip 6, enabling to be attached to the apparatus 1, or to any hanger with a cross-bar section, enabling the clip 6 to drop over it.

According to FIG. 161 a hanger 8 with a hook 9 is created as an extension of the hanger 8 and on the closed outer edge of the hook 9, is an extension 10 to provide that load-bearing part of the hook 9 with extra strength at a possible weak point, and having two arms 11L, 11R, each of which has two depressions 11A, 11B cut into the top surfaces towards the outer ends of the arms 11R, 11L.

FIG. 162 shows a configured rod 12 which may be metal, which has been bent to 90 degrees upwards at either end, to form, at the end, 'loops' 14A, 14B configured to slide downwards over the top edge of the hanger arms 11L, 11R perhaps, though not necessarily into the depressions 11A, 11B on the arms 11L, 11R of the hanger 8. Along the horizontal part of the rail 12, are located two spring grippers 13A, 13B. FIG. 163 shows the hanger 8, with the clip-rail 12 attached. FIG. 164 shows the clip rail 12 again, as a reference for FIGS. 165-169.

FIG. 165 shows a close-up of the loop 14A in front elevation, and FIG. 166 shows a side view which shows the loop 14A coming over the top of the hanger 8 and downwards before bending very slightly inwards to grip the hanger 8 at the top-edge of the arm 11L within the depression 11A. FIG. 167 shows in plan view, the way the loop 14A turns slightly inwards before coming upwards again to meet the top of the loop 14A and being turned inwards towards it. FIG. 168 shows, again in plan view the way the loop 14A grips the hanger arm 11L at the top edge. FIG. 169 is a perspective drawing showing the way the loop 14A may be configured to grip the hanger 1 in the depressions 11A, 11B.

It will be appreciated that the loop configuration may be applied to a number of designs of hanger, and may be attached to the crossbar of a model either incorporating such a feature or not incorporating one.

FIG. 170 shows the hook 9 of the hanger 8 with the extension 10 projecting from the closed side of the hook 9. This extra material strengthens the hook 9 at its weakest point, making it less likely to break there.

Hanger Tubes

According to FIGS. 171 & 172 a substantially planer hanger 1 is shown in profile and in perspective. FIGS. 173 & 174 show the tube-shoulders 2R, 2L from beneath, where a cut D-E, F-G runs along the length of the tubes until it meets the loop configurations A, B, which have been created by excavating a number of sections, in this embodiment, four at the outer end of each tube-shoulder 2R, 2L leaving on the upper sides a common spine 5R, 5L by which the series of loops A, B are linked along the upper surface and outer end of the tube-shoulders 2R, 2L and suspended downwards. At the inner ends E, F of the tube-shoulders 2R, 2L which in this embodiment have been cut at a slight angle, there is on the upper tip, cut in the same direction as, and above the ends of, the cuts D-E, F-G, apertures CR, CL cut a short way along the length of the upper surface. FIG. 179 shows a perspective view of one of the tube-shoulders 2R.

In FIGS. 180-182 the way the tube-shoulder 2R may be fitted to the hanger 1 is shown in three movements. In FIG. 180 the tip 4R of the shoulder 3R of the hanger 1 is inserted into the inner end of the tube-shoulder 2R into the slit D-E at the 'E' end, and pushed (FIG. 181) all the way down and into the loop-section A. In FIG. 182, the inner end of the tube-shoulder 2R is then lowered onto the upper edge of the hanger-arm 3R, and pushed inward so that the edge of the hanger 1, at the central section engages with the aperture CR on the top inner-end of the tube-shoulder 2R, and the outer tip 4R pulls the loop-section A, downwards along the spine 5R to form a contoured end. It will be understood that since the hanger arms 3R, 3L are symmetrical, the fitting of the other tube shoulder 2L will be a mirror of the same operation.

In FIGS. 183 & 184, the fully deployed tube shoulders are seen from front and back respectively. FIG. 186 shows an extension of the concept to include the neck of the hanger, where the tube-shoulder may be extended inwards and partially cut, or excavated by a series of slits XR, XL around the circumference, to allow the tube shoulders 2R, 2L to continue upwards at the inner ends to form a contour at the neck of the hanger 1.

The tube-shoulders 2R, 2L are, in the present embodiment, held by the natural grip of the form. However, it will be appreciated that a more permanent fixing such as glue, staples or pins may also be used to provide a more permanent bond. Additionally, the slits D-E, F-G may have incorporated into them, a series of 'teeth' which may engage with indents cut into the hanger 1 at the point of contact, to lock the extensions 2R, 2L more firmly to the hangerl.

According to FIG. 187 there is provided a substantially planar centre section 6 of a clothes hanger, incorporating a hook 11, a centre section 12 and a lower section 13. Located between the centre section 12 and the lower section 13, two members 9,10 pointing outwards and slightly downwards from the centre, are separated along their length by two parallel cuts W-W and X-X on either side of the member 9, and Y-Y and Z-Z on either side of the member 10. Although these members 9, 10 protrude slightly from the edge of the centre section 1, they are essentially contained within it.

FIG. 188 is a side elevation of the tube 7 which has been configured to form a shoulder. Two tubes 7 and two stays 8 are provided for the apparatus 6, 7, 7, but as these are identical, only one has been illustrated. FIG. 189 is a plan view of the same, and FIG. 190 is a view from below. FIGS. 192 & 193 are end elevations. FIG. 191 shows the planar, curved, stay 8 which, as shown in FIG. 191 and in FIGS. 194-196, has at one end, a tab 21 for insertion into the aperture 20 cut into the bottom of the tube 7 just short of the first loop 14, and a tab 22 at the other end which pulls the loops 14, 15, 16 downwards, causing the spine 17 at the top to assume a rounded contour.

FIGS. 197-199 show how the tubes 7 are fitted to the central section 6 by sliding onto members 9 & 10 along cuts W-W and X-X, Y-Y and Z-Z. The indents 18, 19 cut into the top and bottom edges of the inner end of the tubes 7 stabilise the tubes and prevent rotation.

FIGS. 200, 201 show the complete hanger 23. FIG. 200 shows a front view while FIG. 201 shows the obverse.

Quick Fix Hook

According to FIG. 202 a hanger has been configured with two apertures 4, 5 set centrally in a vertical position with the top aperture 4 cut in a circular form while the lower aperture 5 has been cut in a semi-circular shape with the flat edge at the top. FIG. 203 shows a perspective view of the hanger 1 and FIGS. 204 & 205 show back and front views of the hook apparatus 2. FIG. 206 is a side elevation of the apparatus 2 showing how the spur 9 is created by bending the base 'U'-bend outwards from the stem 7 side and pointing slightly upwards. FIGS. 208-210 are schematic drawings showing how the hook apparatus 2 is deployed onto the hanger 1 in a series of simple movements. In FIG. 208 the apparatus 2 is inserted into the top aperture 4 with the spur 9 pointing inwards towards the surface of the central section 3 of the hanger 1. FIG. 209 shows the same from the other side. In FIG. 210 the hook 6 is pulled upwards so that the spur 9 comes into alignment with the lower aperture 5. FIGS. 211 & 212 show a back and front view of the hanger 1 and hook 2 in the deployed position. FIG. 213 is a side-view cross-section showing how a section of the central part 3 of the hanger 1 is gripped between the stem 7 and the loop 8 and how the spur 9 slots into the lower aperture 5 stabilising the apparatus 2 in a vertical position. FIGS. 214 & 215 show how the apparatus 2 is released from the hanger 1 by pushing the spur 9 back through the aperture 5 from which it protrudes when deployed, and simultaneously pulling back on the stem 7 and hook 6 to disengage the spur 9 from the aperture 5, and also pushing downwards to release the grip of the loop 8 and stem 7 from the section above the aperture 4, whereupon the apparatus 2 is simply drawn back through the aperture 4. Also, both insertion and release may be expedited by introducing the apparatus 2 at the hook 6 end, and withdrawing it the same way, which would be the case if the aperture 4 were smaller than the loop 8 and spur 9.

The invention claimed is:

1. A clothes hanger comprising planar segments that are paper based or fiber-board based and that are assembled to define a hanger shape for suspending a garment, comprising:

a hanger frame formed from a first planar segment having outwardly extending arms;

a top strip formed from a second planar segment;

wherein:

the top strip is horizontally secured onto each of the arms of the hanger frame with the hanger frame disposed vertically, and the hanger frame has a plurality of in-plane tabs projecting outwards from an upper surface of each arm of the hanger frame and the top strip has a plurality of apertures corresponding to the plurality of tabs of the hanger frame such that the tabs of the hanger frame have slotted into the apertures of the top strip.

2. The clothes hanger of claim 1, wherein the top strip has a width greater than a thickness of the hanger frame, preferably at least twice as great, three times as great, four times as great or more.

3. The clothes hanger of claim 1, wherein the hanger frame and the top strip are arranged to form a T-shaped cross-section.

4. The clothes hanger according to claim 1, wherein:

the top strip has a centrally located indent for receiving a hook for suspending the hanger from a rail, wherein the hook is optionally a wire based hook.

5. A cylindrical clothes gripper that is paper based or fiber-board based for gripping a garment to be suspended by the gripper, comprising:

opposing channel walls defining a channel therebetween within which a portion of the garment may be inserted from a tip of the channel towards a base of the channel;

a plurality of teeth protruding into the channel from the opposing channel walls for engaging a portion of a garment.

6. The planar or cylindrical clothes gripper according to claim 5, wherein the teeth are disposed on the opposing channel walls such that they are situated in a staggered arrangement.

7. A clothes hanger comprising a plurality of cylindrical clothes grippers according to claim 5.

8. A clothes hanger according to claim 7, comprising:

a hanger frame formed from a first planar segment having outwardly extending arms from which a garment can be suspended.

9. A box gripper element comprising:

first and second planar clothes grippers that is paper based or fiber-board based, comprising:

opposing channel walls defining a channel therebetween within which a portion of the garment may be inserted from a tip of the channel towards a base of the channel;

a plurality of teeth protruding into the channel from the opposing channel walls for engaging a portion of a garment the box gripper element comprising a box having four interconnected walls defining a tube and the first planar clothes gripper is formed in one wall of the box such that the channel of the planar clothes hanger gripper extends parallel to the axis of the tube, and the box further comprising:

the second planar clothes gripper, wherein:

the first and second planar clothes grippers are disposed on opposing walls of the box.

10. The box gripper element according to claim 9, further comprising: a slot for receiving a hanger bar.

11. The cylindrical clothes gripper of claim 5, wherein the cylinder is tubular, formed from a rolled segment of planar material, and wherein the cylinder includes opposed gripping jaws disposed at an end, preferably a bottom end, of the cylinder, the gripping jaws including first opposed channel walls including the plurality of teeth and second opposed channel walls including the plurality of teeth, wherein the channels separate the jaws.

12. The cylindrical clothes gripper of claim 11, wherein the cylinder comprises a slot for receiving therethrough a hanger bar of a clothes hanger.

13. A clothes hanger for suspending a garment, comprising:

a hanger centre piece formed from a planar segment that is paper based or fiber-board based and;

hanger tubes that are paper based or fiber-board based and have a first end and a second end, wherein:

the hanger tubes are arranged to fit onto the hanger centre piece, wherein the hanger tubes serve as hanger arms extending outwardly from the centre piece from which a garment may be suspended wherein a plurality of loop configurations sharing a common spine, or a slitted or slotted arrangement extending partly through a circumference of the respective tube, is formed at a first end region encompassing the first end of each hanger tube to allow for bending of the respective hanger tube.

14. The clothes hanger according to claim 13, wherein:

the hanger centre piece comprises a hanger tube retention tab surrounded by two hanger tube slits, over which hanger tube retention tab the hanger tube can be fitted through the hanger tube slits.

15. The clothes hanger according to claim 13, further comprising:

a hanger stay dimensioned to fit within the first end region of the hanger tube thereby to retain the first end region in a curved configuration.

16. The clothes hanger according to claim 13, wherein the tube is made of a rolled sheet of material.

17. A clothes hanger, comprising:

a hanger frame formed from a first planar segment that is paper based or fiber-board based, the first planar segment having outwardly extending arms from which a garment can be suspended and a slot;

a hanger hook that is wire-based;

a bracket defining upper and lower legs each of which having holes accommodating the hanger hook, the holes of the bracket facilitating the sliding of the bracket along the hanger hook from a tip of the hanger hook so as to rest on a widened end of the hanger hook, the bracket being inserted into the slot of the hanger frame, portions of each leg extend through the slot and are folded thereby to secure the bracket and the hanger hook to the hanger frame.

* * * * *